US011761297B2

(12) United States Patent
Jacob

(10) Patent No.: US 11,761,297 B2
(45) Date of Patent: Sep. 19, 2023

(54) METHODS AND APPARATUS FOR PROVIDING A PLUG ACTIVATED BY CUP AND UNTETHERED OBJECT

(71) Applicant: Gregoire Max Jacob, Houston, TX (US)

(72) Inventor: Gregoire Max Jacob, Houston, TX (US)

(73) Assignee: SOLGIX, INC, Houston, TX (US)

( * ) Notice: Subject to any disclaimer, the term of this patent is extended or adjusted under 35 U.S.C. 154(b) by 0 days.

(21) Appl. No.: 17/892,015

(22) Filed: Aug. 19, 2022

(65) Prior Publication Data

US 2022/0389789 A1 Dec. 8, 2022

Related U.S. Application Data

(63) Continuation of application No. 17/275,509, filed on Mar. 11, 2021.

(51) Int. Cl.

| | |
|---|---|
| ***E21B 33/134*** | (2006.01) |
| ***E21B 23/01*** | (2006.01) |
| ***E21B 23/06*** | (2006.01) |
| ***E21B 33/128*** | (2006.01) |
| ***E21B 33/129*** | (2006.01) |

(Continued)

(52) U.S. Cl.

CPC ..... *E21B 33/134* (2013.01); *E21B 23/01* (2013.01); *E21B 23/06* (2013.01); *E21B 33/128* (2013.01); *E21B 33/129* (2013.01); *E21B 23/0411* (2020.05); *E21B 23/0413* (2020.05); *E21B 33/1295* (2013.01); *E21B 2200/08* (2020.05)

(58) Field of Classification Search

CPC ..... E21B 33/134; E21B 19/24; E21B 23/01; E21B 23/06; E21B 33/124; E21B 33/128; E21B 33/1285; E21B 33/129; E21B 33/1293; E21B 2200/08; E21B 23/0411; E21B 23/0413; E21B 23/04; E21B 33/1292

See application file for complete search history.

(56) References Cited

U.S. PATENT DOCUMENTS 30,023 A * 9/1860 Gilmore ..... E21B 1/02 175/401
47,819 A * 5/1865 Haupt ..... E21B 1/30 173/55

(Continued)

*Primary Examiner* — Robert E Fuller
*Assistant Examiner* — Neel Girish Patel
(74) *Attorney, Agent, or Firm* — Innovation and Patent IP Houston, LLC

(57) ABSTRACT

A plug assembly includes an expandable assembly, a locking ring and a cup. The expandable assembly is adapted to be deformed radially over the locking ring and the cup. The locking ring has a stopping inner surface. The plug assembly is used with one or more untethered objects, the untethered objects having an outer surface adapted to couple with the cup, and the cup having an outer surface adapted to couple with the stopping inner surface of the locking ring. The combination of cup and untethered objects is also adapted to contact an inner surface of the plug assembly and, using well fluid pressure, to apply forces to the plug assembly. The forces cause the longitudinal movement of the cup and untethered objects while contacting the inner surface of the plug assembly until the cup contacts the stopping inner surface of the locking ring.

20 Claims, 50 Drawing Sheets

(51) Int. Cl.
*E21B 23/04* (2006.01)
*E21B 33/1295* (2006.01)

(56) References Cited

U.S. PATENT DOCUMENTS

| | | | | |
|---|---|---|---|---|
| 2,331,532 | A | 8/1940 | Bassinger | |
| 5,131,468 | A | 7/1992 | Lane et al. | |
| 5,819,846 | A | 10/1998 | Bolt, Jr. | |
| 5,984,007 | A | 11/1999 | Yuan et al. | |
| 6,220,349 | B1 | 4/2001 | Vargus et al. | |
| 6,394,180 | B1 | 5/2002 | Berscheidt | |
| 7,475,736 | B2 | 1/2009 | Lehr et al. | |
| 7,510,018 | B2 | 3/2009 | Williamson | |
| 8,579,024 | B2 | 11/2013 | Mailand et al. | |
| 8,684,096 | B2 | 4/2014 | Harris et al. | |
| 8,887,818 | B1 | 11/2014 | Carr et al. | |
| 8,997,859 | B1 | 4/2015 | Ackermann | |
| 9,027,655 | B2 | 5/2015 | Xu et al. | |
| 9,027,659 | B2 | 5/2015 | Martinez et al. | |
| 9,062,543 | B1 | 6/2015 | Snider et al. | |
| 9,080,403 | B2 | 7/2015 | Xu et al. | |
| 9,284,803 | B2 | 3/2016 | Stone et al. | |
| 9,309,733 | B2 | 4/2016 | Xu et al. | |
| 9,316,084 | B2 | 4/2016 | Carter et al. | |
| 9,316,086 | B2 | 4/2016 | Van Lue | |
| 9,382,787 | B2 | 7/2016 | Naedler | |
| 9,732,579 | B2 | 8/2017 | Hiorth et al. | |
| 9,752,407 | B2 | 9/2017 | Jacob | |
| 9,835,003 | B2 * | 12/2017 | Harris | E21B 33/1208 |
| 9,976,381 | B2 | 5/2018 | Martin et al. | |
| 9,988,867 | B2 | 6/2018 | Jacob et al. | |
| 10,066,453 | B2 | 9/2018 | Silva | |
| 10,385,651 | B2 | 8/2019 | Smith et al. | |
| 10,408,012 | B2 | 9/2019 | Martin et al. | |
| 10,472,927 | B2 | 11/2019 | Marcin et al. | |
| 10,508,526 | B2 | 12/2019 | Ring | |
| 10,648,275 | B2 | 5/2020 | Dirocco | |
| 10,662,732 | B2 | 5/2020 | Frazier | |
| 10,724,311 | B2 | 7/2020 | Parekh et al. | |
| 10,794,142 | B2 | 10/2020 | Stone et al. | |
| 11,002,104 | B2 | 5/2021 | Wolf et al. | |
| 11,021,927 | B2 | 6/2021 | Hiorth | |
| 11,047,186 | B2 | 6/2021 | Ng et al. | |
| 11,072,991 | B2 | 7/2021 | Martin et al. | |
| 11,125,045 | B2 | 9/2021 | Hern et al. | |
| 11,274,525 | B2 | 3/2022 | Kratochvil | |
| 11,396,787 | B2 | 7/2022 | Kellner et al. | |
| 11,408,245 | B2 | 8/2022 | Dudzinski | |
| 11,428,089 | B2 | 8/2022 | Winkler et al. | |
| 11,434,717 | B2 | 9/2022 | Jacob | |
| 11,492,867 | B2 | 11/2022 | Yuan et al. | |
| 2003/0188876 | A1 * | 10/2003 | Vick | E21B 33/1208 166/134 |
| 2004/0079528 | A1 * | 4/2004 | Metcalfe | E21B 7/20 166/55 |
| 2013/0186647 | A1 * | 7/2013 | Xu | E21B 33/129 166/207 |
| 2013/0186650 | A1 * | 7/2013 | Xu | E21B 23/01 166/386 |
| 2013/0206409 | A1 * | 8/2013 | Stone | E21B 43/261 166/135 |
| 2014/0262344 | A1 * | 9/2014 | Standridge | E21B 33/129 166/208 |
| 2016/0047195 | A1 | 2/2016 | Snider | |
| 2016/0186511 | A1 | 6/2016 | Coronado | |
| 2016/0369582 | A1 * | 12/2016 | Bar | E21B 43/26 |
| 2017/0145781 | A1 * | 5/2017 | Silva | E21B 23/06 |
| 2018/0135380 | A1 * | 5/2018 | Saulou | E21B 33/128 |
| 2018/0148993 | A1 * | 5/2018 | Schmidt | E21B 33/1291 |
| 2018/0171748 | A1 * | 6/2018 | Hou | E21B 33/1293 |
| 2018/0274325 | A1 * | 9/2018 | Greenlee | E21B 33/128 |
| 2019/0106961 | A1 * | 4/2019 | Hardesty | E21B 33/128 |
| 2019/0203557 | A1 * | 7/2019 | Dirocco | E21B 33/129 |
| 2019/0292874 | A1 * | 9/2019 | Saeed | E21B 33/1293 |
| 2019/0309598 | A1 * | 10/2019 | Cheng | E21B 33/128 |
| 2020/0347694 | A1 * | 11/2020 | Power | E21B 33/128 |
| 2021/0238950 | A1 * | 8/2021 | Keeling | E21B 33/128 |
| 2021/0310338 | A1 | 10/2021 | Turley et al. | |
| 2021/0332661 | A1 * | 10/2021 | Tonti | E21B 23/01 |
| 2021/0381334 | A1 * | 12/2021 | Goodman | E21B 33/128 |

* cited by examiner

METHODS AND APPARATUS FOR PROVIDING A PLUG ACTIVATED BY CUP AND UNTETHERED OBJECT

CROSS-REFERENCE TO RELATED APPLICATION

The present application is a continuation application of U.S. application Ser. No. 17/275,509 filed Mar. 11, 2021, titled "METHODS AND APPARATUS FOR PROVIDING A PLUG WITH A TWO-STEP EXPANSION" naming Gregoire M Jacob as inventor. All the foregoing applications are hereby incorporated herein by reference in their entirety.

BACKGROUND

This disclosure relates generally to methods and apparatus for providing a plug inside a tubing string containing well fluid. This disclosure relates more particularly to methods and apparatus for providing a plug with a two-step expansion.

The first five figures (FIGS. 1 to 5) refer to one environment example in which the methods and apparatus for providing a plug inside a tubing string containing well fluid described herein may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and also coming from downhole formation such as produced fluids, like water and hydrocarbons.

The tubing string 1 can be partially or fully cemented, referred as cemented stimulation, or partially or fully free within the borehole, referred as open-hole stimulation. Typically, an open-stimulation will include temporary or permanent section isolation between the formation and the inside of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically come from perforations or sliding sleeves openings.

Each isolation includes a set plug 6 with its untethered object 5, represented as a spherical ball as one example.

The stimulation and isolation are typically sequential from the well end. At the end of stage 4*c*, after its stimulation 7, another isolation and stimulation may be performed in the tubing string 1.

FIG. 2 depicts a sequential step of FIG. 1 with the preparation of subsequent stage 4*d*. In this representation, a toolstring 10 is conveyed via a cable or wireline 9, which is controlled by a surface unit 8. Other conveyance methods may include tubing conveyed toolstring, coiled tubing. Along with a cable, a combination of gravity, tractoring and pump-down may be used to bring the toolstring 10 to the desired position inside the tubing string 1. In FIG. 2, the toolstring 10 conveys an unset plug 11, dedicated to isolating stage 4*c* from stage 4*d*.

FIG. 3 depicts a sequential view of FIG. 2, where the unset plug has been set (6) inside the tubing string 1, and further perforating has been performed uphole of the set plug 6. Typically, the set plug creates a restriction in the tubing string able to receive after an untethered object such as a ball. The toolstring 10 and cable 9 of FIG. 2 have then been removed from the tubing string.

FIG. 4 depicts a sequential view of FIG. 3, where an untethered object 5 is pumped from surface 3 with the well fluid 2 inside the tubing string 1.

FIG. 5 depicts a sequential view of FIG. 4, where the untethered object 5 lands on the set plug 6 and creates a well fluid isolation uphole compared to downhole of the plug position. Further pumping may increase the fluid pressure uphole of the plug position 6, including on the untethered object 5, of the stage 4*d*. Additional pumping rate and pressure may create a fluid stimulation 7 inside the formation located on or near stage 4*d*. When the stimulation is completed, another plug may be set and the overall sequence of stages 1 to 5 may start again. Typically, the number of stages may be between 10 and 100, depending on the technique used, the length of well and spacing of each stage.

There is a continuing need in the art for methods and apparatus for methods and apparatus for providing a plug inside a tubing string containing well fluid. Preferably, the plug is provided using a 2-step ball contact, first with one or more deformable plug components, second with one or more rigid plug components.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Figure 6:
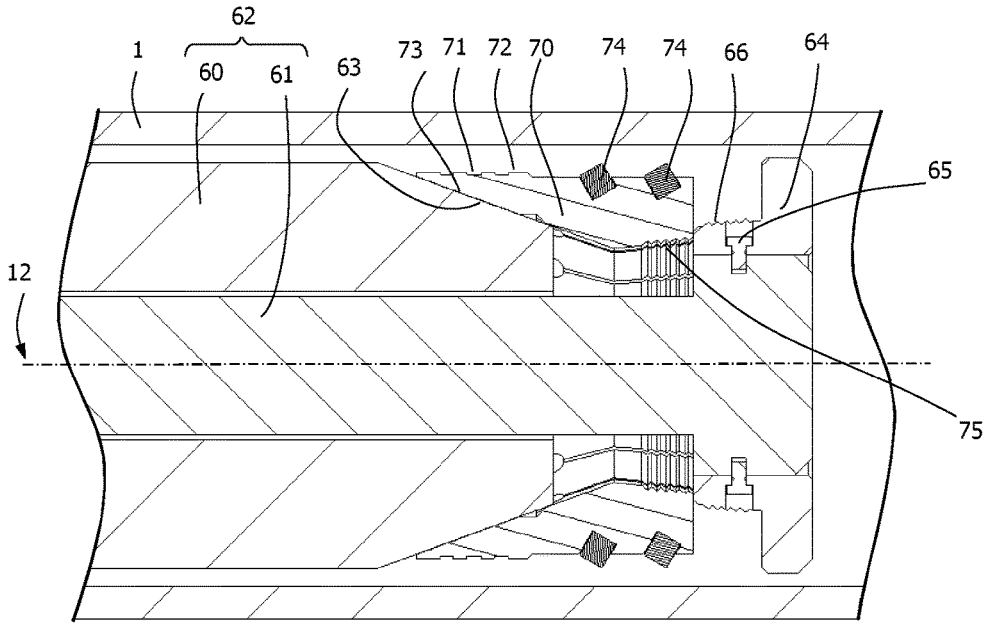
FIG. 6 is a cross-section view of a plug on a retrievable setting tool, in an unset or run-in-hole position inside a tubing string, according to an example embodiment.

FIG. 6 represents a possible embodiment of a plug on a retrievable setting tool. This is a portion of a cut view inside a tubing string 1, depicted around its cylindrical axis 12. The plug is represented in its unset position, which represents the travel, or run-in-hole position.

The retrievable setting tool 62 is represented with two main parts, the mandrel 60 and the rod 61. The rod 61 can slide longitudinally within the mandrel 60, and the movement is preferably activated by a conveyance toolstring, not represented on the figure. The mandrel 60 consists primarily of a cylinder which outside diameter is smaller than the inside diameter of the tubing string 1, to allow free conveyance inside the tubing string. The tip of the mandrel is adapted as a punch having an expansion face 63, which is conical and is matching the inner surface 73 of the continuous expandable ring 70. Preferably, both surfaces 63 and 73 are in contact during the conveyance as depicted in FIG. 6. Also, the continuous expandable ring can include a cylindrical sealing section 72, as main outer surface, and this surface is possibly crenelated, with radial grooves 71 to act as contact relief and to improve surface contacts in case of tubing string surface imperfection or debris presence, such as sand particles. The back of the continuous expandable ring includes the gripping section on its outer diameter, which may include anchoring device such as buttons 74, or slips. On the back inner surface of the continuous expandable ring, a conical surface 75 is present, which includes a radial teeth profile.

An integral locking and back-pushing ring 64 is positioned on the back of the continuous expandable ring. On one inner surface, it includes a conical surface 66 with a radial teeth profile. Both conical surfaces 66 and 75 may have a similar angle, and teeth with similar or proportional spacing. In this conveyance position, the two surfaces 66 and 75 are not in contact with each other.

The integral locking and back-pushing ring 64 includes an attachment with the rod 61 on its inner cylindrical surface. The attachment may be performed with shear screws 65, disposed radially across the two parts. Shear rings may also be used for the same purpose.

The stacking of the two plug parts, namely continuous expandable ring 70 and integral locking and back-pushing ring 64 are configured to stay in place due to mechanical constraint, on the rod 61 and mandrel 60, while under conveyance within the casing string 1.

Figure 7A:
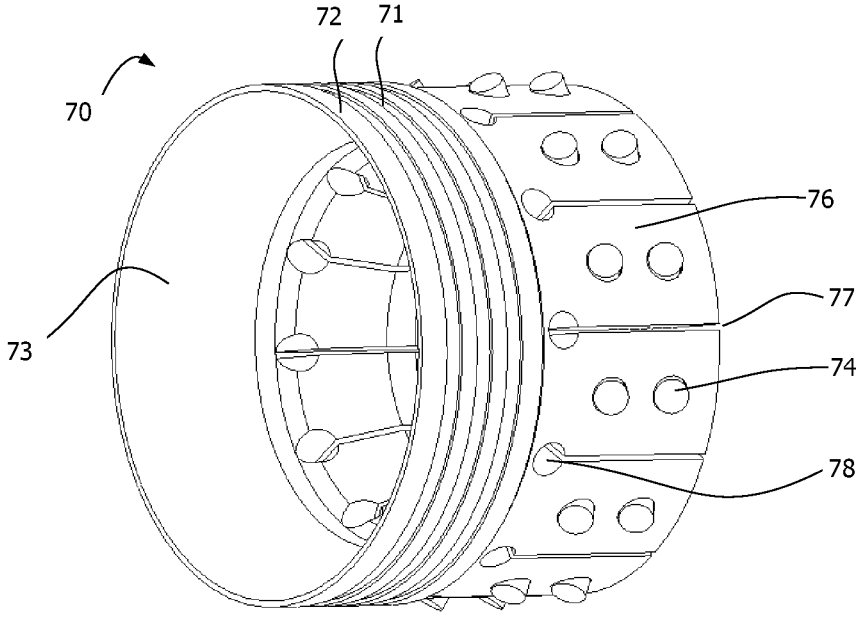
FIGS. 7A and 7B are isometric views of an expandable continuous ring, in its unset position, according to an example embodiment.
Figure 7B:
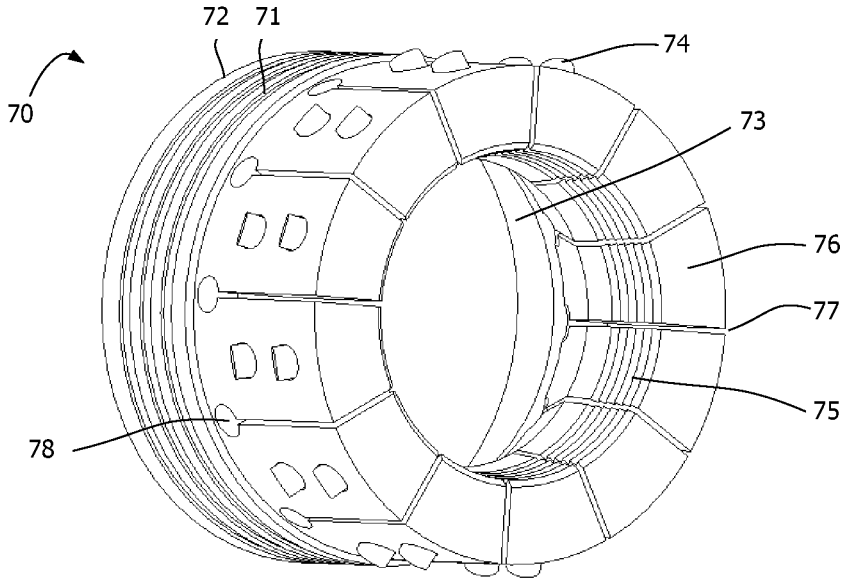

FIGS. 7A and 7B represent two isometric views of the continuous expandable ring. As seen in FIG. 6, the continuous expandable ring 70 may contain two sections, within the same part. The sealing section is characterized by a cylindrical outer surface 72 optionally crenelated with grooves 71. The front inner surface is preferably conical 73. The back section of the ring 70 includes anchoring devices, such as buttons 74. Those buttons are preferably made out of hard metal, ceramic or composite metals, in order to penetrate the inner surface of the tubing string when the plug is actuated. Other anchoring devices include metal slips or a gripping surface. In this embodiment, buttons are distributed around the outer cylindrical surface of the ring. The back section of the continuous expandable ring may include radial slit cuts 77 distributed around the cylindrical shape, creating several slips 76. Preferably, the number of slips is between 4 and 16. Each slip includes its own gripping devices, here depicted with two buttons 74 each. Preferably, each slip may contain between 1 and 8 buttons. At the end of the slit cut 77, a relief hole 78 or feature can be added to allow for the transition of the expandable section by deformation, next to 71 and 72, and the expandable section by radial separation with the slips 76.

In FIG. 7B, additional details can be observed regarding the back surface of the slips 76, preferably flat cut, and the inner conical surface with the teeth 75.

Figure 8:
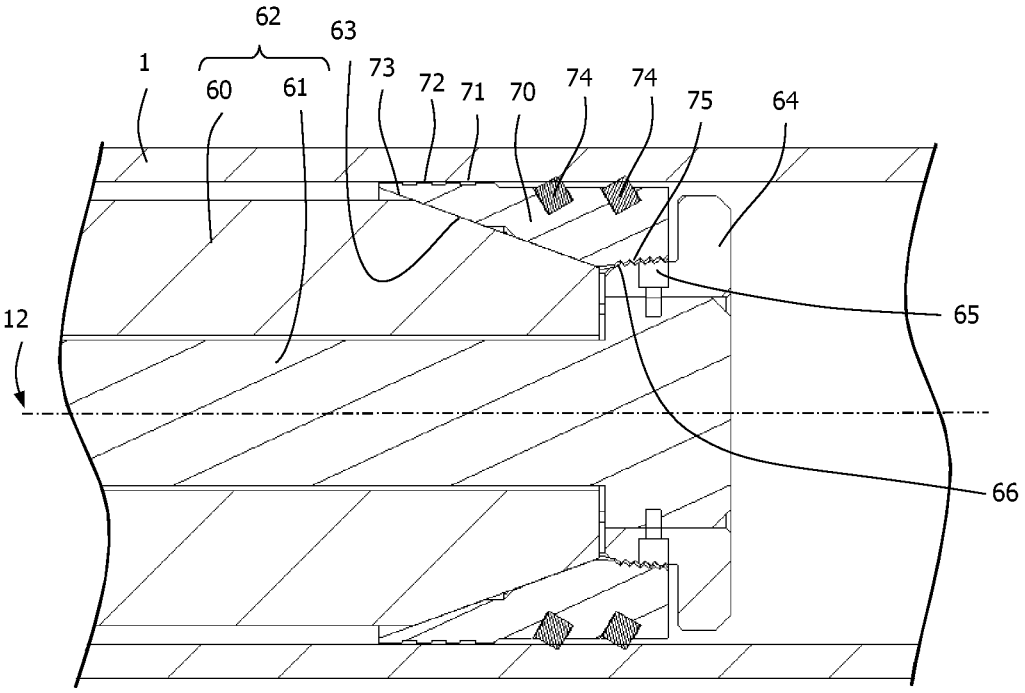
FIG. 8 is a cross-section view of a plug on a retrievable setting tool, after setting tool actuation, with the plug in its set position, according to an example embodiment.

FIG. 8 represents a subsequent step of FIG. 6. In FIG. 8, the plug is set inside the tubing string 1. The conveyance toolstring, not shown, has been actuated, which initiated a longitudinal movement between rod 61 and mandrel 60, along the axis 12. The setting actuation includes the compression of the continuous expandable ring 70 from its back, by the integral locking and back-pushing ring 64, constraining the front portion of the continuous expandable ring 70 to deform plastically over the mandrel expansion face at location 73. The material of the continuous expandable ring may have a high ductility to allow this radial deformation without breaking. In addition, through the compression movement of the back-pushing ring 64, the back section of the continuous expandable ring is expanding and the buttons 74 enter in contact with the inner surface of the tubing string. After reaching this expanded position for the continuous expandable ring 70, the integral locking and back-pushing ring 64 can geometrically fit on the back inner surface 75. At this point of actuation, both surfaces 75 and 66 are in contact. The conical shape of this surface allows further radial expansion of the continuous expandable ring 70, and consequently allows to have the buttons 74 penetrate further inside the tubing string. A force applied by the setting longitudinal movement is preferably between 10,000 and 60,000 lbf [44,500 N to 267,000 N]. Preferably, the maximum setting force is set by the value of the multiple shear screws 65 which may shear when reaching the desired set force.

The teeth on both surfaces 66 and 75 allow to lock the two parts together and constrain the continuous expandable ring 70 in its radially expanded state, anchored on the tubing string 1 at the buttons 74 position. The sealing surface 72 of the continuous expanded ring 70 is also contacting the inner surface of the tubing string 1.

Figure 9A:
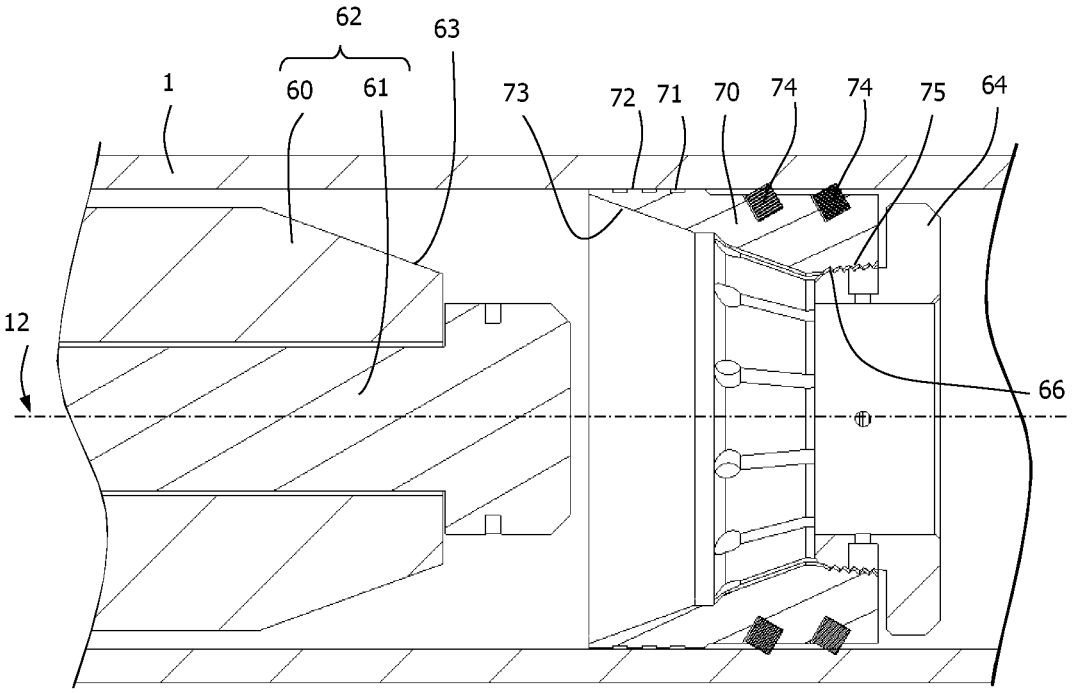
FIG. 9A is a cross-section view of a set plug with the retrievable setting tool being pulled away from the set plug, according to an example embodiment.
Figure 9B:
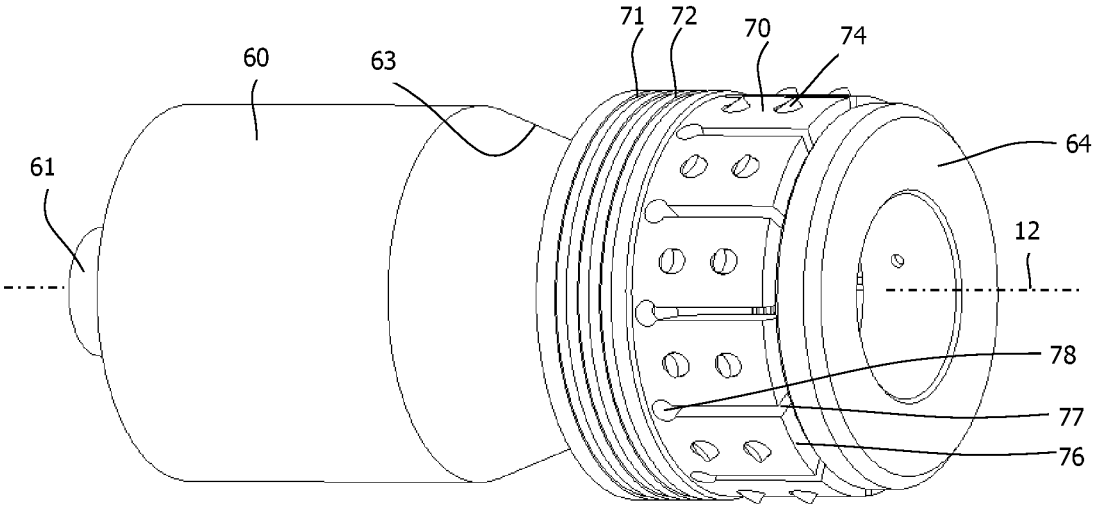
FIG. 9B is an isometric view of the same embodiment as FIG. 9A, without representing the tubing string.

FIGS. 9A and 9B represent the release of the retrievable setting tool 62 from the set plug, with the expanded continuous ring 70 and the integral locking and back-pushing ring 64. FIG. 9A is cut view of the embodiment inside the tubing string 1, along the axis 12. FIG. 9B is an isometric view of the same embodiment without the tubing string.

With the expandable continuous ring in its expanded position and maintained expanded from its back by the integral locking and back-pushing ring, and with interlocking contact along surfaces 66 and 75, the front inner conical surface initially at location 73 can come loose from the mandrel 60. A small force against the elastic compression friction around the surface conical might be necessary to retrieve the rod 61 and the mandrel 60. This force may be preferably below 500 lbf [2,200 N]. Depending on the conveyance method, such as wireline, coiled-tubing, tubing conveyed, the retrievable setting tool 62 along with the rest of the conveyance toolstring, not shown, will be recovered and brought back to surface.

Figure 10A:
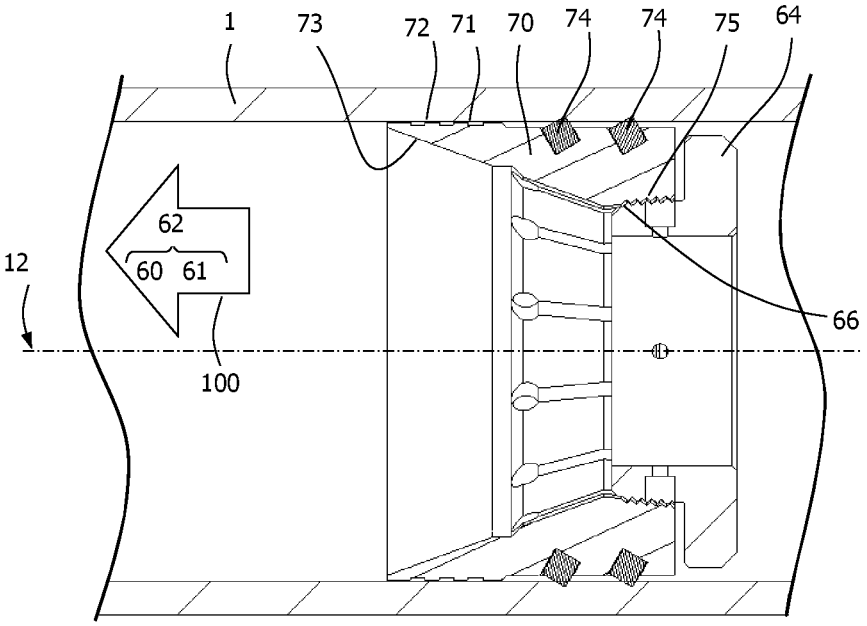
FIG. 10A is a cross-section view of a set plug with the retrievable setting tool being fully retrieved away from the set plug, according to an example embodiment.
Figure 10B:
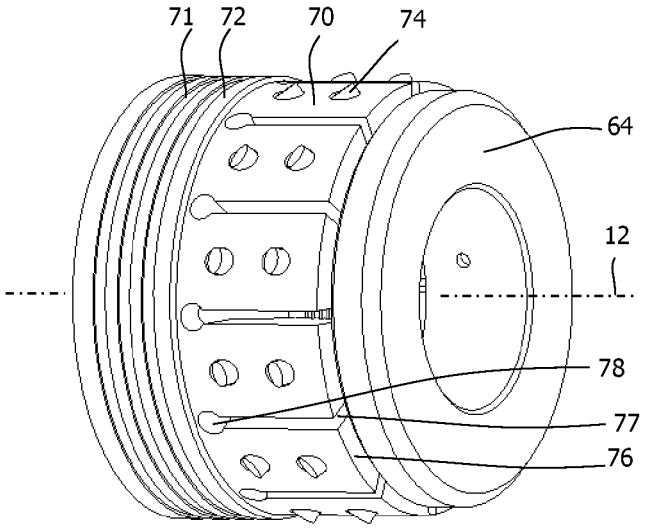
FIG. 10B is an isometric view of the same embodiment as FIG. 10A, without representing the tubing string.

FIGS. 10A and 10B represent the plug set inside the tubing string, with the retrievable setting tool 62 retrieved. FIG. 10A is cut view of the embodiment inside the tubing string 1, along the axis 12. FIG. 10B is an isometric view of the same embodiment without the tubing string, with the retrievable setting tool not seeable on the figure. Noticeable in FIG. 10B, in the set plug position, the gaps formed by the slit cuts 77 are wider after expansion as the corresponding gaps before expansion in FIGS. 7A and 7B.

Figure 11A:
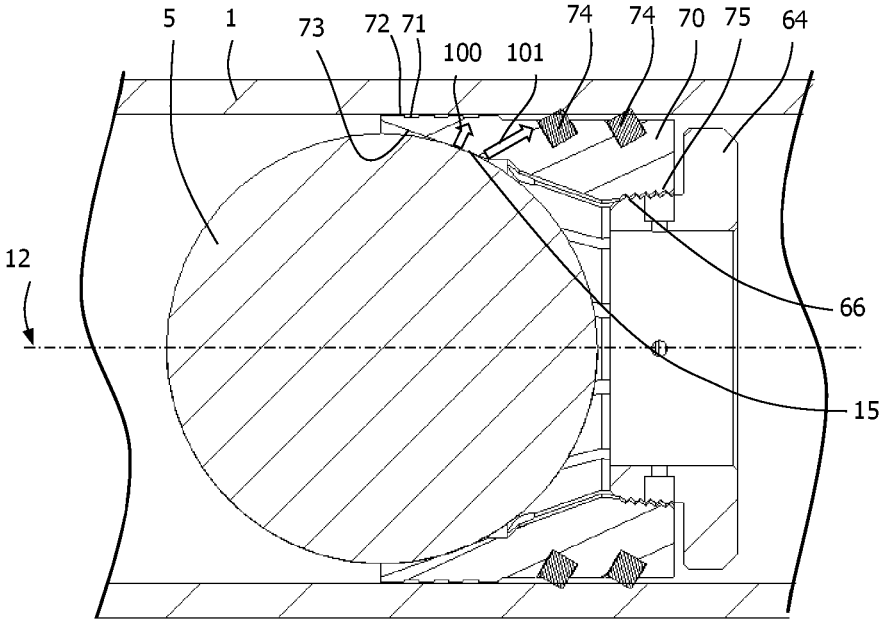
FIG. 11A is a cross-section view of a set plug with the receiving of an untethered object acting on the expandable continuous ring, according to an example embodiment.
Figure 11B:
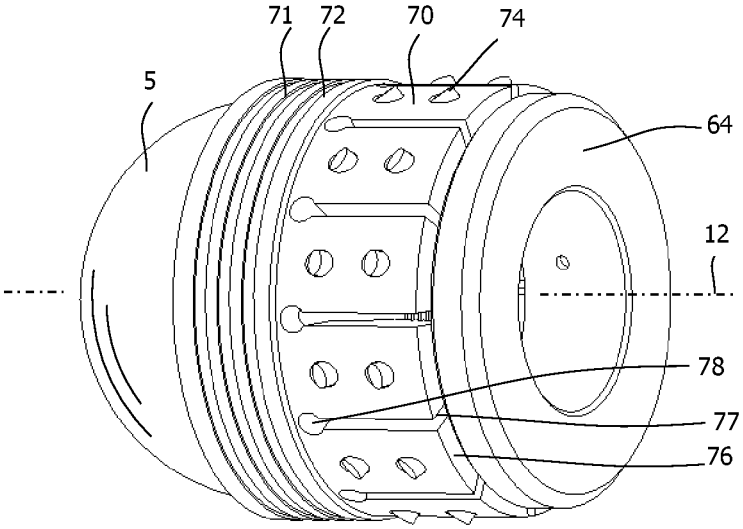
FIG. 11B is an isometric view of the same embodiment as FIG. 11A, without representing the tubing string.

FIG. 11A and FIG. 11B represents a sequential step of FIGS. 10A and 10B. The set plug has received and untethered object 5. This untethered object can be pumped from surface. The untethered object 5 may take the shape of a sphere, a dart, a pill. The untethered object 5 would include at least a hemispherical or a curved section 15, with a curvature higher than the flaring surface 73, preferably conical, of the continuous expandable ring 70.

Note that in other embodiments, the untethered object can be carried within the conveyance adapter, and can be released downhole near the plug setting position. This technique is often referred to as caged ball or ball in place.

FIG. 11A depicts a cut view of the embodiment within the tubing string 1, along axis 12. The hemispherical surface 15 of the untethered object 5 is contacting the conical surface 73 of the inner expandable continuous ring. Through the isolation of the well fluid with its untethered object 5, a pressure differential can appears uphole versus downhole of the set plug (64, 70). This differential pressure, preferably in the order of 500 to 15,000 psi [3.5 MPa to 100 MPa] induces a force on the untethered object. The resultant of this force may be distributed through the contact surfaces 15 and 73, into two forces. One force is represented as arrow 100, for the force directed to the sealing surface 72 of the expandable continuous ring, and the other force is represented as arrow 101, for the force directed to the gripping devices 74 of the anchoring section. The ductility of the material of the expandable continuous ring allows propagating the force radially up to the tubing string, which in comparison is preferably less deformable under similar loading. This distribution into two forces allows ensuring a substantial flow isolation up to a potential complete sealing, depending on the materials combination and pressure available, as well as sustaining the gripping force of the anchoring section through the buttons 74, and substantially fixing the positioning of the plug device within the tubing string.

FIG. 11B represents an isometric view of the same embodiment as in FIG. 11A without the tubing string 1.

Figure 12:
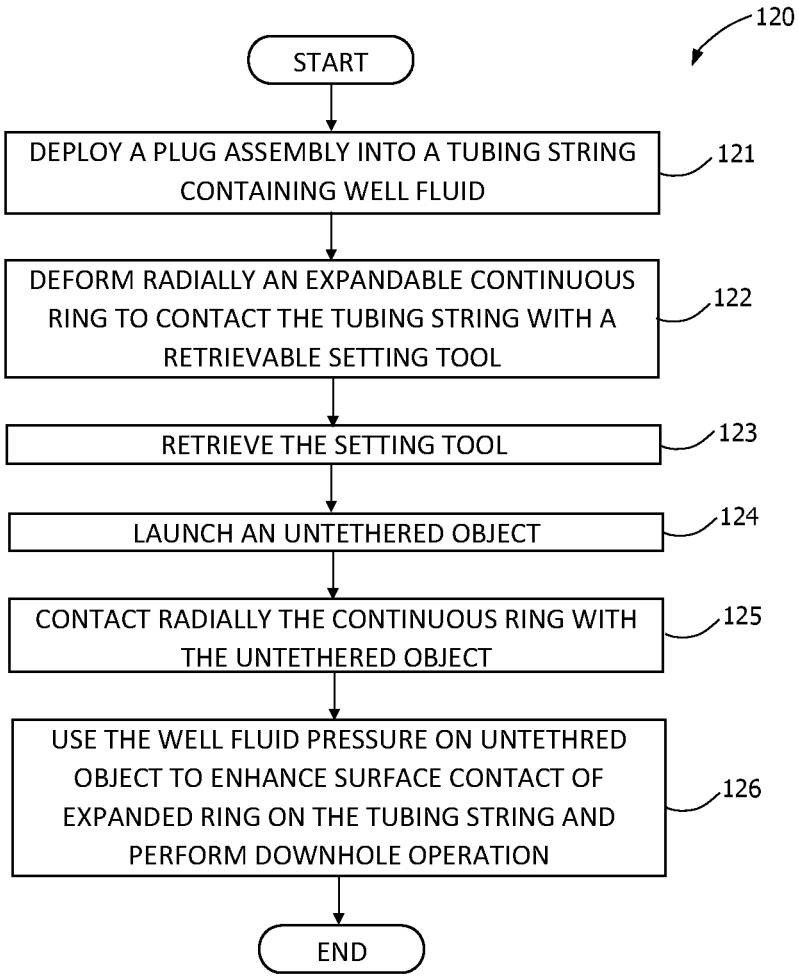
FIG. 12 is a flow diagram representing a technique sequence of deployment of a plug and action of the untethered object on the expandable continuous ring.

FIG. 12 represents an example technique sequence 120, which includes steps depicted from FIGS. 6 to 11. Step 121 corresponds to the deployment of the plug assembly (64,70) into the tubing string (1) containing well fluid (2). On step 122, the plug assembly with its expandable continuous ring 70 is then deformed radially due to the action from a retrievable setting tool 62. At the end of the deformation, at least a portion of the ring 70 will contact the inner surface of the tubing string 1. Then, the retrievable setting tool 62, is retrieved during step 123. Further, an untethered object 5 is launched, such as from surface, inside the tubing string. Then, in step 124, the untethered object 5 reaches the position of the plug set in step 122 and contacts radially its expandable continuous ring 70. Finally, in step 125, the well fluid pressure up-hole of the untethered object (5) is used to act as a force on the expandable continuous ring (70) and consequently enhance its surface contact on the tubing string (1). This isolation state allows performing a downhole operation inside the well.

All parts of the plug, such as expandable continuous ring 70, the integral locking and back-pushing ring 64, untethered object 5, may be built out of a combination of dissolvable materials, whether plastics or metals. Dissolvable materials have the capacity to react with surrounding well fluid 2 and degrades in smaller particles over time. After a period of preferably a few hours to a few months, most or all the dissolvable components have degraded to particles remaining in the well fluid 2.

Figure 13A:
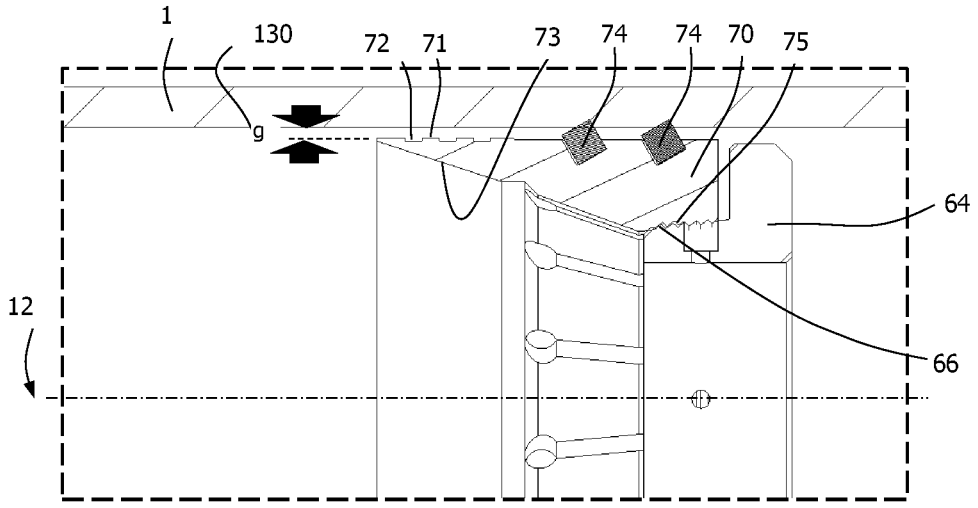
FIG. 13A is a detailed cross-section view of the contact area between the plug and the tubing string before the action of the untethered object, according to an example embodiment.
Figure 13B:
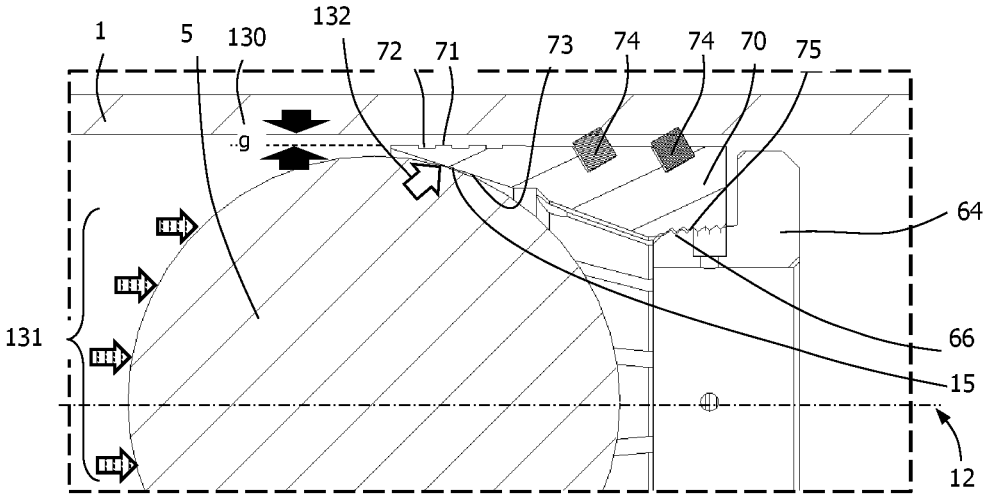
FIG. 13B is a detailed cross-section view of the contact area between the plug and the tubing string at landing of the untethered object contacting the expandable continuous ring, according to an example embodiment.
Figure 13C:
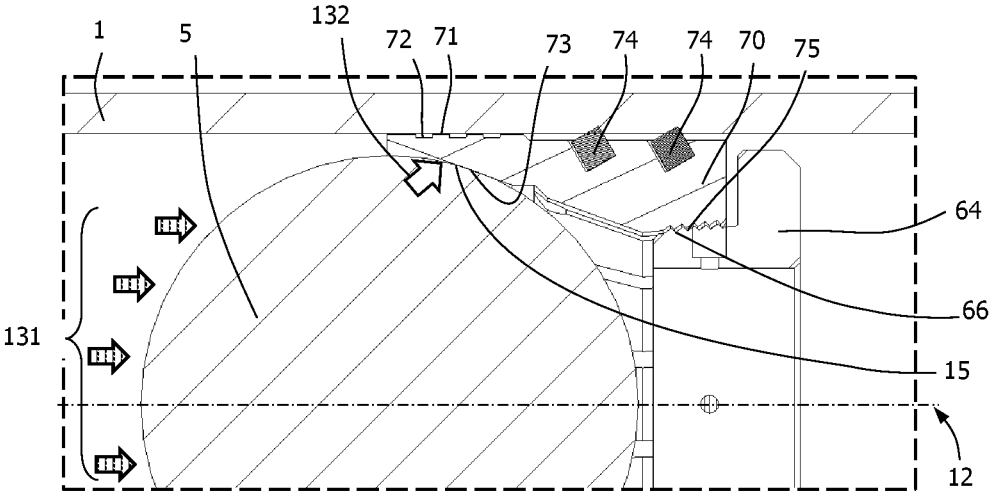
FIG. 13C is a detailed cross-section view of the contact area between the plug and the tubing string, after the pressure action of the untethered object and further expanding of the expandable continuous ring.

FIGS. 13A, 13B, 13C represent a close-up view of the positioning of the expandable continuous ring 70 relative to the tubing string inner surface. FIG. 13A is a variation of the previously depicted FIG. 10A.

The close-up view 13A shows a potential gap 130 between the external expanded surface 72 of the continuous expandable ring 70 relative to the inner surface of the tubing string 1. This gap 130 may be cylindrical around axis 12. This gap 130 may not necessarily be continuous or equal around the inner surface of the tubing string 1. The gap 130 may depend on possible dimensions variations of the tubing string 1 or the expanded continuous ring 70 after expansion, as depicted in FIG. 10A. An additional possibility for the presence of this gap 130 is a potential elastic compression of the continuous expandable ring after its expansion in FIG. 10A with the retrievable setting tool 62. Depending on the material selected for the expandable continuous ring, a combination of plastic and elastic deformations are possible, allowing therefore for a spring-back movement to the expansion provided during the plug setting process.

The other components of the plug keep similar functions as disclosed in the description of FIG. 10A. Gripping devices, such as buttons 74, ensure the anchoring inside the inner surface of the tubing string. Further, the integral locking and back-pushing ring 64 is constraining in position the expanded continuous ring 70 via a toothed conical contact between surface 66 and surface 75. The inner surface 73 may be kept conical.

In FIG. 13B, sequential of FIG. 13A, an untethered object 5 has been launched and has landed on the set plug assembly. The step is similar to FIG. 11A. The difference depicted lies in the gap 130. As depicted in FIG. 13B, the outside surface 15 of the untethered object, preferably including a hemispherical surface, has a diameter allowing to contact continuously the conical surface 73 of the expandable continuous ring 70. The force 131 on the untethered object is caused by a flow restriction and pressure differential created uphole compared to downhole by the plug assembly inside the well fluid 2. As explained in FIG. 11A, the force 131 on the untethered object may be transmitted to the expandable continuous ring through a force 132. The force 132 will be preferably distributed on the conical contact surface 73. Since the continuous expandable ring 70 is fixed through the combination of gripping devices 74 inside the tubing string 1 and secured from its back surface 75 by the integral locking and back-pushing ring 64 with surface 66, it may not move longitudinally, even with the resulting force 132 applied to it. Furthermore, the radial component of the force 132 may contribute to expand the expandable continuous ring 70 further and reduce the gap 130.

FIG. 13C is sequential of FIG. 13B. The figure represents the closing of gap 130 which has ultimately disappeared through the action of force 132. In this view, the outer surface 72 of the expanded continuous ring 70 is contacting the inner surface of the tubing string 1. Optional corrugation, in the form of crenelated grooves 71, may be added to help the contact quality, by providing some volume pocket for potential particles, such as sand or rust, which may be present on the surface and in the well fluid 2. In this representation, the expandable continuous ring is maintained longitudinally in place inside the tubing string thanks to the gripping devices, such as buttons 74, and back locking from the back-pushing ring 64, as described in FIG. 13B.

The untethered object 5 may slide longitudinally slightly further downhole along its curved or hemispherical surface 15, as the conical contact surface 73 may increase in diameter when the force 132 is acting and deforming the continuous expandable ring 70 even more. The longitudinal movement may stop as an equilibrium between the acting forces 131 and 132, with the reaction constraint from the expandable continuous ring 70 and tubing string 1, come to an equilibrium.

Further force 131, transmitted as 132, from the untethered object, may in turn, enhance the sealing contacts between the untethered object 5, the continuous expandable ring 70 and the tubing string 1. This enhanced contact surfaces may globally enhance the sealing of the overall plug inside the tubing string 1, and improve the isolation. Another effect of the further force 132 may be to direct a fraction of this force towards the gripping devices, such as buttons 74, and in turn provide additional anchoring force and globally enhanced gripping of the plug, ensuring its set position inside the tubing string 1.

Figure 14:
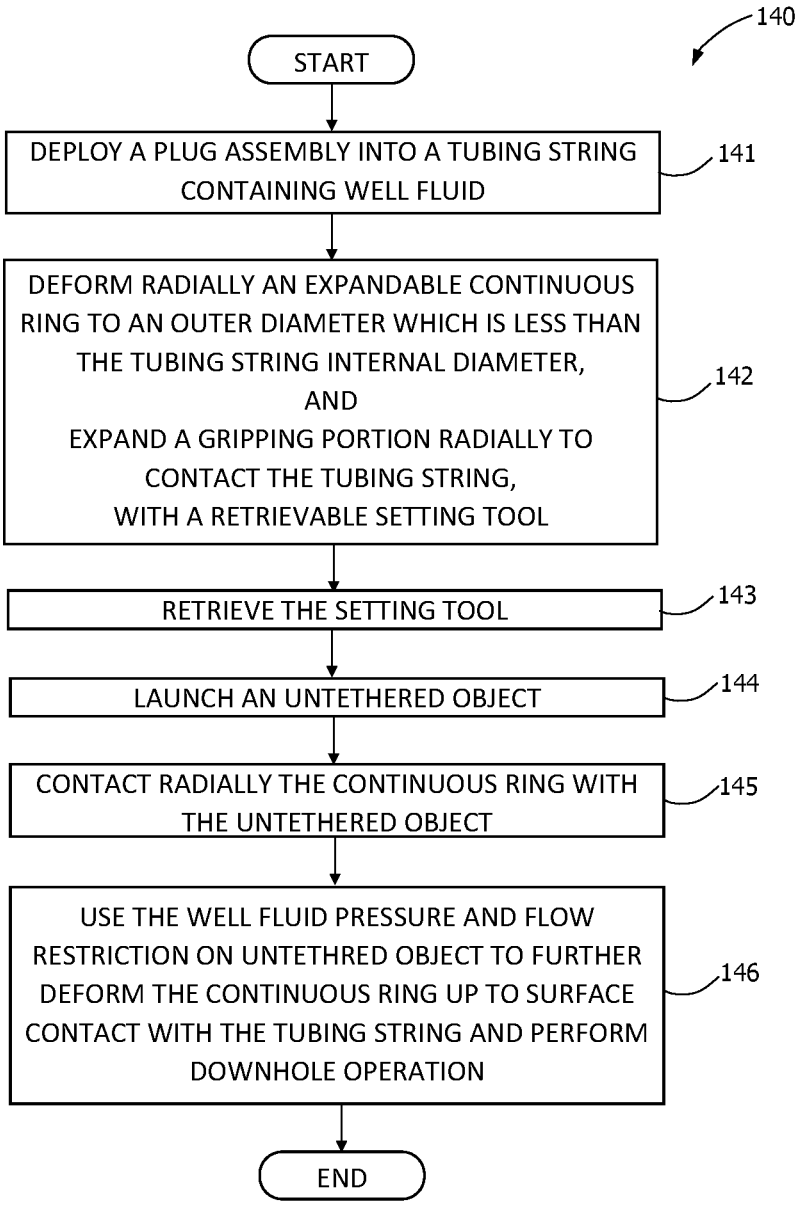
FIG. 14 flow diagram representing a technique sequence of deployment of a plug, with the action of an untethered object for further expanding the expandable continuous ring and contacting a stopping surface on the locking ring.

FIG. 14 represents a technique sequence 140, which includes steps depicted in FIGS. 6 to 11, with the additional features described in FIGS. 13A to 13C.

Step 141 corresponds to the deployment of the plug assembly (64,70) into the tubing string (1) containing well fluid (2). During step 142, the plug assembly with its expandable continuous ring 70 is deformed radially due to the action from a retrievable setting tool 62. During the same step 142, the gripping portion of the expandable continuous ring (70) is expanded radially so that, at least a button (74) of the gripping portion is contacting the inner surface of the tubing string (1), and so that the continuous portion of the expandable continuous ring (70) is deformed to an outer diameter which is less than the tubing string (1) internal diameter. Then, during step 143, the retrievable setting tool (62), is retrieved. Further during step 144, an untethered object (5), is launched, such as from surface, inside the tubing string (1). Then, during step 145, the untethered object (5) reaches the position of the set plug in step 142 and contacts radially its expandable continuous ring (70). Finally, during step 146, the well fluid (2) pressure and flow restriction up-hole of the untethered object (5) are used to apply a force on the expandable continuous ring to further deform it radially up to contact with the tubing string (1). This isolation state allows performing a downhole operation inside the well.

Figure 15A:
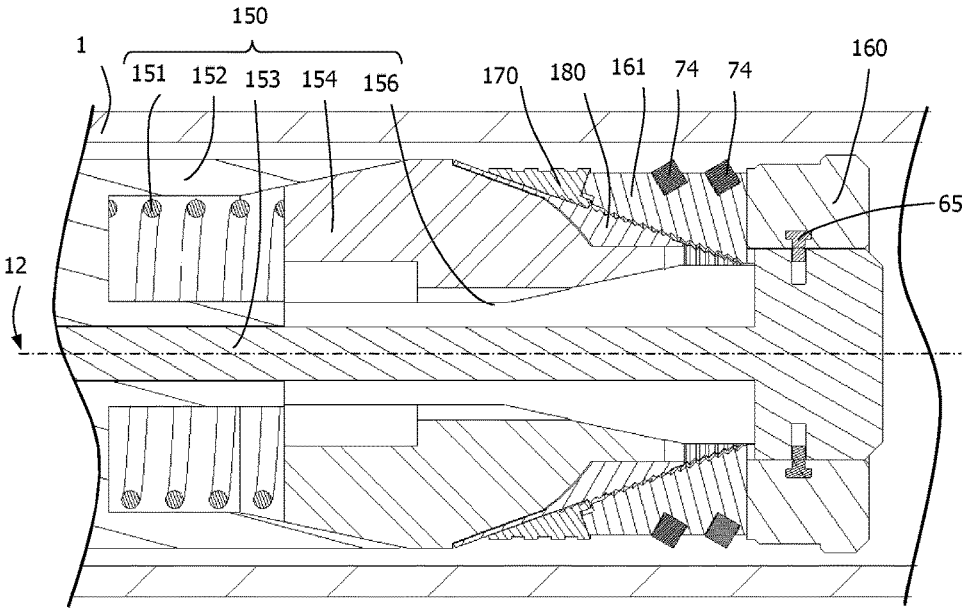
FIG. 15A is a cross-section view of another embodiment with a plug assembly and retrievable setting tool, showing the plug assembly as well as the setting tool in an unset position, or run-in-hole inside a tubing string, according to an example embodiment.

In FIG. 15A, another embodiment is presented.

FIG. 15A represents a possible embodiment of a plug on a retrievable setting tool. This is a portion of a cut view inside a tubing string 1, depicted around its cylindrical axis 12. The plug is represented in its unset position, which represents the travel, or run-in-hole position.

As represented, the plug includes four main parts:

- a continuous expandable seal ring 170,
- an expandable gripping ring 161 which includes one or more anchoring devices, represented as buttons 74,
- a locking ring 180,
- a back-pushing ring 160.

In FIG. 15A, the plug main parts are represented unset and undeformed, over the retrievable setting tool 150.

Figure 15B:
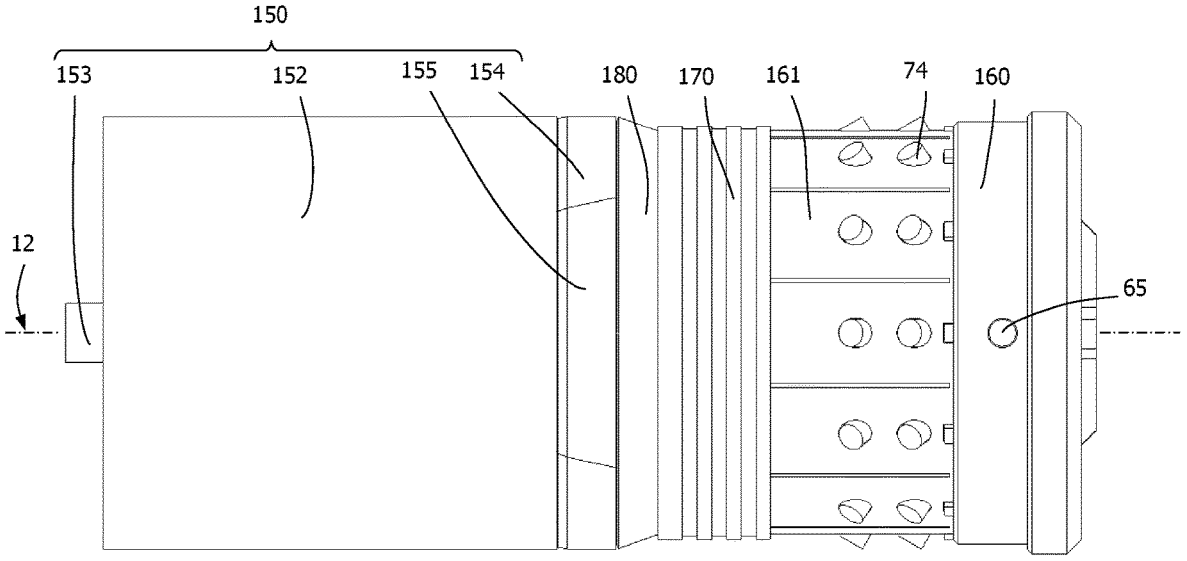
FIGS. 15B and 15C are isometric views at two different viewing angles of the same embodiment as FIG. 15A, without representing the tubing string.

As depicted, the retrievable setting tool 150 includes the following main parts:

- a rod 153, which may couple to the back-pushing ring 160 of the plug with one or more shear screw, shear pin or shear ring (65),
- a housing 152 and a nose 256, which guides the rod 153 longitudinally along the axis 12,
- a collapsible expansion punch, with multiple azimuthal sections, represented in FIG. 15B with two sections 154 and two sections 155. The four sections have matched cut side planes so that the overall shape of an expansion face towards the locking ring 180, is continuous with a combination of conical and hemispherical shapes. The segmented conical sections 154, 155 are held radially in place within the housing 152 and the nose 156,
- a compression spring 151 may apply a force outward axially on the upper surfaces of the sections 154 and 155, while being secured longitudinally and radially by the housing 152 and the nose 156.

Figure 15C:
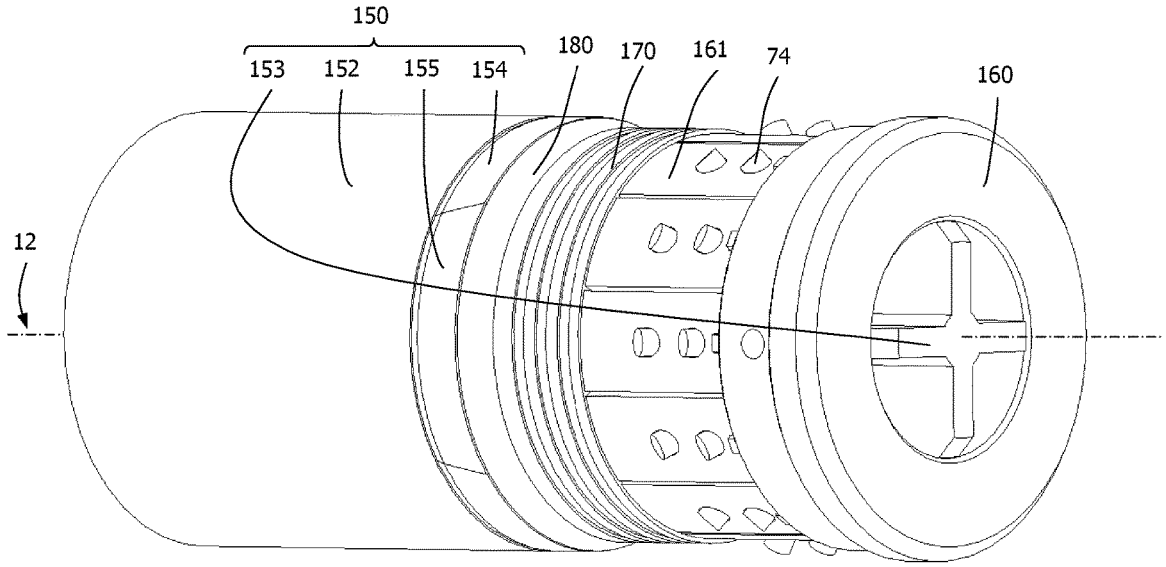

FIG. 15B and FIG. 15C depict the same embodiment as 15A, without the tubing string 1. FIG. 15B presents the embodiment as a straight front isometric view. FIG. 15C presents the embodiment at an angled isometric view. The same components as in FIG. 15A, namely 152, 153, 154, 155 can be observed constituting the retrievable setting tool 150. Regarding the plug, components 170, 180, 161 and 160 can also viewed from both isometric views.

Figure 16A:
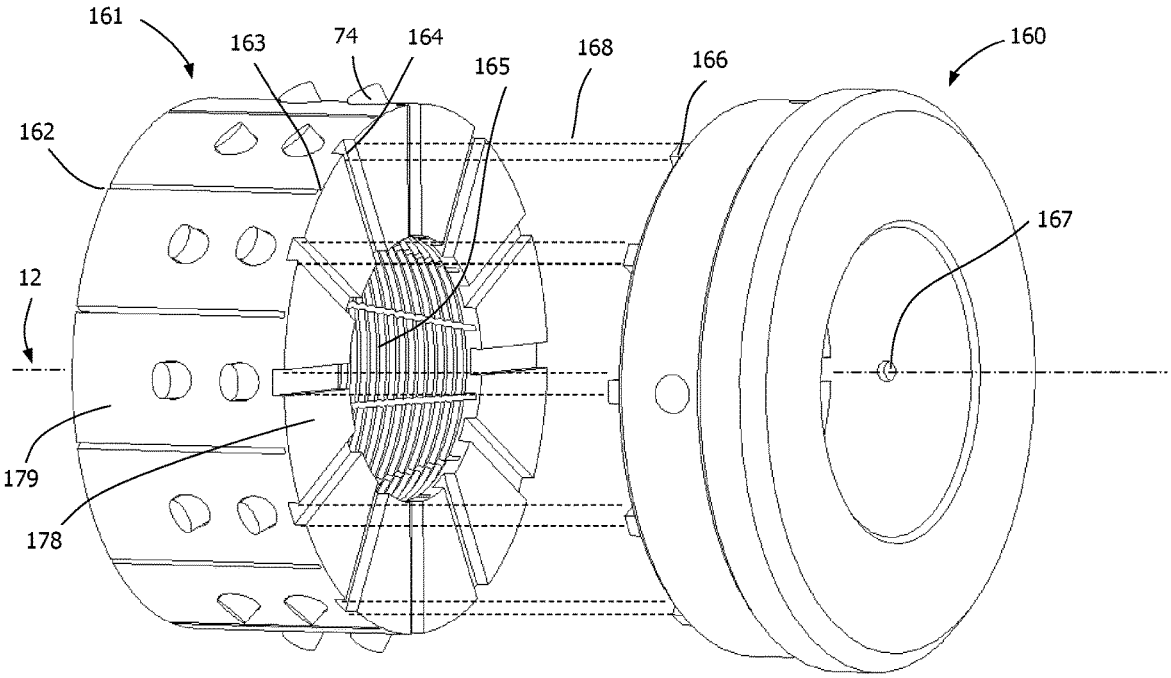
FIG. 16A is an isometric view of an expandable gripping ring and an isometric view of a back-pushing ring, in the same viewing direction, according to an example embodiment.
Figure 16B:
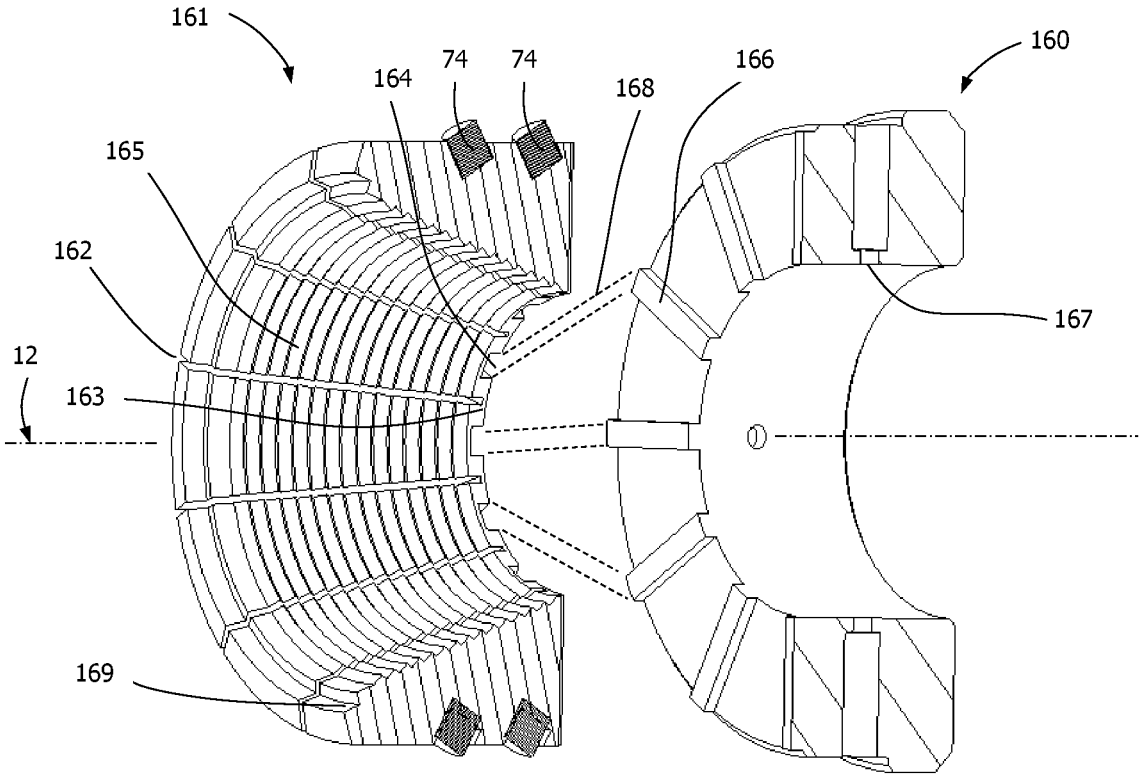
FIG. 16B is a cross-sectional isometric view of the same parts represented in FIG. 16A, from a different viewing angle, according to an example embodiment.

FIGS. 16A and 16B show detailed views of two parts of the plug: the expandable gripping ring 161 and the back-pushing ring 160. FIG. 16A represents an isometric view of both parts within the same orientation along axis 12. FIG. 16B represents another isometric view of both parts seen as a cut view, along axis 12.

The expandable gripping ring 161 can be built with a preferably cylindrical outer shape separated by slit cuts 162. The slit cuts 162 separate the expandable gripping ring in the same numbers of ring sections 179. The ring sections 179 are kept together as a single part, in the unexpanded state, through a thin section 163, each positioned at the opposite end of the slit cuts 162. Preferably, the number of slit cuts 162, as well as ring sections 179 and thin sections 163, is between 4 and 16. The preferably cylindrical outer shape may contain one diametrical dimension around axis 12, or several sub-cylindrical faces with potentially larger outer curvatures for each ring section 179. The adaptation of the curvatures may be needed to cope with the expanded shape which might be closer to the inside diameter of the tubing string. Other possible features on each or on some of the ring sections 179 are anchoring devices such as buttons 74. Alternatively, slip teeth or rough surfaces, can be used as anchoring devices and be present on the outer surface of the ring sections 179. The purpose of the anchoring devices 74 is to penetrate the inner surface of the tubing string 1 to provide a local anchoring. Alternatively, the anchoring devices may increase the surface friction between the expanding gripping ring 161 and the inner face of the tubing string to an adherence point. The number of buttons 74 may preferably be between 1 and 10 for each ring section 179.

The bottom surface 178 of the expandable gripping ring 161 may include radial directing rails 164. Those rails 164 may preferably be positioned in the center of each ring sections 179.

The back-pushing ring 160 may have the counter shapes of the rails 164, protruding out as radial bars 166.

The two parts 161 and 160 may have therefore a matching feature between each other's, symbolized by the alignment 168.

The inner surface of the back-pushing ring may be cylindrical with openings 167 allowing to position shear screw, shear pins or shear rings.

FIG. 16B allows seeing the possible inner surface of the expandable gripping ring 161, with a principal conical shape, containing teeth or other anti-backing feature 165. The front part of the conical shape 165 may include a groove 169.

Figure 17A:
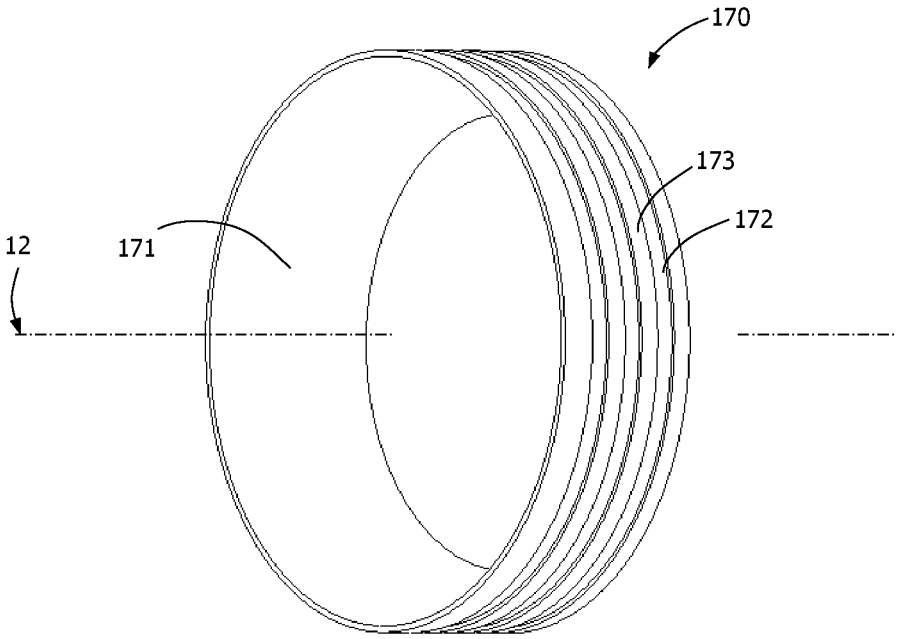
FIG. 17A is an isometric view of an expandable continuous seal ring, according to an example embodiment.

FIG. 17A represents an isometric view of the continuous expandable seal ring 170. As main features represented, the outer surface 173 may be cylindrical, along axis 12. Potential crenelated groove features 172 may be added on this cylindrical surface 173. The inner surface of continuous expandable seal ring 170 may be conical 171.

Figure 17B:
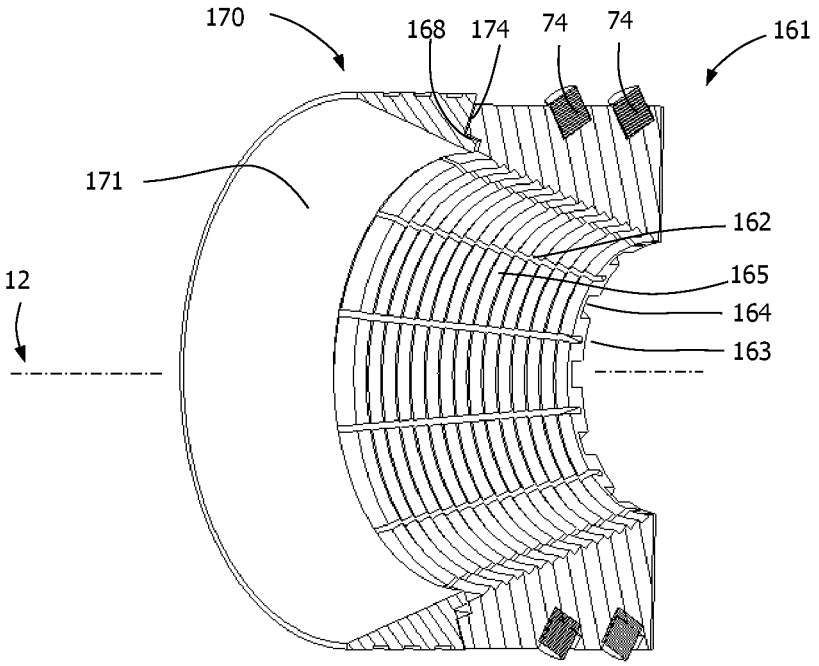
FIG. 17B is a cross-sectional isometric view of the expandable continuous seal ring position next to a cross sectional isometric view of the expandable gripping ring, as the two parts would be positioned in an unset or run-in-hole position, according to an example embodiment.

FIG. 17B represents an isometric cut view of both the continuous expandable seal ring 170 and the expandable gripping ring 161. The position represented is the assembly in the unset, run-in-hole position, as shown in FIG. 15A. The two parts 170 may share a common contact surface 174, which may be a cylindrical, annular, or conical contact. The two surfaces 171 and 165 may have the same conical angle, as referred to axis 12. A preferred angle may be between 5 and 30 degrees. As an additional alignment or positioning feature, the groove 169 of the expandable gripping ring 161 may match the counter form 168 on the continuous expandable seal ring 170.

Figure 18A:
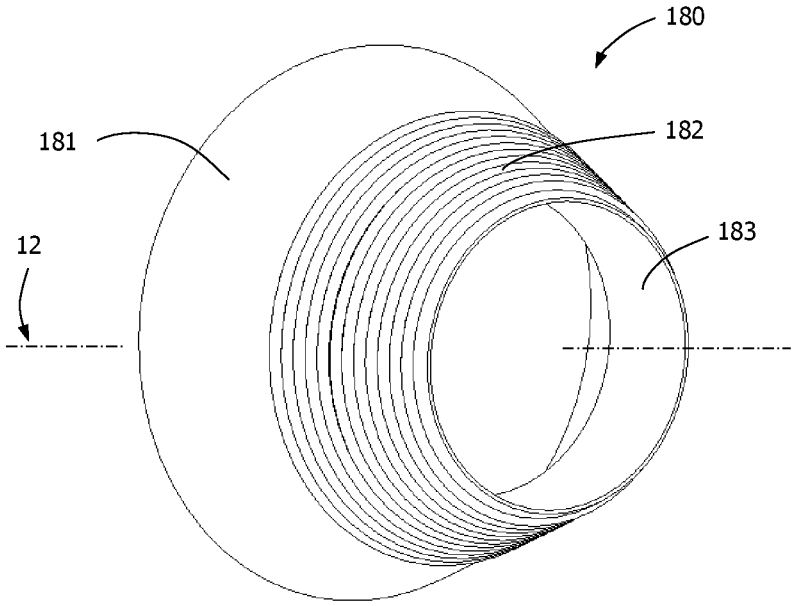
FIG. 18A is an isometric view of a locking ring, according to an example embodiment.
Figure 18B:
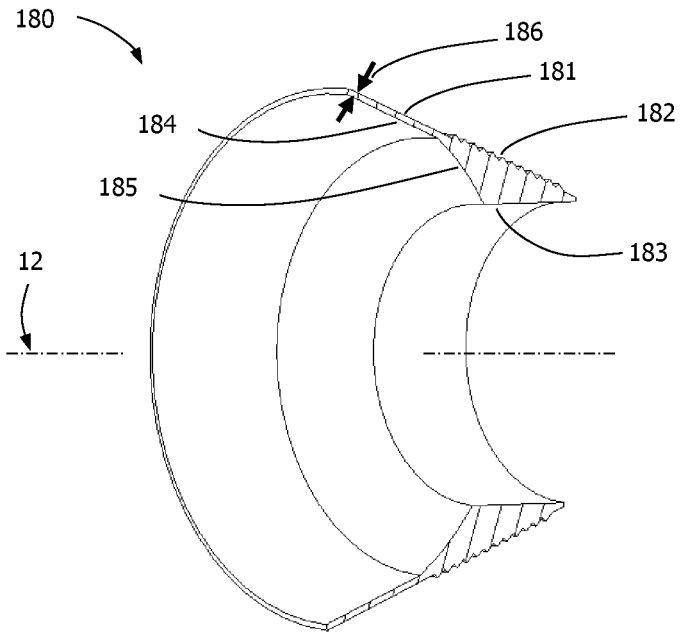
FIG. 18B is a cross-sectional isometric view of a locking ring, according to an example embodiment.

FIG. 18A and FIG. 18B represent the isometric view and cut view of the locking ring 180.

The locking ring 180 may include on its external surface conical surfaces 181 and 182. The angle of the conical surfaces 181 and 182 may be similar to the angle of the surface 171 of the continuous expandable seal ring 170 and of the surface 165 of the expandable gripping ring 161. The conical surfaces may include a slick conical surface 181 and rough conical surface 182, which may include teeth or corrugated features with a matching pattern compared to surface 165 of the expandable gripping ring 161

The inner surface of the locking ring 180 may include a conical surface 184. With the front section of the locking ring 180 having both an external 181 and internal 184 conical surfaces, it results in a funnel feature. The thickness 186 between both conical surfaces may be thin, in the order of 0.1 in to 0.5 in [2 mm to 12 mm]. Further inside the inner surface of the locking ring 180, the conical surface 184 may transition to a hemispherical surface 185 (i.e, a stopping inner surface). The back inner surface may then transition to a cylindrical surface 183.

Figure 19:
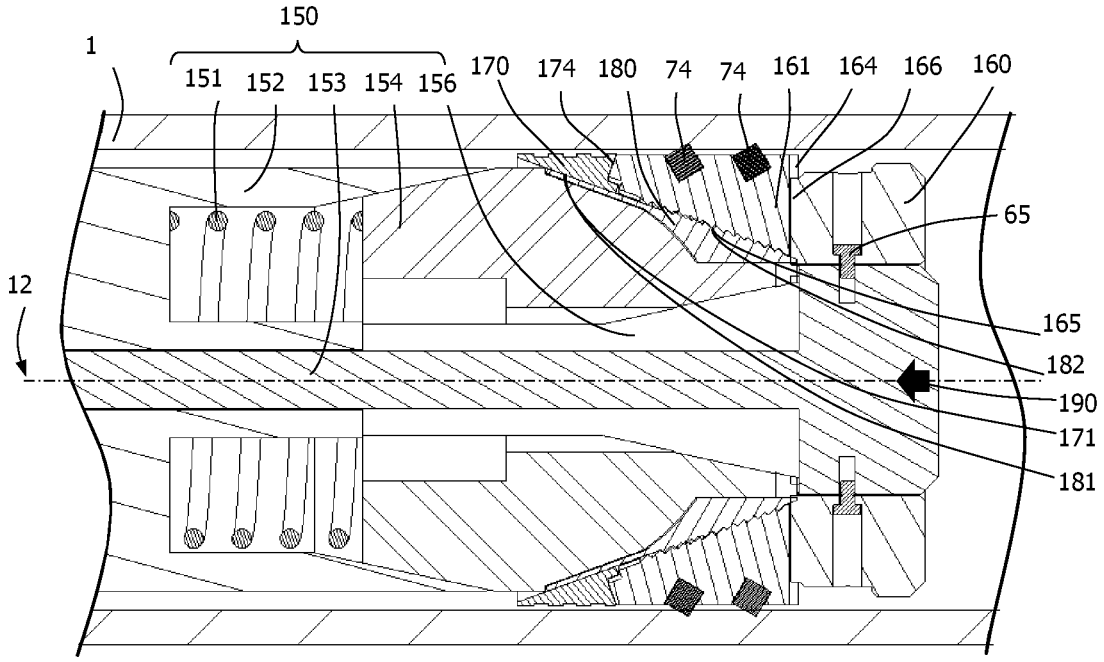
FIG. 19 is a cross-section view of plug assembly in a set stage inside a tubing string with a retrievable setting tool having expanded the expandable assembly.

FIG. 19 represents a sequential view of FIG. 15A, representing the plug in a set stage. FIG. 19 is a cut view of the set plug with actuated retrievable setting tool 150 inside the tubing string 1.

Figure 1:
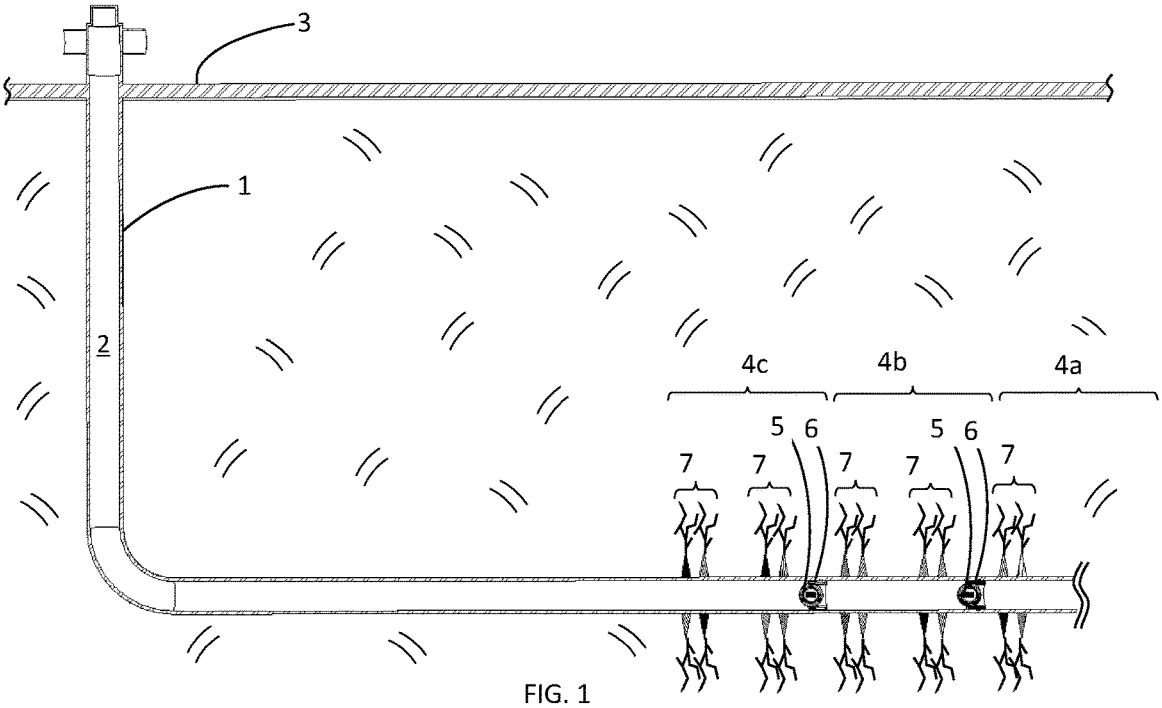
FIG. 1 is a wellbore cross-section view of typical Multi-Stage-Stimulation operation ongoing, with three stages completed.
Figure 2:
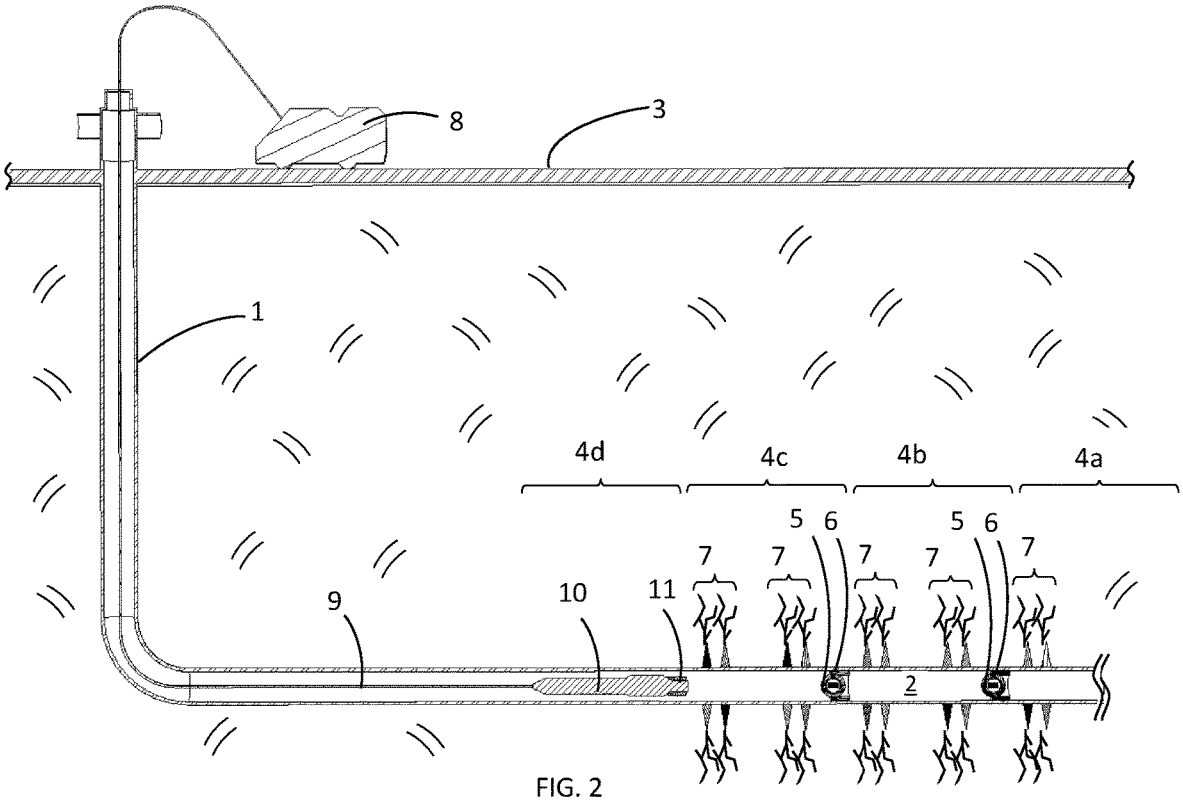
FIG. 2 is a wellbore cross-section view of toolstring conveyance to install the third isolation device for the fourth stage.
Figure 3:
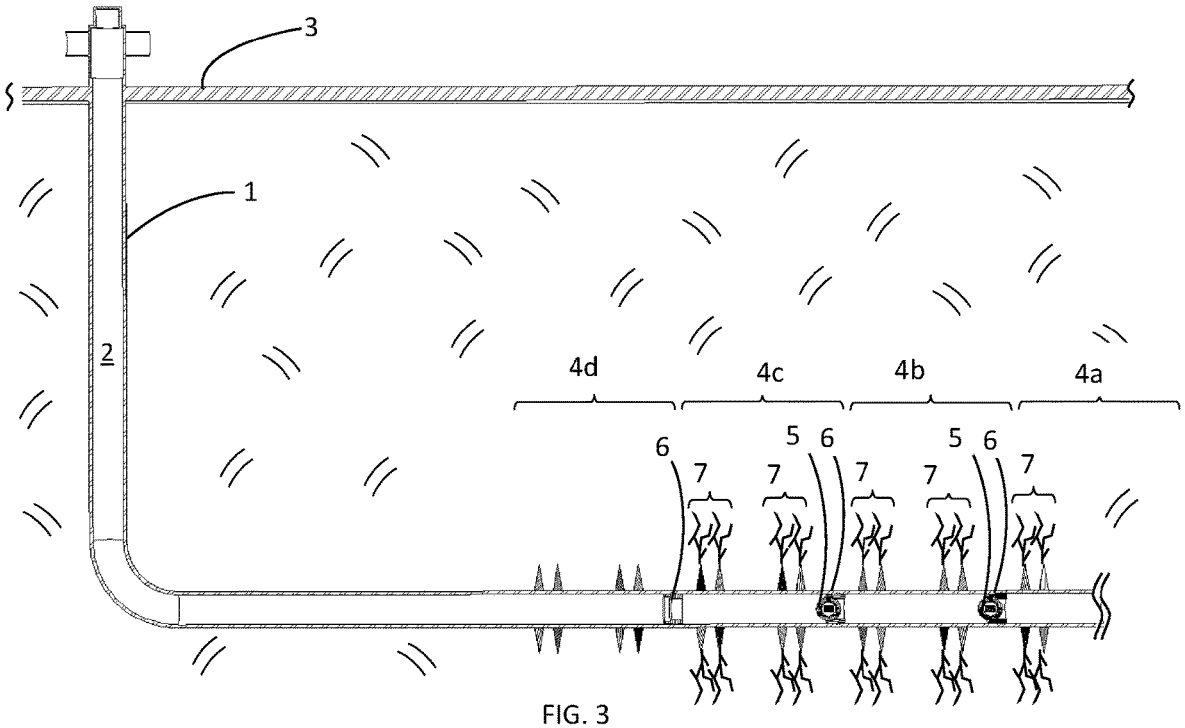
FIG. 3 is a wellbore cross-section view of the third stage isolation device being set and the fourth stage being perforated.
Figure 4:
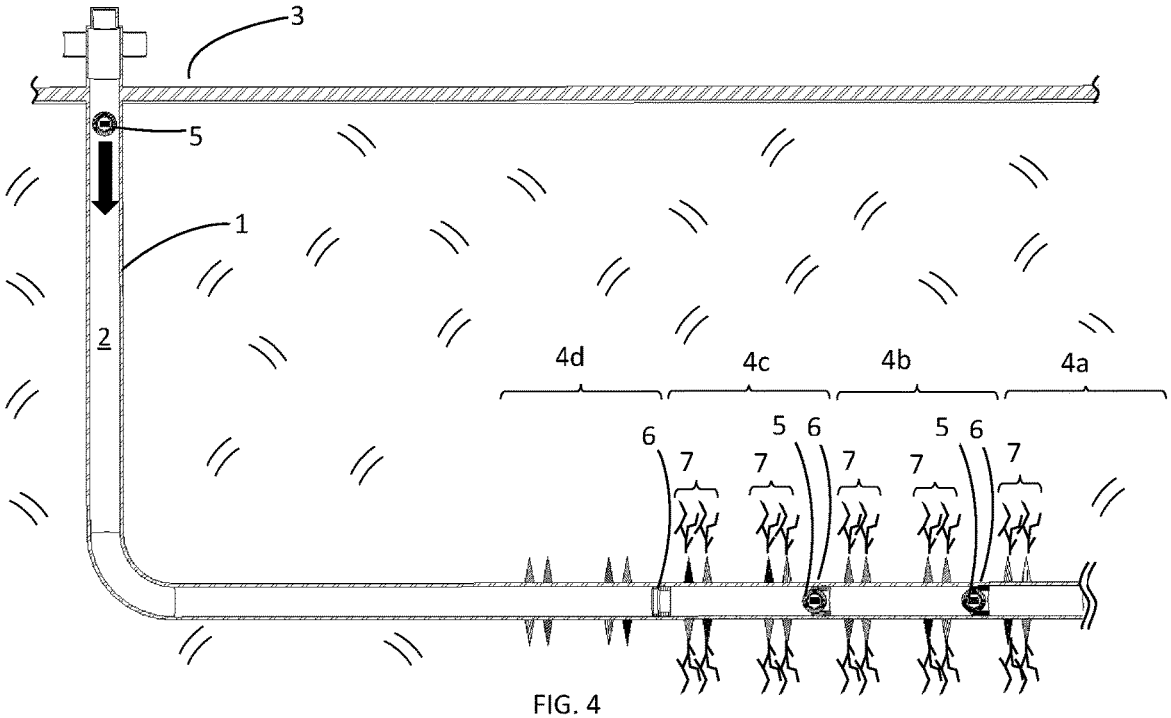
FIG. 4 is a wellbore cross-section view of an untethered object being dropped inside the well and moving towards the third isolation device through the perforated area.
Figure 5:
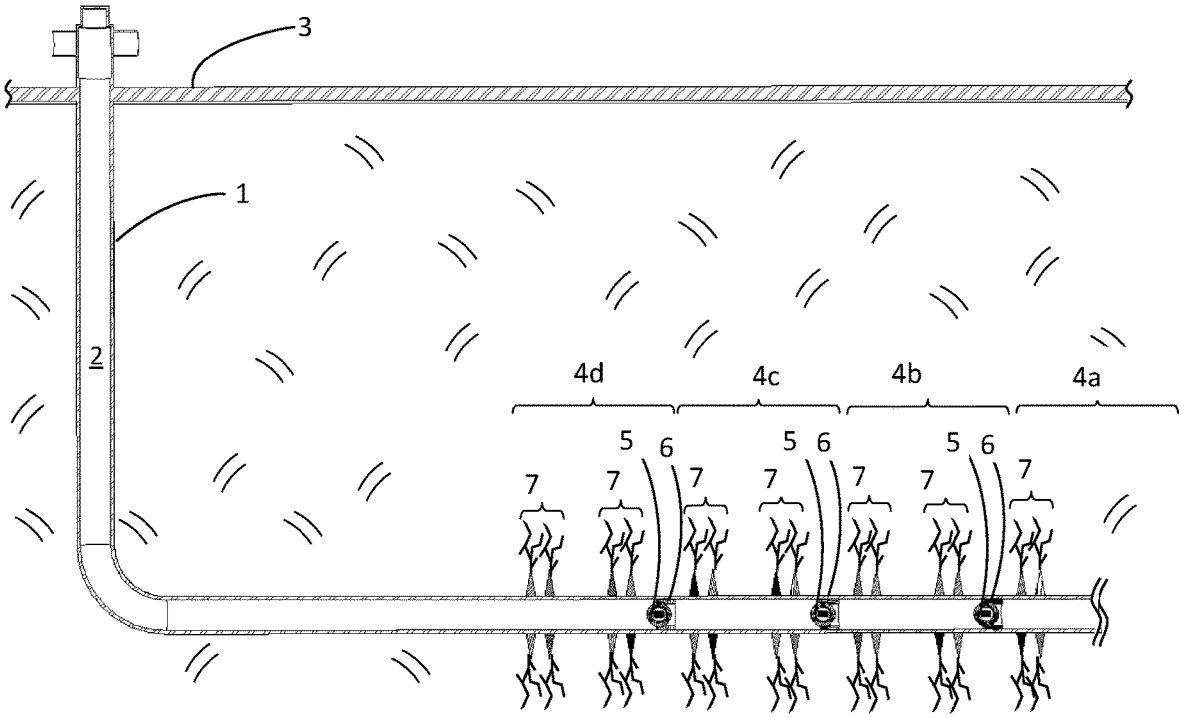
FIG. 5 is a wellbore cross-section view of the fourth stage isolated from the third stage by a plug and untethered object, and completed with pressure pumping operation.

Compared to FIG. 15A, a longitudinal movement 190 of the rod 153 has occurred compared to the other parts 151, 152, 154, 155, 156 of the retrievable setting tool 150. This longitudinal actuation 190 is preferably performed by an actuation tool as part of the toolstring 10, as depicted in FIG. 2.

The consequence of the rod movement 190 is a similar movement for the back-pushing ring 160, which is linked with the rod 153 by shearing devices 65. The longitudinal movement of the back-pushing ring 160 induces in turn the expansion of the expandable gripping ring 161.

The expansion of the expandable gripping ring 161 occurs while traveling on inner conical surface 165 over the matching conical surfaces 182 and 181 of the locking-ring 180. The rail features 166 on the back-pushing ring 160 and counter shape 164 on the expandable gripping ring 161 provides a radial expanding guide for ring sections 179. During the expansion, the ring sections 179 may be separated from each other by the rupture of the thin sections 163. The expansion of the expandable gripping ring will continue preferably up the contact of the anchoring devices 74 to the inner surface of the tubing string 1.

The expansion and longitudinal movement of the expandable gripping ring 161, induces also in turn the expansion of the continuous expandable seal ring 170. The expansion involves the traveling of the inner conical surface 171 over the matching conical surface 181 of the locking-ring 180. The expansion force is transmitted through the contact surface 174 between the expandable gripping ring 161 and the continuous expandable seal ring 170.

During the expansion process of 161 and 170, the locking ring 180 may not move longitudinally as secured in position with the retrievable setting tool 150, and in particular the sections 154.

The actuation force transmission 190 continues as long as an equilibrium is reached with the anchoring devices 74 and the shear devices 65.

Figure 20:
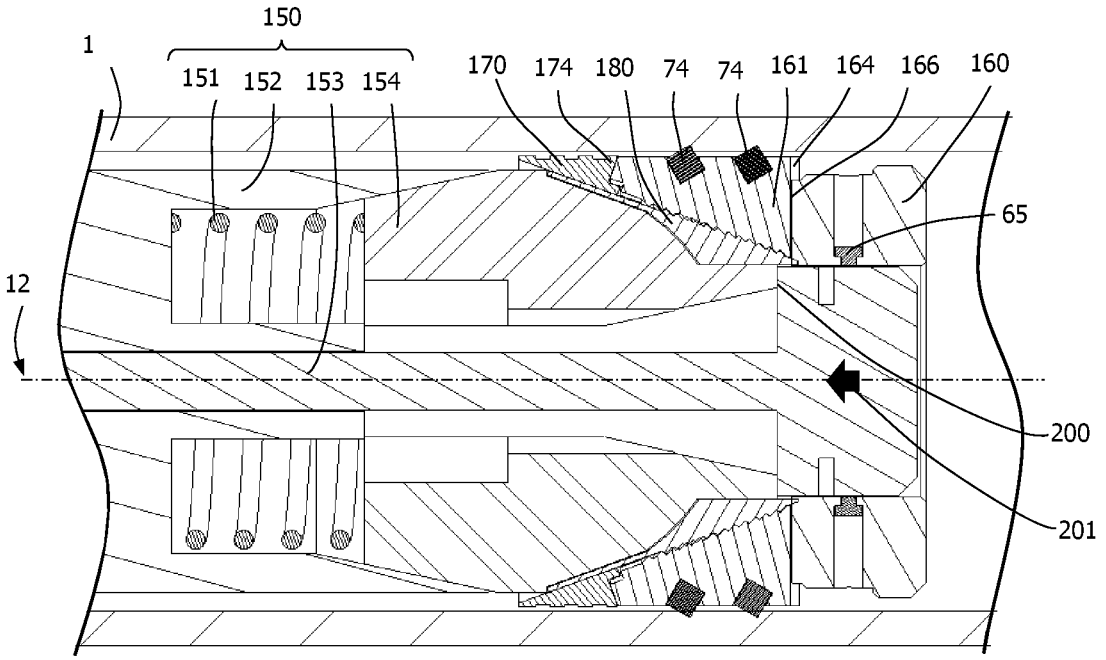
FIG. 20 is a cross-section view of plug assembly in a set stage inside a tubing string with a retrievable setting tool disconnecting from a back-pushing ring.

FIG. 20 is an immediate sequence of FIG. 19. At this moment, the shear devices 65 have sheared, disconnecting longitudinally the rod 153 from the back-pushing ring 160.

The rod may continue its longitudinal movement 201 up to contacting the sections 154 at the contact surface 200.

No other parts depicted in FIG. 20 may have moved compared to the description done for FIG. 19.

Figure 21:
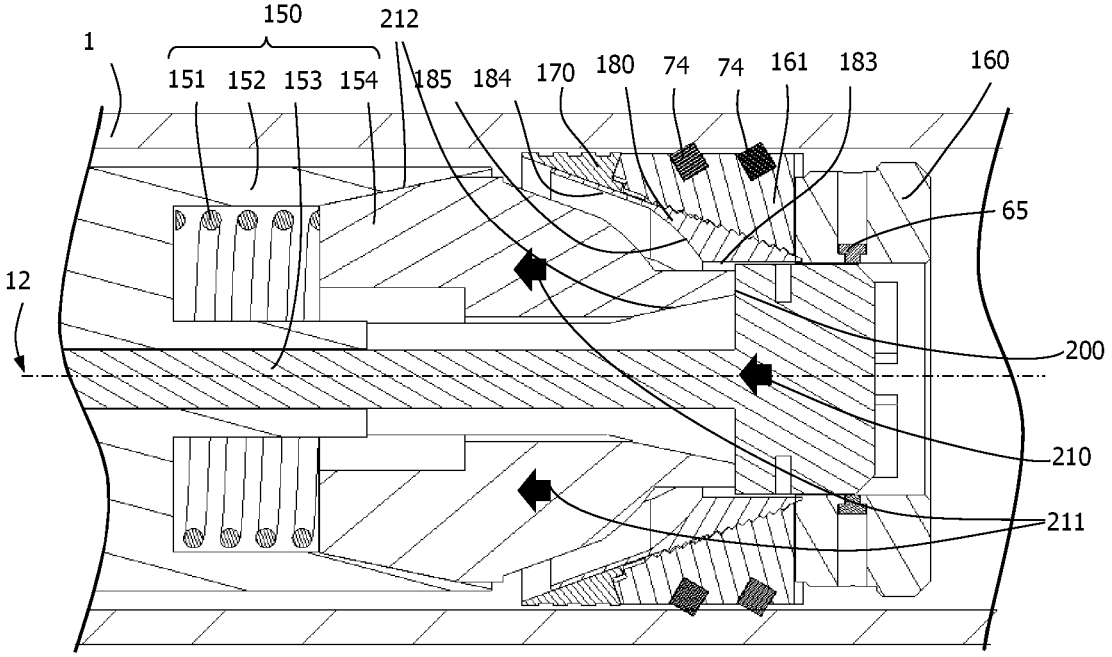
FIG. 21 is a cross-section view of plug assembly in a set stage inside a tubing string with a retrievable setting tool with collapsed sections.

FIG. 21 is a sequence of FIG. 20. At this moment, the further continuous movement 210 of the rod 153, has pushed the sections 154 by contacting the surface 200. The movement of the sections 154 may follow a combined axial and radial movement 211, guided by the surface 212 of the housing 152 and the nose 156. The relative movement of the sections will further be detailed in FIG. 35A to FIG. 38C.

At that point, the locking ring 180 is free from the contact surfaces 184 and 185 with the sections 154 of the retrievable setting tool 150. The locking ring 180, as well as the expandable gripping ring 161 and expandable continuous seal ring 170 are secured in position inside the tubing string 1, thanks to the different locking features described previously in FIGS. 16B, 17B and 18A, namely the teeth or corrugated surfaces 165, 182 along with groove feature 169.

The longitudinal movement of the section 154 also induces the compressing of the spring 151 of the retrievable setting tool 150.

Figure 22:
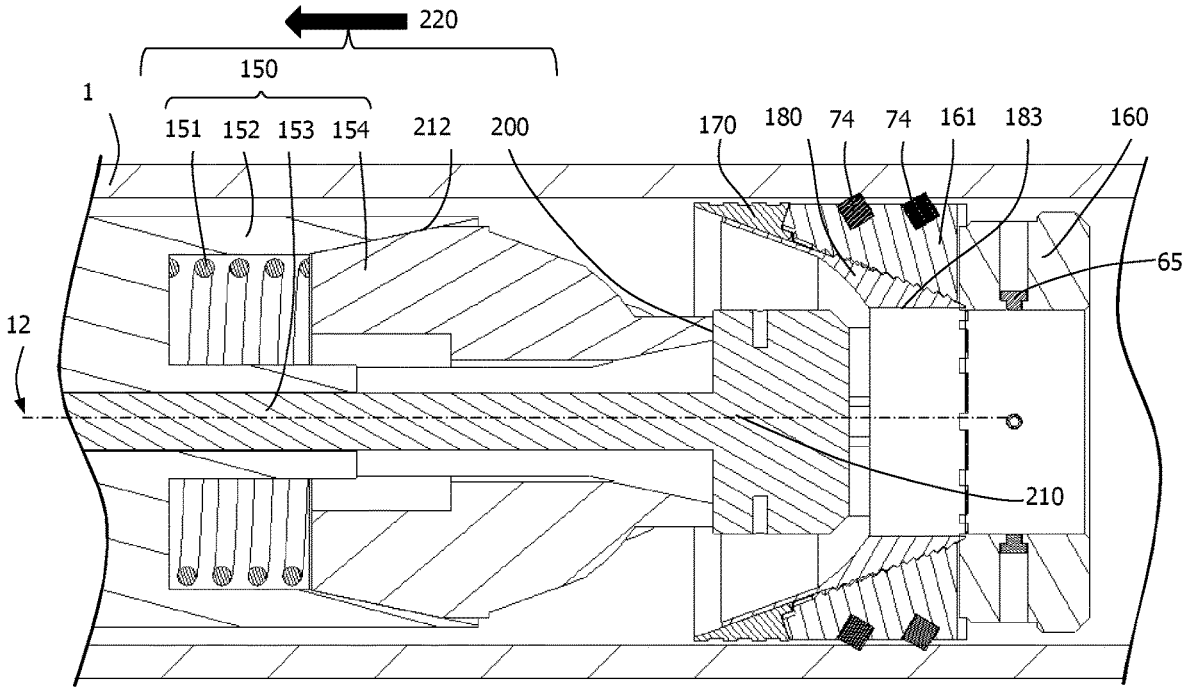
FIG. 22 is a cross-section view of plug assembly in a set stage inside a tubing string with a retrievable setting tool with collapsed sections under retrieval from the plug assembly.

FIG. 22 is a sequence of FIG. 21. It represents the retrieval movement 220 of the retrievable setting tool 150. The retrievable movement 220 is preferably induced from the retrieval of the toolstring 10 as represented in FIG. 2.

The plug parts 170, 180, 161 and 160 may now remain in place inside the tubing string 1.

Figure 23A:
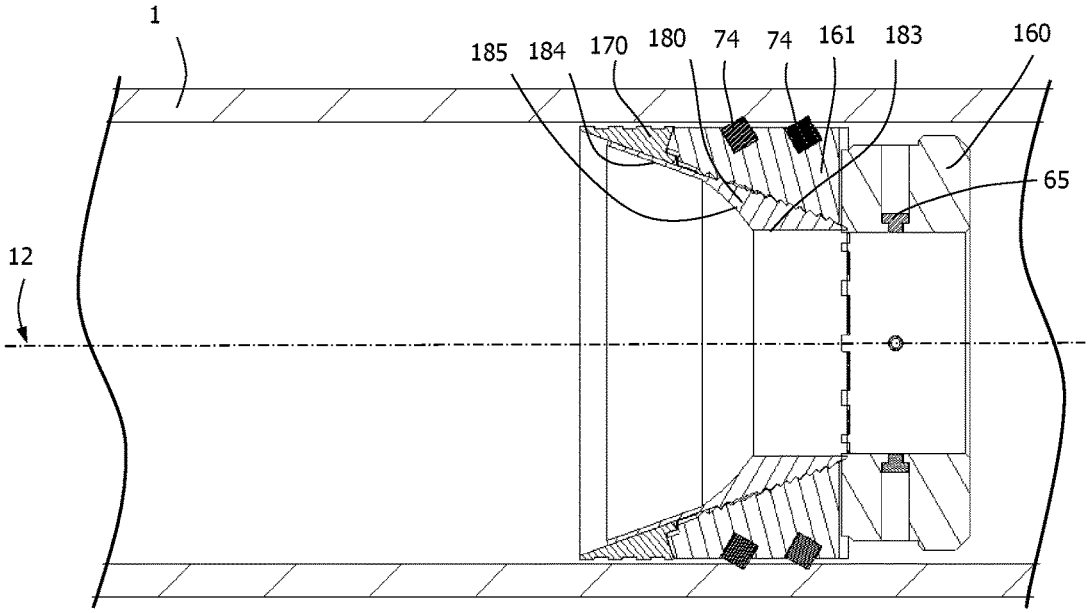
FIG. 23A is a cross-section view of a plug assembly in a set stage inside a tubing string after retrieval of the retrievable setting tool.

FIG. 23A is a sequence of FIG. 22. It represents the set plug inside the tubing string 1. The retrievable setting tool 150 has now been retrieved.

Figure 23B:
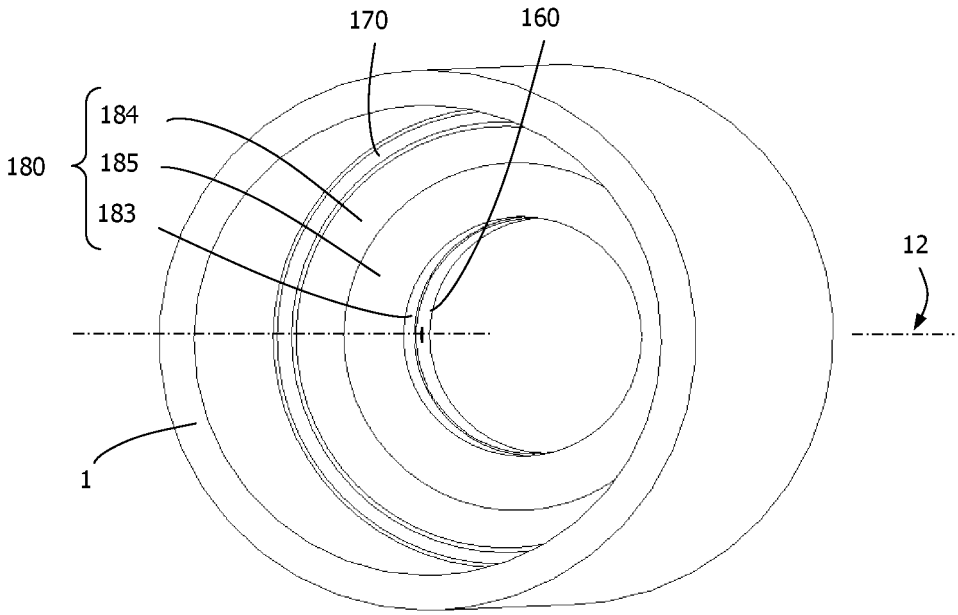
FIG. 23B is an isometric view of the same embodiment as FIG. 23A.

FIG. 23B is an isometric view of FIG. 23A representing the set plug inside the tubing string 1. The view allows representing following surfaces of the locking ring 180: the conical surface 184, the hemispherical surface 185 and the cylindrical surface 183. The expandable continuous seal ring 170 may be visible, as well as the back-pushing ring 160 in the back.

Figure 23C:
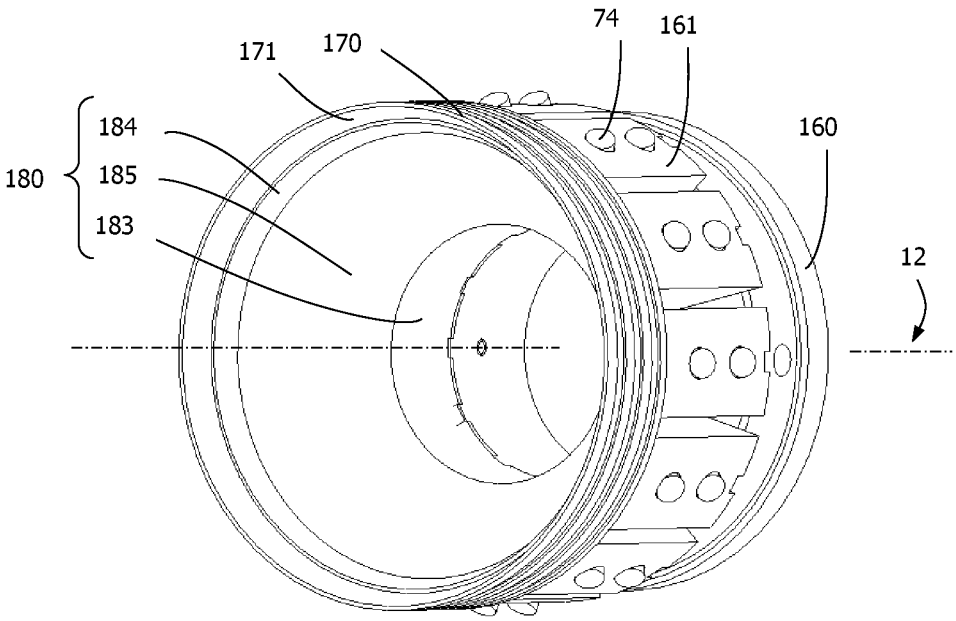
FIG. 23C is an isometric view of the same embodiment as FIG. 23B without showing the tubing string.

FIG. 23C is a similar isometric view as FIG. 23B, without the representation of the tubing string 1. This view represents the set plug with locking ring 180, the expandable continuous seal ring 170, the expandable gripping ring 161 with anchoring devices 74, and the back-pushing ring 160.

Visible inner surfaces are referenced, namely the conical surface 171 of the expandable continuous ring 170, the conical surface 184, the hemispherical surface 185 and the cylindrical surface 183, of the expandable gripping ring 180.

Figure 24A:
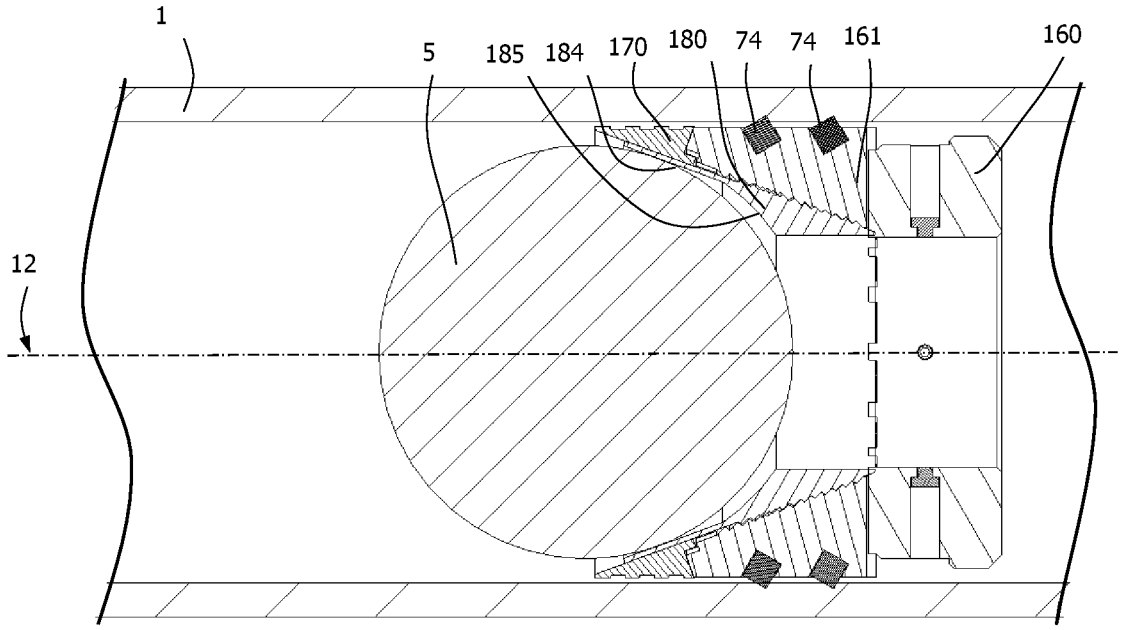
FIG. 24A is a cross-section view of a plug assembly in a set stage inside a tubing string with the landing position of an untethered object.

FIG. 24A is a sequence of FIG. 23A. It represents the same plug as in FIG. 23A with the addition of the untethered object 5.

The untethered object 5 may have the shape of a sphere, or for the purpose of this embodiment only contain a spherical surface which will contact the inner surface 185 of the locking ring 180. As other possible shapes for the untethered object containing a spherical front surface, it may include pill shape or dart shape.

As represented in FIG. 24A, the diameter of the spherical portion of the untethered object 5 may be adapted to contact the conical surface 184 of the locking ring 180, while not contacting the hemispherical surface 185.

Figure 24B:
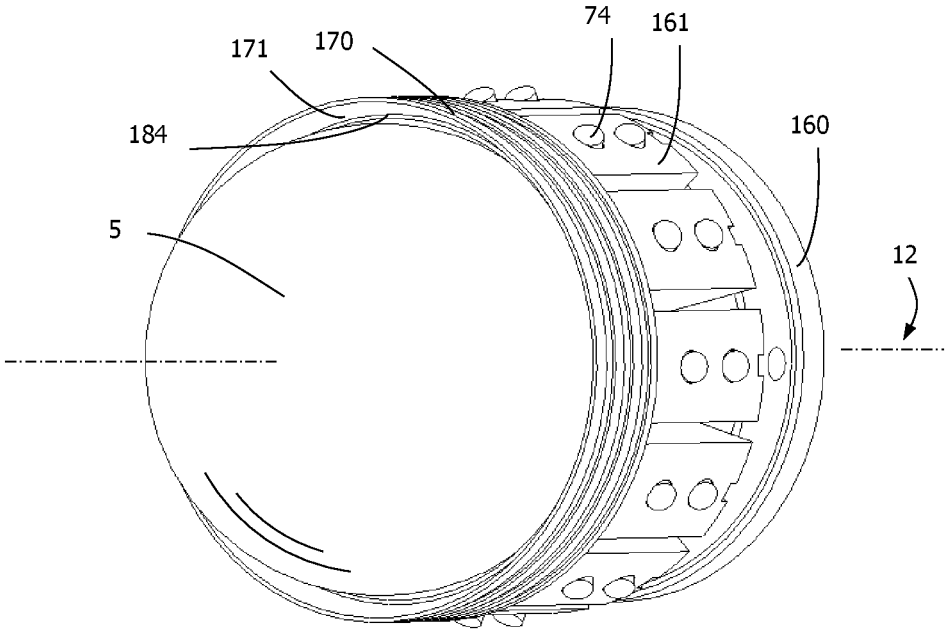
FIG. 24B is an isometric view of the same embodiment as FIG. 24A without showing the tubing string.

FIG. 24B represents an isometric view of FIG. 24A, without the tubing string 1. The figure represents the position of the untethered object 5 as it landed on the plug and contacted the surface 184 of the locking ring 180, while not necessary contacting the inner conical surface 171 of the expandable continuous seal ring 170. The expandable gripping ring 161, along with its anchoring devices 74, and the back-pushing ring, may preferably keep their set position from FIG. 23A.

Figure 24C:
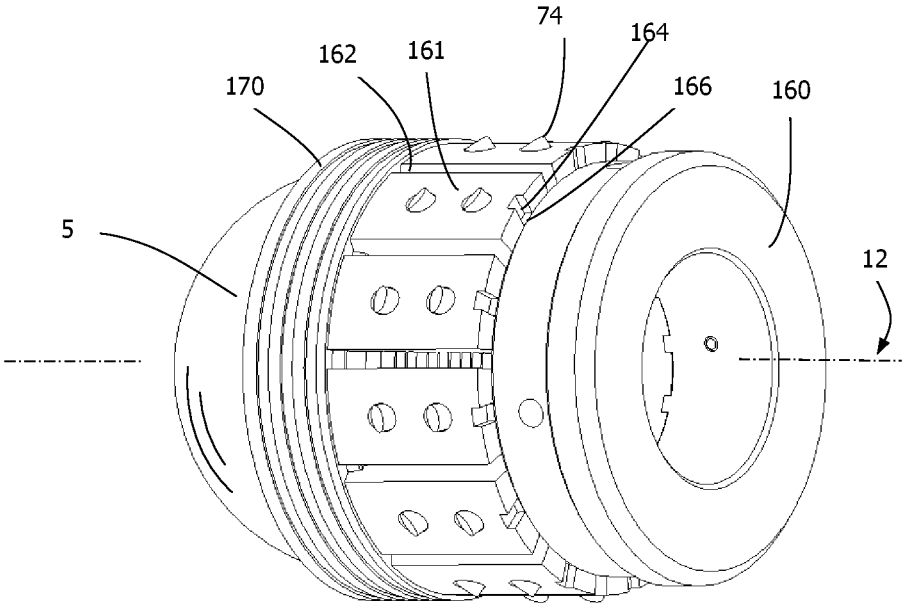
FIG. 24C is another isometric view from the back of the same embodiment as FIG. 24B.

FIG. 24C represents a different orientation of the same embodiment as FIG. 24B. Same components as FIG. 24B are represented. In particular, the position of the rails 164 and 166 with its radial positioning are represented after the expansion of the expandable gripping ring. The slit cuts 162 are consequently wider as depicted in the unset position represented in FIG. 16A.

Figure 25:
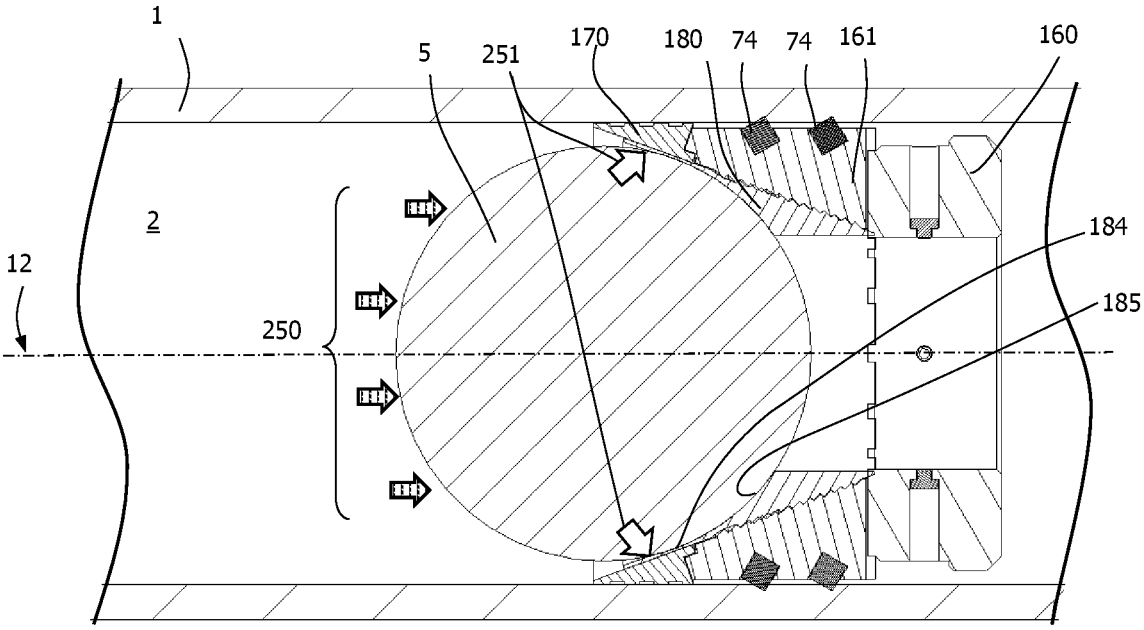
FIG. 25 is a cross-section view of a plug assembly in a set stage inside a tubing string with the untethered object pressing on the plug assembly using well fluid pressure.

FIG. 25 is a sequence of FIG. 24A. It represents the action of the untethered object 5. Through pumping well fluid 2 inside the tubing string 1, such as from surface, the flow restriction constituted by the set plug component 170, 161 and 180, along with the untethered object 5, creates a flow restriction and in turn a pressure 250 on the untethered object, which created a force. This force is transmitted through the contact surface 184 and induces a conical expansion force 251. This force 251 expands the thin section of the locking ring 180 and in turn the inner surface 171 of the expandable continuous seal ring 170. This further expansion of the continuous expandable seal ring may provide enhanced contact surface with the tubing string 1, and consequently enhance the sealing of the plug. The expansion movement of the continuous expandable seal ring may continue as long as the untethered object moves longitudinally inwards through the conical surface 184, and may be stopped at the point where the untethered object 5 contacts the hemispherical surface 185 of the locking ring 180. The other plug components 161 and 160 may not move during this further expansion process of the continuous expandable seal ring 170.

Figure 26A:
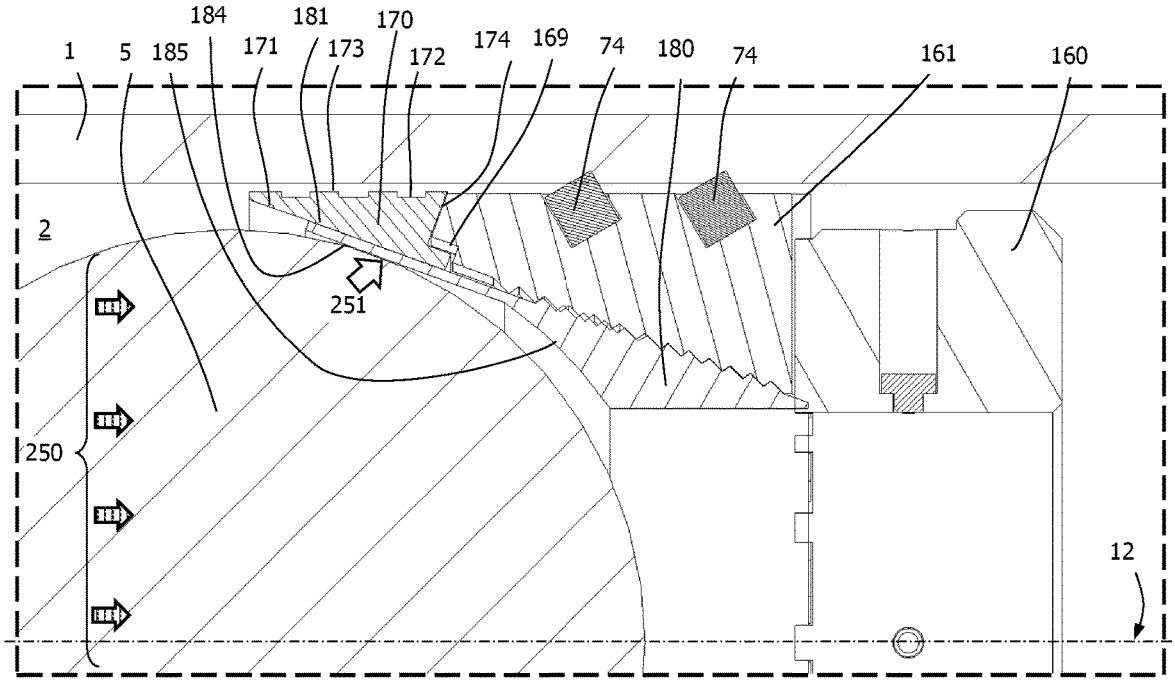
FIG. 26A is a detailed view of a cross-section view of a plug assembly in a set stage inside a tubing string with the landing position of an untethered object.
Figure 26B:
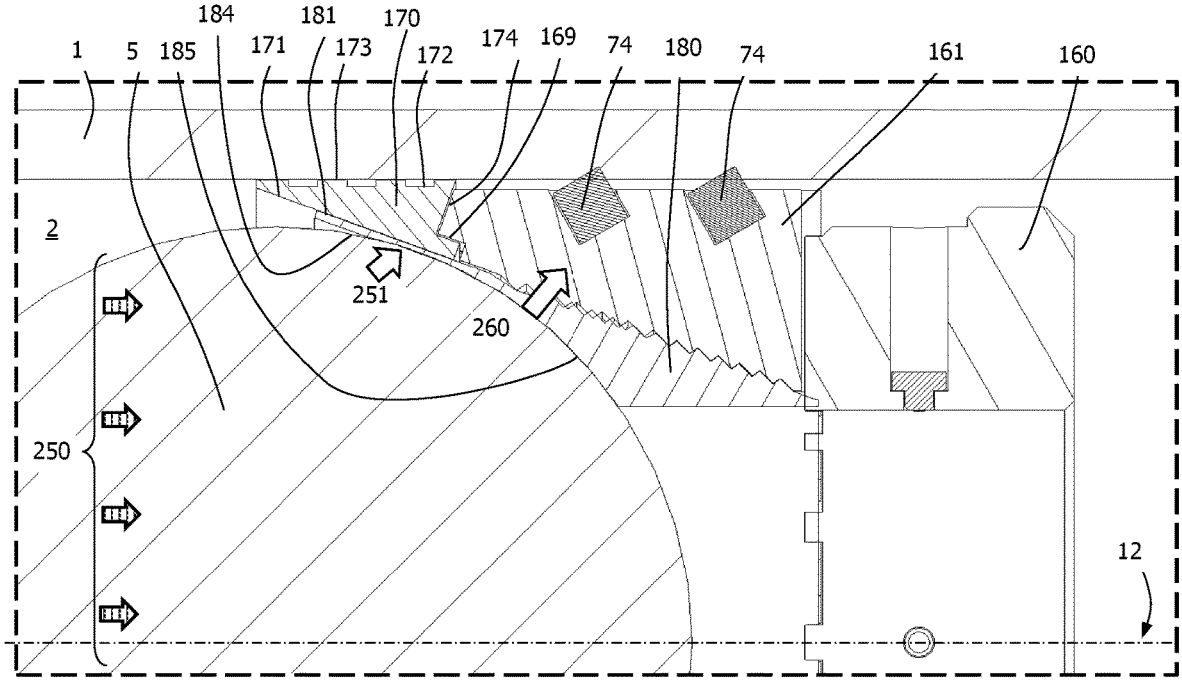
FIG. 26B is a detailed view of a cross-section view of a plug assembly in a set stage inside a tubing string with the untethered object pressing on the plug assembly using well fluid pressure.

FIGS. 26A and 26B represent close-up views of already depicted views in FIGS. 24A and 25.

FIG. 26A shows in detail the untethered object 5 contacting the inner surface 184 of the locking ring 180. The resulting force 251, induced from pressure force 250 on the untethered object 5, is transmitted through the thin section between the surfaces 184 and 181 of the locking ring 180. Assuming a material with sufficient ductility, preferably above 5%, the force 251 is then transferred to the continuous expandable seal ring 170, on its inner conical surface 171. As depicted in FIG. 26A, the continuous expandable seal ring 170 may not contact the inner surface of the tubing string 1. A possible radial gap may be present between the external cylindrical surface 173 of the continuous expandable seal ring 170 and the inner surface of the tubing string 1.

The expandable gripping ring 161 may be locked longitudinally with the anchoring devices 74 penetrating inside the tubing string 1. The expandable gripping ring 161 may be also locked radially with locking ring 180. Therefore, the force 251 acting on the expandable continuous seal ring 170 may be guided along the surface 174 contacting the expandable gripping ring 161. The expandable continuous seal ring 170 may expand further radially following the surface 174, represented as a conical surface. A possible groove 169 on the expandable gripping ring 161 may have a similar radial gap to allow this relative radial movement between both parts 161 and 170.

FIG. 26B shows the possible final position of the untethered object 5. Force 251 has expanded both the thin section of the locking ring 180 and further the expandable continuous seal ring 170 up to contacting the outer surface 173 with the inner surface of the tubing string 1. The expandable continuous seal ring 170 is therefore radially further expanded, following the guiding surface 174. The groove gap 169 may be closed after this expansion. The untethered object 5 may move longitudinally during the expansion process of both the locking-ring 180 and expandable continuous seal ring 170. This longitudinal movement of the untethered object 5 may stop as the untethered object 5 is contacting the hemispherical surface 185 of the locking ring 180. At the point of contact, the expansion process of the locking ring and expandable continuous ring may stop as well, and the force 250 from the untethered object may then be shared between further force 251 and a force 260. The force 260 may be directed from the untethered object 5, towards the locking ring 180 and transmitted to the expandable gripping ring 161, allowing to possibly reinforce the anchoring penetration of the anchoring devices 74 inside the tubing string 1.

Figure 27:
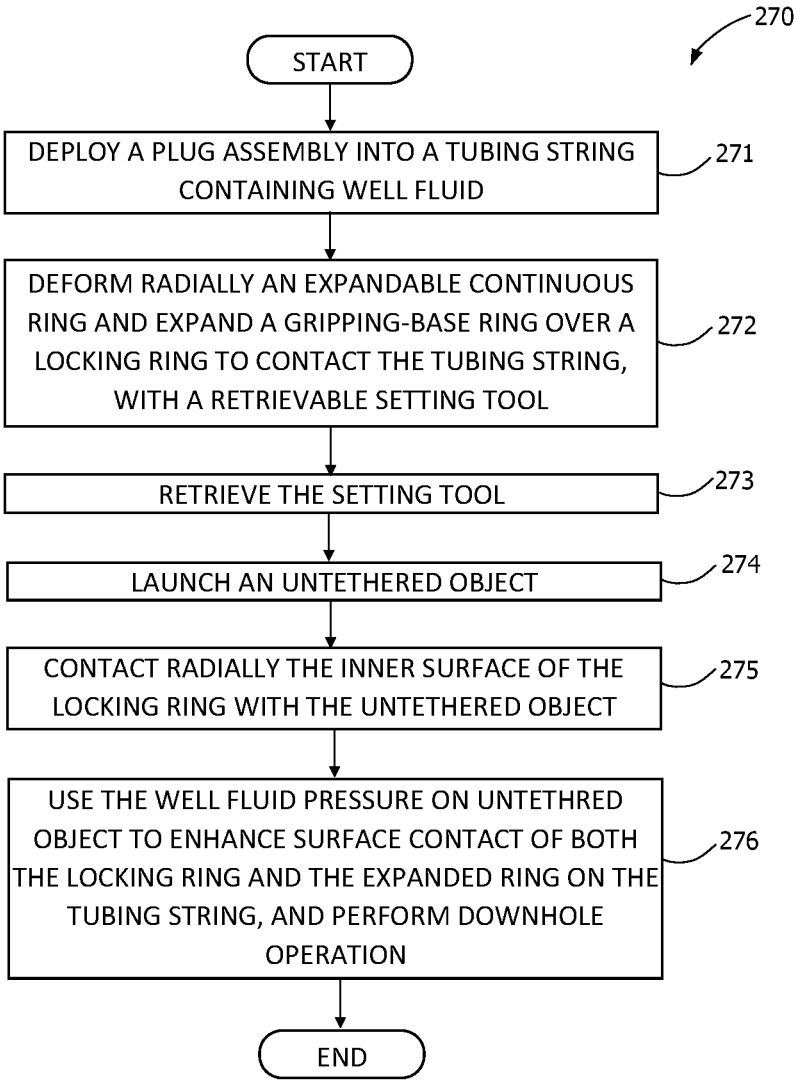
FIG. 27 is a flow diagram representing a technique sequence of deployment of a plug and action of the untethered object on the expandable continuous ring.

FIG. 27 represents a technique sequence 270, which includes major steps depicted in FIG. 15A to FIG. 25.

Step 271 corresponds to the deployment of the plug assembly (170, 180, 161, 160) into the tubing string (1) containing well fluid (2). During step 272, the plug assembly with its expandable continuous seal ring (170) is deformed radially, and the expandable gripping ring 161 is expanded radially, both due to the action of a retrievable setting tool (150), over a locking ring (180). During the same step 272, the expandable gripping ring contacts at least one point of the inner surface of the tubing string (1). Then, during step 273, the retrievable setting tool (150), is retrieved. Further during step 274, an untethered object (5), is launched, such as from surface, inside the tubing string (1). Then, during step 275, the untethered object (5) reaches the position of the set plug in step 272 and contacts radially the inner surface of the locking ring (180). Finally, during step 276, the well fluid (2) pressure and flow restriction up-hole of the untethered object (5) is used to act as a force on both the locking ring (180) and the expandable continuous seal ring (170) to enhance the surface contact with the tubing string (1). This isolation state allows performing a downhole operation inside the well.

Figure 28:
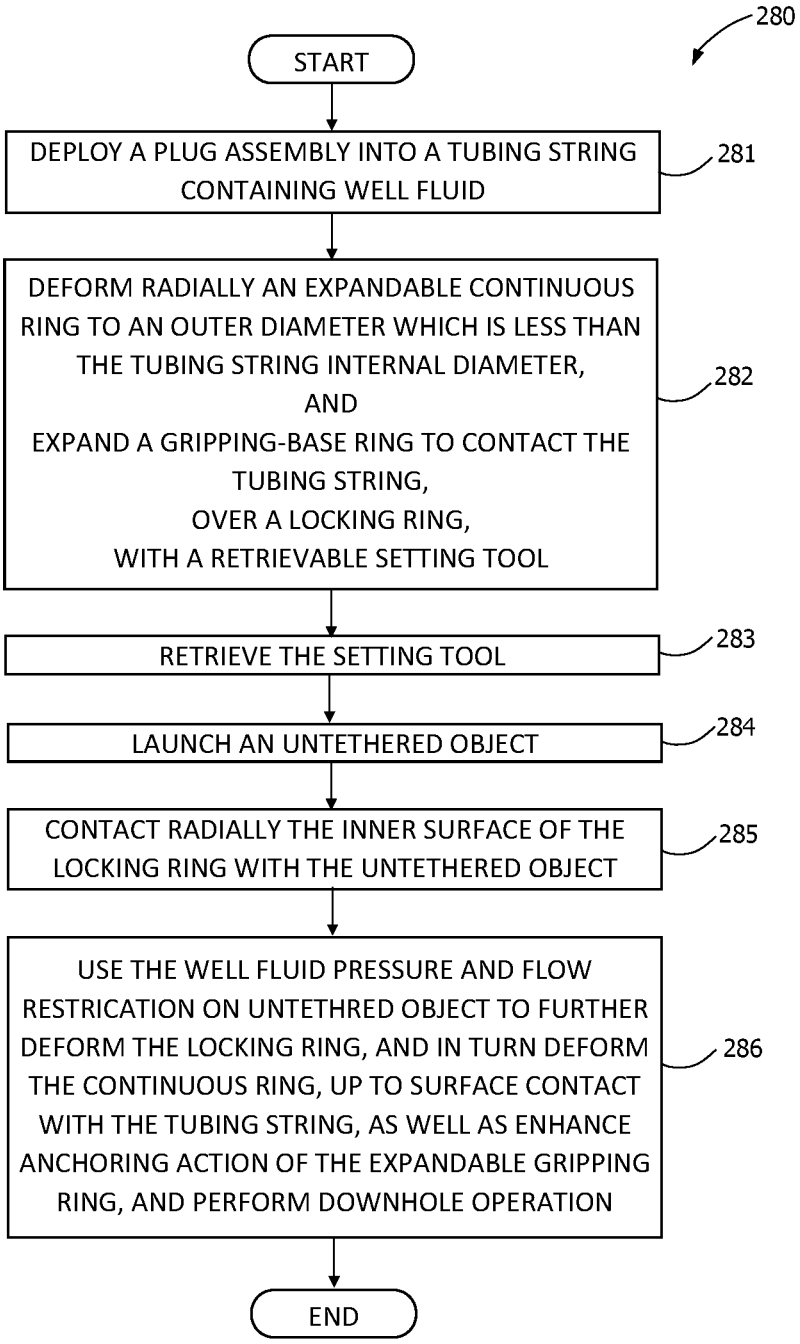
FIG. 28 is a flow diagram representing a technique sequence of deployment of a plug, with the action of an untethered object for further expanding the expandable assembly and contacting a stopping surface on the locking ring.

FIG. 28 represents a technique sequence 280, which includes major steps depicted in FIG. 15A to FIG. 26B.

Step 281 corresponds to the deployment of the plug assembly (170, 180, 161, 160) into the tubing string (1) containing well fluid (2). During step 282, the plug assembly with its expandable continuous seal ring (170) is deformed radially, and the expandable gripping ring (161) is expanded radially, both due to the action of a retrievable setting tool (150), over a locking ring (180). During the same step 272, the expandable gripping ring contacts at least one point of the inner surface of the tubing string (1), while the expandable continuous seal ring (170) is deformed to an outer diameter which is less than the tubing string (1) inner diameter. Then, during step 283, the retrievable setting tool (150), is retrieved. Further during step 284, an untethered object (5), is launched, such as from surface, inside the tubing string (1). Then, during step 275, the untethered object (5) reaches the position of the set plug in step 282 and contacts radially the inner surface of the locking ring (180). Finally, during step 286, the well fluid (2) pressure and flow restriction up-hole of the untethered object (5) is used to act as a force to deform further both the locking ring (180) and the expandable continuous seal ring (170), up to surface contact with the tubing string, allowing further enhanced contact between all plug components from the untethered object (5) to the tubing string (1) passing through the locking ring (180) and expandable continuous seal ring (170). The force also provides enhanced anchoring action on the expandable gripping ring (161). This isolation state allows performing a downhole operation inside the well.

Figure 29:
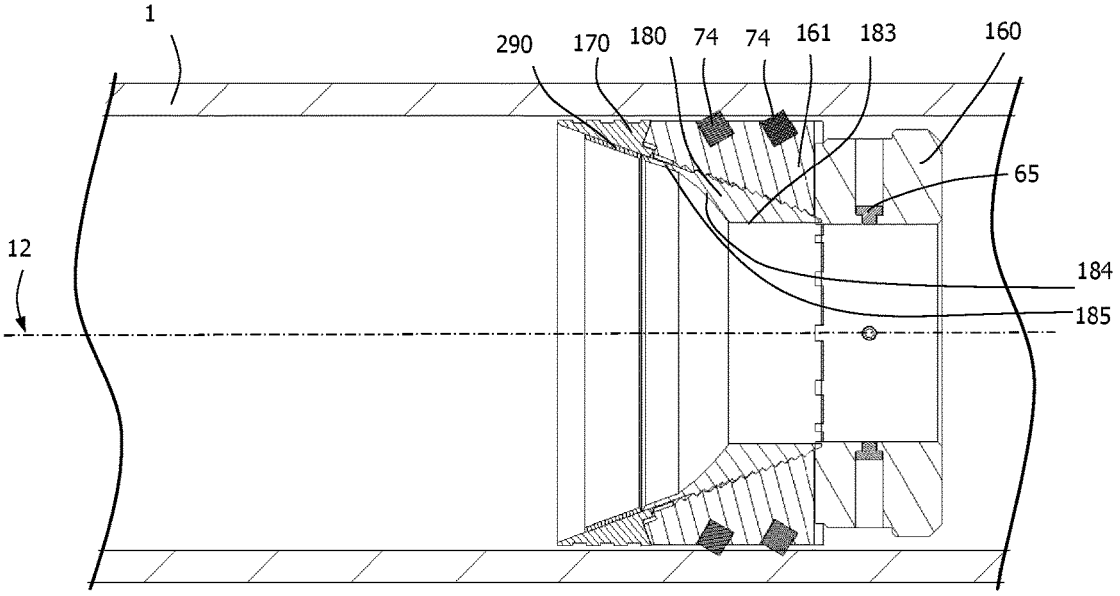
FIG. 29 is a cross-section view of another embodiment of a plug assembly in a set stage inside a tubing string after retrieval of the retrievable setting tool, having a two-section locking ring.
Figure 30A:
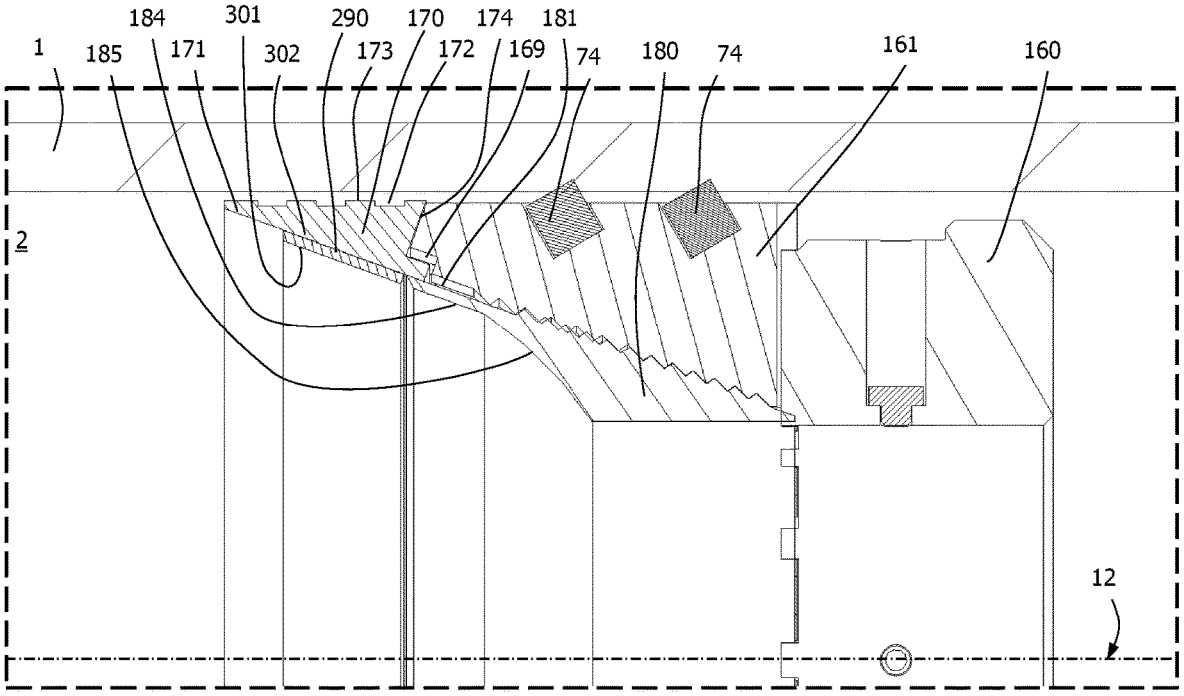
FIG. 30A is a detailed view of FIG. 29.
Figure 30B:
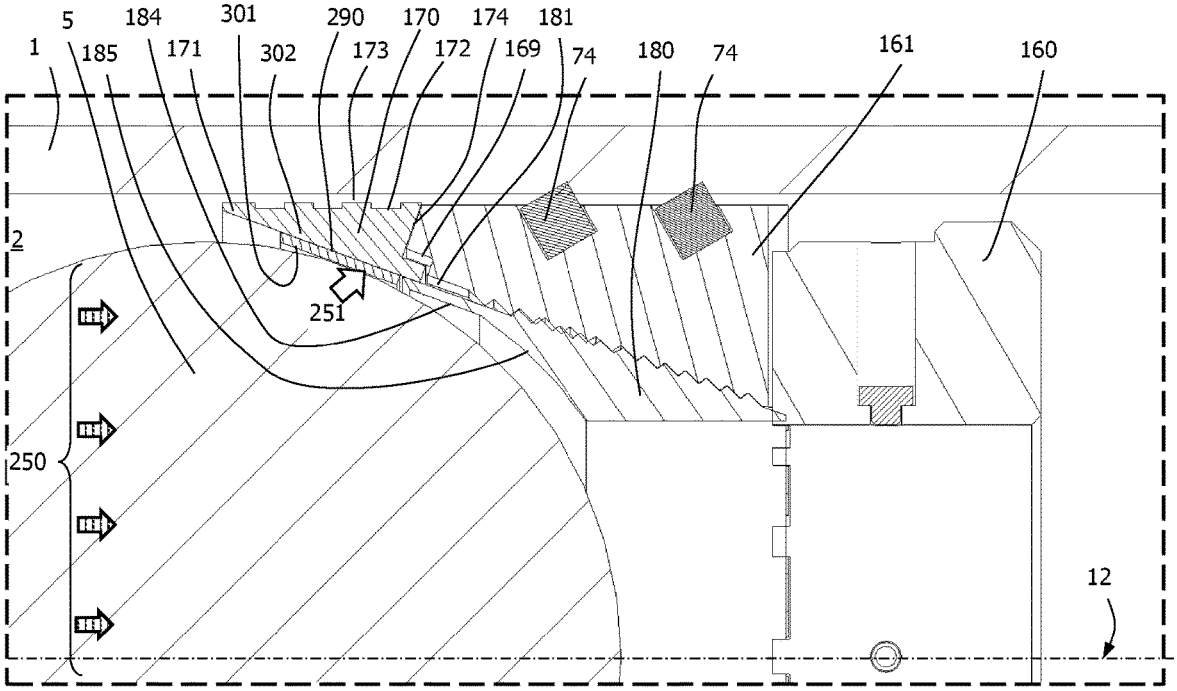
FIG. 30B is a detailed view of a plug assembly with a two-section locking ring in a set stage inside a tubing string with the landing position of an untethered object.
Figure 30C:
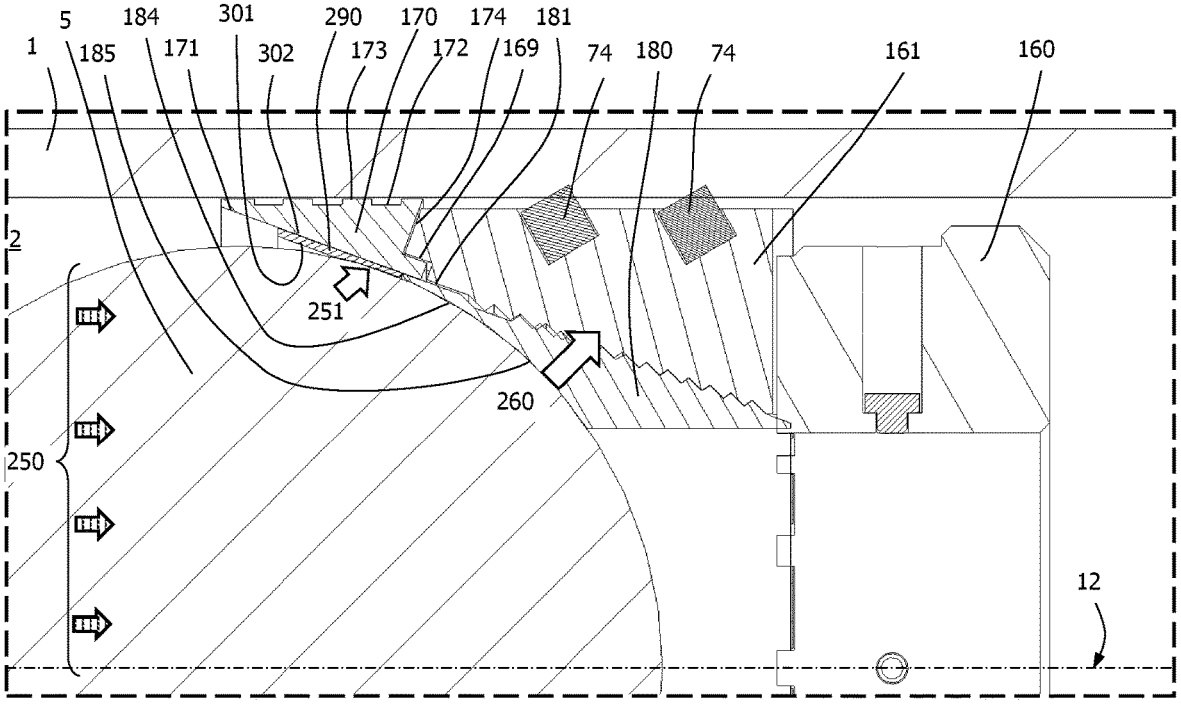
FIG. 30C is a detailed view of a plug assembly with a two-section locking ring in a set stage inside a tubing string with the untethered object pressing on the plug assembly using well fluid pressure.
Figure 31:
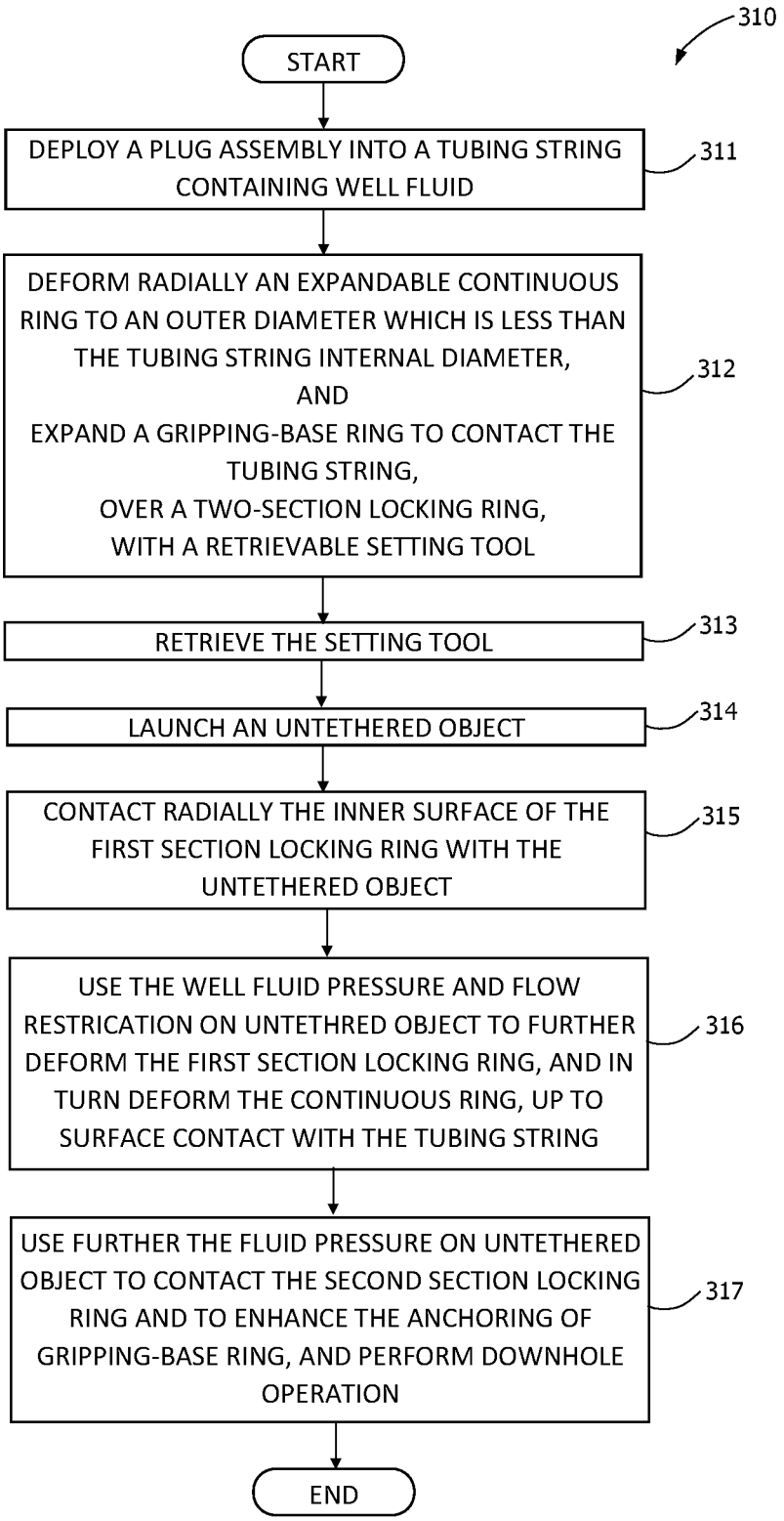
FIG. 31 is a flow diagram representing a technique sequence of deployment of a plug with a two-section locking ring, with the action of an untethered object for further expanding the expandable assembly and contacting a stopping surface on the locking ring.

FIGS. 29 to 31 represent a variation to the previously described embodiment from FIG. 15A to FIG. 26B.

A noticeable difference is a separation in two parts of the locking ring 180.

FIG. 29 represents a set plug, in a similar configuration as FIG. 23A. The locking ring 180 is shorter than in FIG. 23A, and referred to as first section locking ring. A second section locking ring 290 corresponds to the thin section conical shape described in FIG. 18B.

The other parts of the plug, namely the expandable continuous seal ring 170, the expandable gripping ring 161 with its anchoring devices 74, the back-pushing ring 160 with shearing devices 65, remain similar to FIGS. 15A to 26B.

FIG. 30A represents a close-up view of FIG. 29 in the same configuration. The first section locking ring 180 keeps the inner surfaces 185 as hemispherical and 184 as conical. The second section locking ring 290 includes an inner conical surface 301 which may be in the continuity of the inner surface 184 of the first section locking ring 180. The second section locking ring 290 includes an outer conical surface 302 which may be in the continuity of the outer surface 181 of the first section locking ring 180. In this configuration, most of the contact surface 171 with the expandable continuous seal ring 170 occurs with the second section locking ring 290 via the conical surface 302, and most of the contact surface with the expandable gripping ring 161 occurs via the external conical surface 181 of the first section locking ring.

This configuration with two sections locking ring allows for example to adapt the material properties for the first 180 and second 290 section of the locking ring. As the second section 290 might be more exposed to deformation, a choice of more ductile material could be made. Regarding the first section locking ring 180, more exposed to radial loading, a material with higher yield stress might be selected.

FIG. 30B represents the action of an untethered object 5, similar to FIG. 26A previously described.

A difference is the acting of the untethered object 5 through the force 251 which is now contacting the second section 290 of the locking ring. The deformation is now transferred from inner surface 301 towards the outer surface 302 of the second section locking ring 290, and further to the expandable continuous seal ring 170 via its inner surface 171. A similar deformation as described in FIG. 26A can occur, with the expandable continuous seal ring 170 following the trajectory surface 174 of the expandable gripping ring 161. The first section locking ring 180 might not be contacted by the untethered object during this step.

FIG. 30C represents the further action of an untethered object 5, similar to FIG. 26B previously described.

The resulting shape is very similar to FIG. 26B. A difference is that the majority of the force 251 towards the expandable continuous seal ring 170 is transmitted via the second section locking ring 290, and that the majority of the force 260 towards the expandable gripping ring 161 is transmitted via the first section locking ring 180.

Depending on material property choices, some specific goals towards sealing (290, 170) and towards anchoring (180, 161) might be selected to reach the wished performance.

FIG. 31 represents a technique sequence 310, which includes major steps depicted in FIG. 29 to FIG. 30C.

Step 311 corresponds to the deployment of the plug assembly (170, 180, 290, 161, 160) into the tubing string (1) containing well fluid (2). During step 312, the plug assembly with its expandable continuous seal ring (170) is deformed radially, and the expandable gripping ring (161) is expanded radially, both due to the action of a retrievable setting tool (150), over a two-section locking ring (180 and 290). During the same step 312, the expandable gripping ring contacts at least one point of the inner surface of the tubing string (1), while the expandable continuous seal ring (170) is deformed to an outer diameter which is less than the tubing string (1) inner diameter. Then, during step 313, the retrievable setting tool (150), is retrieved. Further during step 314, an untethered object (5), is launched, such as from surface, inside the tubing string (1). Then, during step 315, the untethered object (5) reaches the position of the set plug in step 282 and contacts radially the inner surface of the first section locking ring (290). Then, during step 316, the well fluid (2) pressure and flow restriction up-hole of the untethered object (5) is used to act as a force to deform further both the first section locking ring (290) and the expandable continuous seal ring (170), up to surface contact with the tubing string, allowing further enhanced contact between all plug components from the untethered object (5) to the tubing string (1) passing through the first section locking ring (290) and expandable continuous seal ring (170). Further in step 317, the force coming from the fluid pressure on the untethered object (5) is used to contact the second section locking ring (180) to enhance the anchoring action on the expandable gripping ring (161). This isolation state allows performing a downhole operation inside the well.

Figure 32:
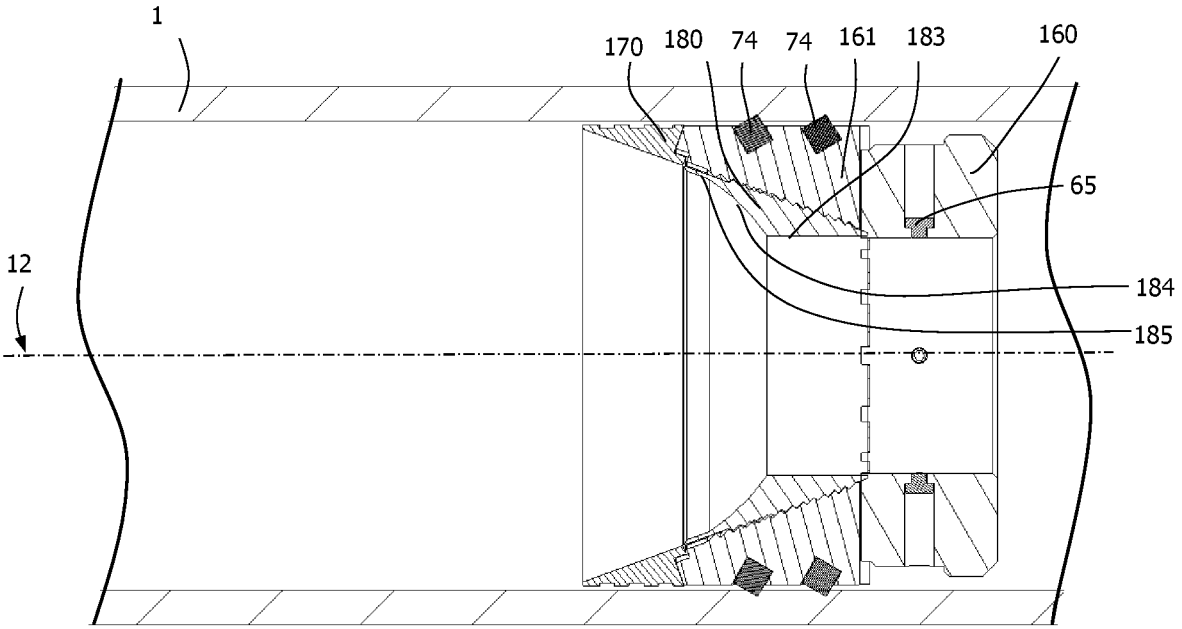
FIG. 32 is a cross-section view of another embodiment of a plug assembly in a set stage inside a tubing string after retrieval of the retrievable setting tool, having a short-length locking ring.
Figure 33A:
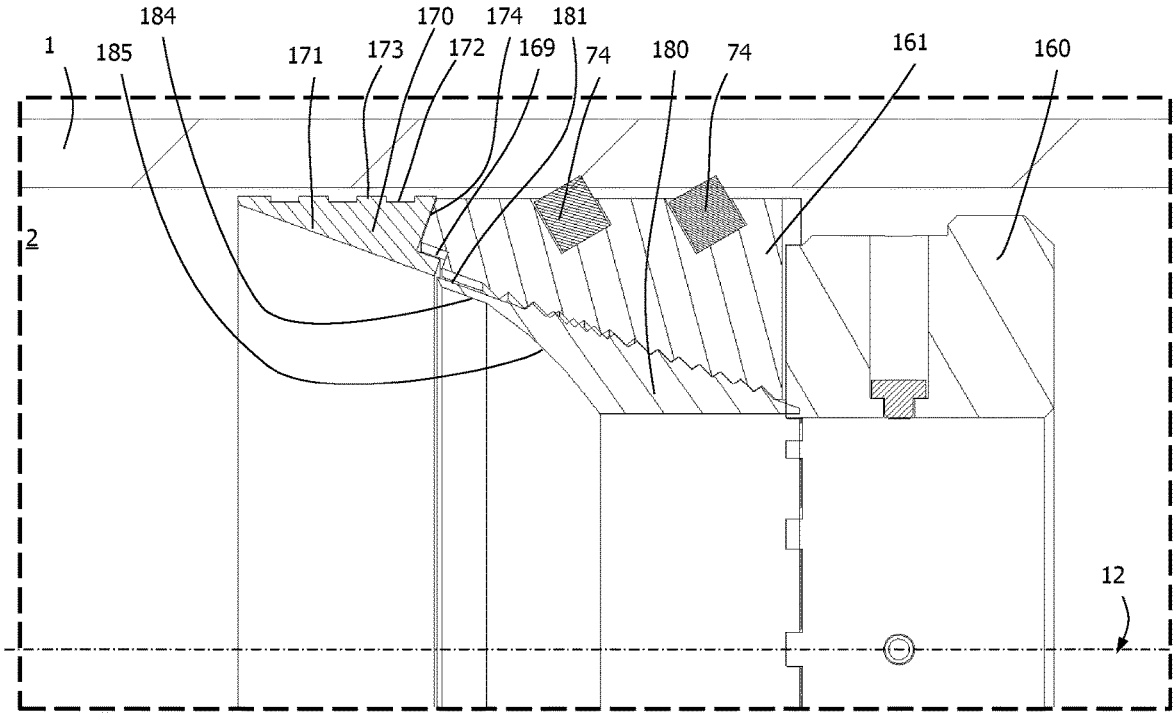
FIG. 33A is a detailed view of FIG. 32.
Figure 33B:
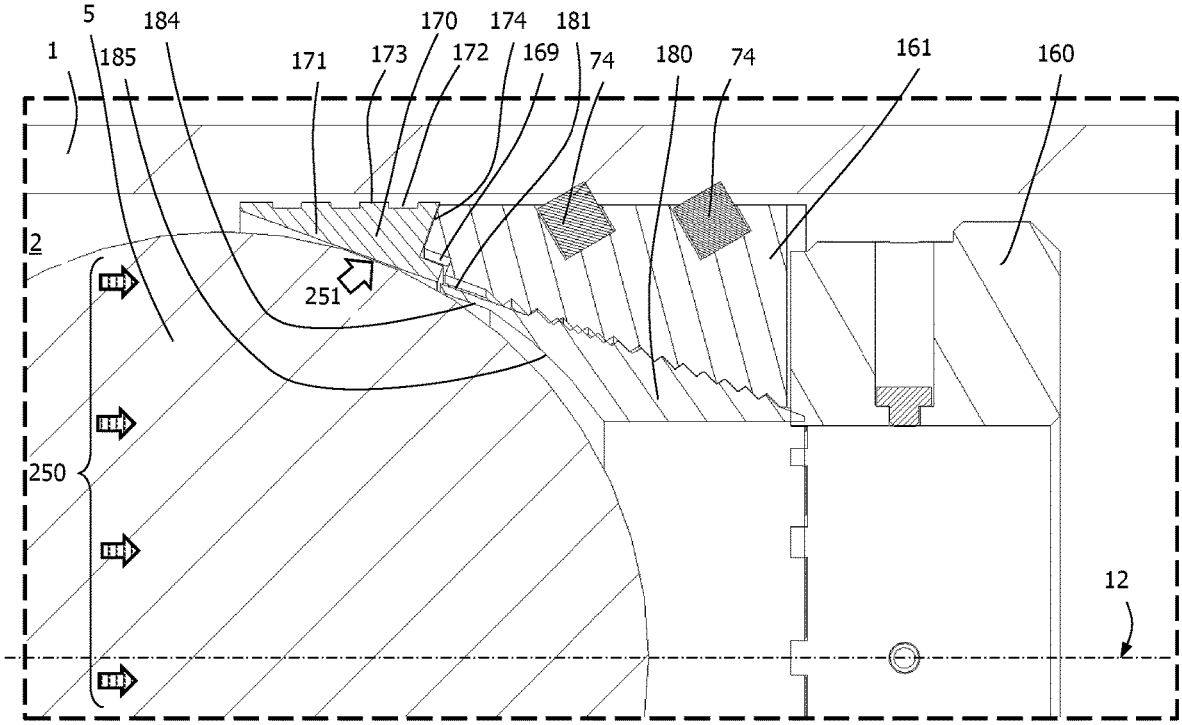
FIG. 33B is a detailed view of a plug assembly with a short-length locking ring in a set stage inside a tubing string with the landing position of an untethered object.
Figure 33C:
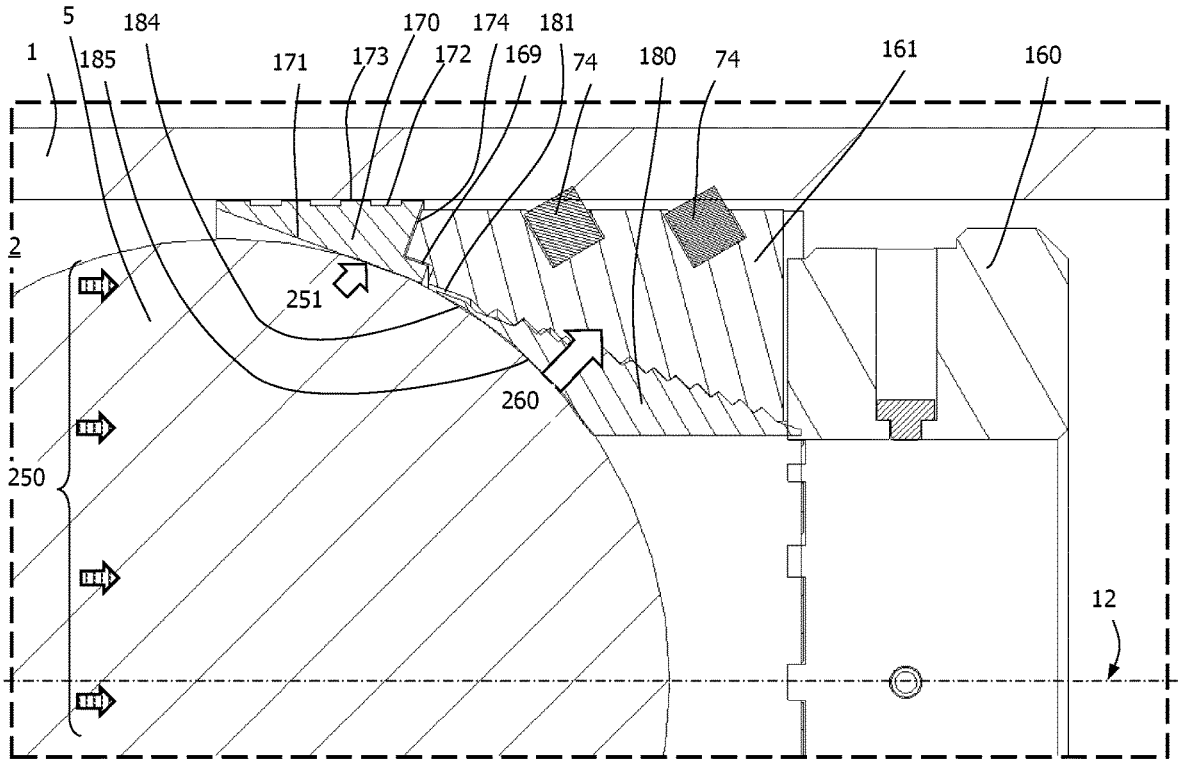
FIG. 33C is a detailed view of a plug assembly with a short-length locking ring in a set stage inside a tubing string with the untethered object pressing on the plug assembly using well fluid pressure.

FIG. 32 to FIG. 33C depict another embodiment.

In this embodiment the locking ring 180 only contains the second section as described in FIGS. 29 to 30C. As a different description, the locking ring 180 can be considered shorter, and in the set plug position not covering the inner surface of the expandable continuous seal ring 170.

FIG. 32 represents the cut view of a set plug with a short locking ring 180. The hemispherical surface 185 as described in FIG. 18B and in FIG. 30 might be kept similar. The conical surface 184 might be smaller in length, compared to FIG. 18B and FIG. 30, with a possible taper towards the part extremity.

The other parts of the plug, namely the expandable continuous seal ring 170, the expandable gripping ring 161 with its anchoring devices 74, the back-pushing ring 160 with shearing devices 65, remain similar to FIGS. 15A to 26B.

FIG. 33A represents a close-up view of FIG. 32 in the same configuration.

A difference compared to previously depicted FIG. 23A or 26A is the length of the locking ring 180. In this configuration, the inner conical surface 171 of the continuous expandable seal ring 170 is not covered by the locking ring thin section. The locking ring 180 has dimensions making the outer surface 181 matching approximately the inner surface of the expandable gripping ring 161. The other features between the expandable continuous seal ring and the expandable gripping ring, like the contact surface 174 and groove 169, remain similar to previously described in FIG. 26A.

FIG. 33B represents a sequence step of FIG. 33A, whereby the untethered object 5 has reached the position of the plug.

In this configuration, the untethered object 5 contacts directly the inner surface 171 of the continuous expandable seal ring 170. The force 251, coming from the fluid pressure 250 acting on the untethered object, acts directly on the continuous expandable seal ring 170 and allow its further deformation.

The reason for not having a second section locking ring or a longer locking ring, as in FIG. 26A or 30B, may be to reduce the number of surface contact to potentially enhance the sealing function. This configuration may need to secure the positioning of the expandable continuous seal ring after its initial expansion and before being constrained by the untethered object. This secure positioning could be achieved by the material choice with possible controlled elastic restraint between the different parts, or by adapting the groove 169 on the expandable gripping ring 161 to constrain longitudinally the movement of the continuous expandable seal ring 170.

FIG. 33C represents a sequence of FIG. 33B and depicts the further action of the untethered object 5 on the set plug.

The force 251 on the untethered object 5 has further radially deformed the continuous expandable seal ring 170, up to contacting its outer surface 173 with the tubing string 1 inner surface. The untethered object moved longitudinally up to contacting the hemispherical surface 184 of the locking ring 180. The force on the untethered object 5 also provides a force component 260 which is directed towards the expandable gripping ring 180 and its anchoring devices 74, enhancing the anchoring action of the embodiment.

Figure 34:
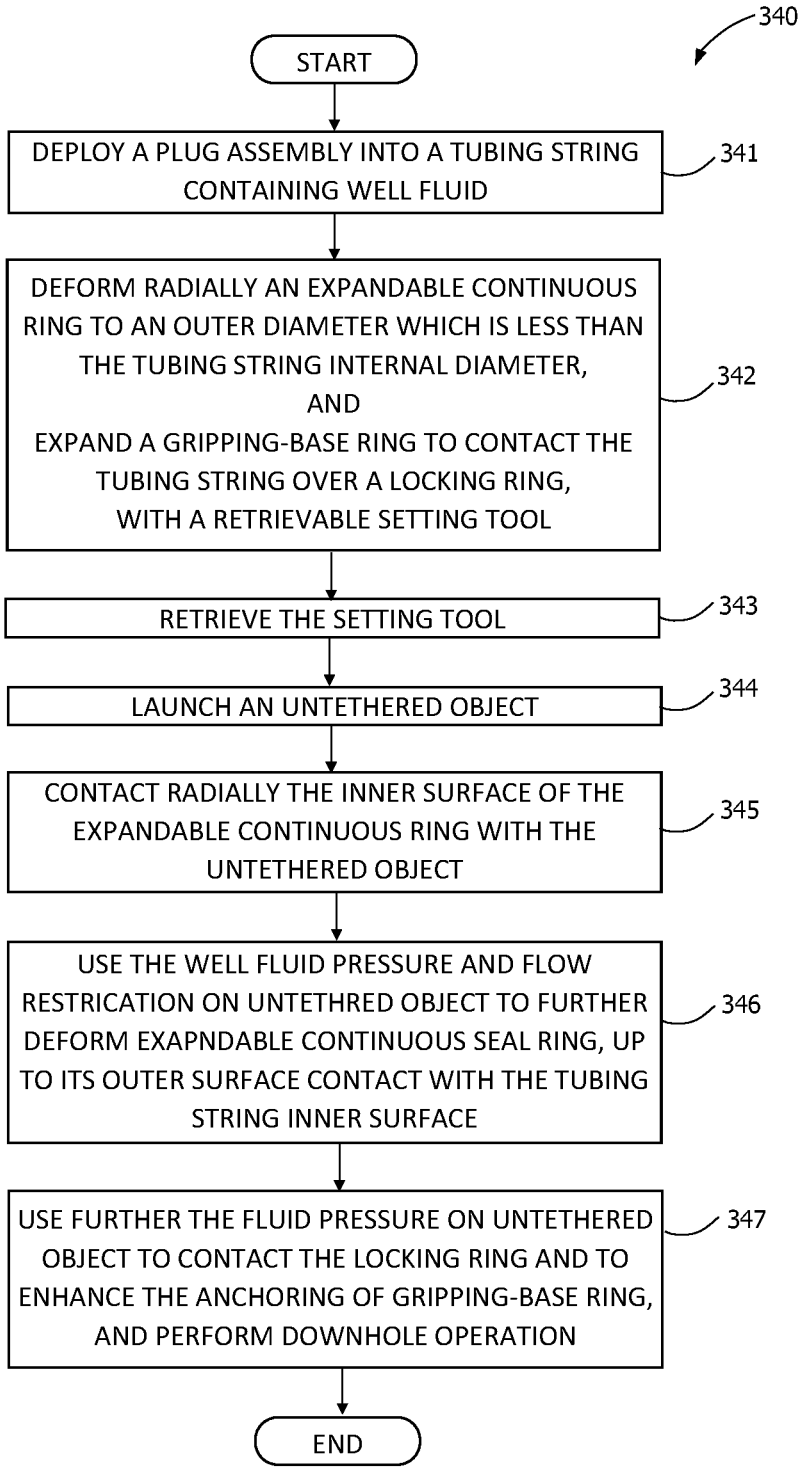
FIG. 34 is a flow diagram representing a technique sequence of deployment of a plug with a short-length locking ring, with the action of an untethered object for further expanding the expandable assembly and contacting a stopping surface on the locking ring.

FIG. 34 represents a technique sequence 340, which includes major steps depicted in FIGS. 32 to 33C.

Step 341 corresponds to the deployment of the plug assembly (170, 180, 161, 160) into the tubing string (1) containing well fluid (2). During step 342, the plug assembly with its expandable continuous seal ring (170) is deformed radially, and the expandable gripping ring (161) is expanded radially, both due to the action of a retrievable setting tool (150), over a locking ring 180. During the same step 342, the expandable gripping ring contacts at least one point of the inner surface of the tubing string (1), while the expandable continuous seal ring (170) is deformed to an outer diameter which is less than the tubing string (1) inner diameter. Then, during step 343, the retrievable setting tool (150), is retrieved. Further during step 344, an untethered object (5), is launched, preferably from surface, inside the tubing string (1). Then, during step 345, the untethered object (5) reaches the position of the set plug in step 282 and contacts radially the inner surface of the expandable continuous seal ring (170). Then, during step 346, the well fluid (2) pressure and flow restriction up-hole of the untethered object (5) is used to act as a force to deform further the expandable continuous seal ring (170), up to its outer surface contact with the tubing string inner surface, allowing further enhanced contact between all plug components from the untethered object (5) to the tubing string (1) passing through expandable continuous seal ring (170). Further in step 347, the force coming from the fluid pressure on the untethered object (5) is used to contact the locking ring (180) to enhance the anchoring action on the expandable gripping ring (161). This isolation state allows performing a downhole operation inside the well.

FIGS. 35A to 38C represent a possible embodiment of the retrievable setting tool 150 and its functioning. This retrievable setting tool could be compatible, for example, with the embodiment of FIGS. 15A to 34 with a plug assembly. The embodiment of FIGS. 35A to 38C could set an expandable assembly inside a well bore, such as a patch, a liner hanger, a packer.

Figure 35A:
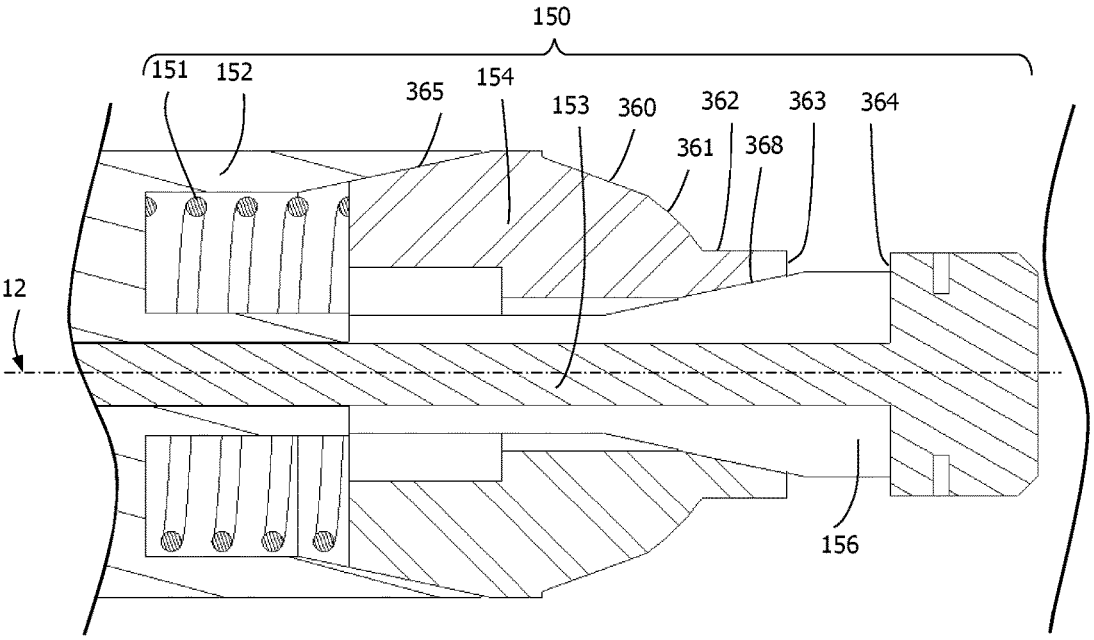
FIG. 35A is a cross-section view of a retrievable setting tool, including a collapsible section, according to an example embodiment.
Figure 35B:
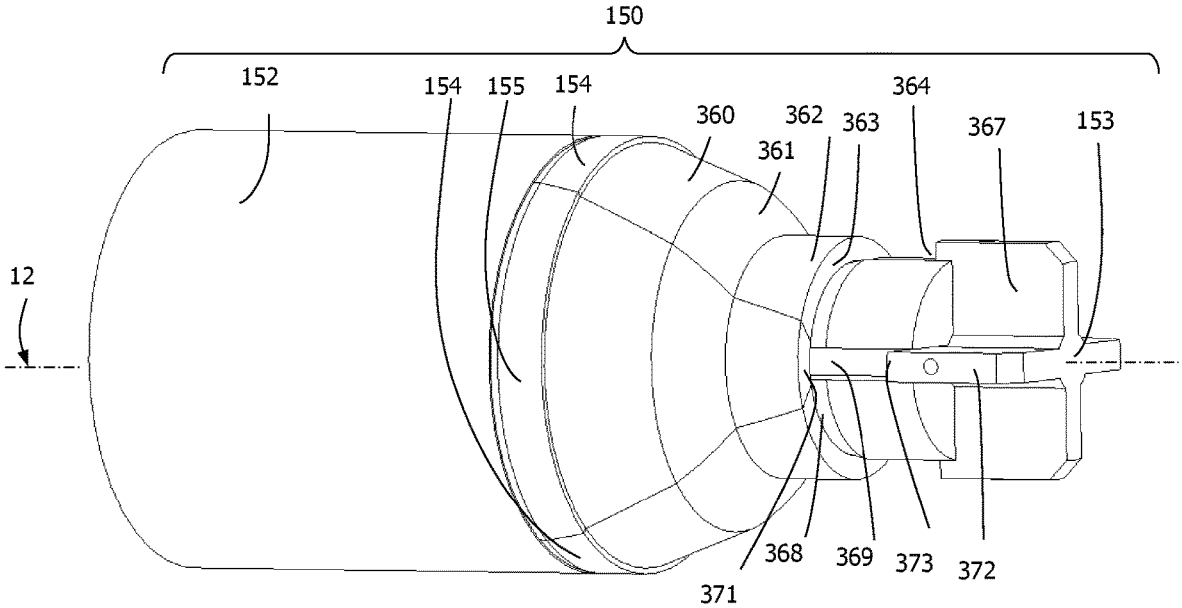
FIG. 35B is an isometric view of FIG. 35A.

FIGS. 35A and 35B represent the main components of the retrievable setting tool, in its unactuated or run-in-hole position. This is the position in which the plug assembly described in FIG. 15A is in an unset or undeformed position. FIG. 35A depicts a cut view, and FIG. 35B depicts the same embodiment in isometric view.

As represented in FIGS. 35A and 35B, the retrievable setting tool 150 may comprise the following parts:

- a housing 152, which is preferably connected to the toolstring 10, as depicted in FIG. 2, and having a preferably cylindrical outer shape enabling the traveling inside the tubing string 1,
- a nose 156, which is connected to and extends from the housing 152, and having longitudinal grooves 369, a rod 153, which may be able to move longitudinally with respect to housing 152 and nose 156 along tool axis 12. The rod may include multiple fins, the number of fins may be paired from 2 to 8.

In the example of FIGS. 35A and 35B, the fins are represented as four fins which can slide longitudinally inside the nose 156 through corresponding grooves 369. The four fins may be paired two by two, represented as fin pair 367 on the vertical axis and as fin pair 372 on the horizontal axis. The shape may be different between the fin pair 367 and the fin pair 372, so that the surfaces 364 of the fin pair 367 and the surfaces 373 on the fin pair 372 are offset along axis 12.

A collapsible expansion punch, with multiple sections, represented here with two sections 154 and two sections 155. Preferably, the number of sections will be paired from 2 to 8. Both sections 154 and both section 155 have external surfaces 362, 361 and 360 that form the expansion face of the collapsible expansion punch. The sections also have matched cut side planes so that, in its unactuated or run-in-hole position, the overall outer shape of the expansion face towards the components of the plug assembly (i.e., toward the right in the FIGS. 35A and 35B) is continuous. In this position, the external surfaces 362, 361 and 360 of all the sections are aligned. For matching with the plug embodiment described in FIG. 15A to FIG. 29, external surface 362 may be cylindrical, external surface 361 may be hemispherical and external surface 360 may be conical. The sections 154 and 155 may be constrained longitudinally and radially with the housing 152 with guiding surface 365 and with the nose 156 with guiding surface 368. The side planes joining the sections 154 and 155 participate also to the geometrical constraints of the sections, allowing only a collapse movement, and may be provided with guiding rails and corresponding grooves not shown in the figures. As shown, the side planes joining the sections 154 and 155 are oriented at angles relative to the axial and radial directions of the retrievable setting tool, so that the sections 155 can slide along a combined radial and longitudinal direction. Those side planes joining the section 154 and 155 would be visible when relative movement between the sections has occurred, as shown in FIG. 38B. Guiding rails on those side planes joining the sections 154 and 155 would help further constrain the relative movement of the sections 154 and 155 with each other. Guiding rails could take the shape of square, rectangular, trapezoid, hemispheric cross section. Guiding rails would be linear and have a compound angle relative to the longitudinal and radial direction of the assembly. The compound angle would depend from the number of sections 154 and 155 and the choice of angle on the guiding surfaces 365 and 368.

The housing 152, the nose 156, and the collapsible expansion punch, with its two sections 154 and two sections 155 may form a mandrel assembly on which one or more components of a plug assembly, including an expandable ring, can be expanded.

A spring 151 may apply a force longitudinally towards the expansion face of the collapsible expansion punch, while being secured longitudinally and radially by the housing 152. The spring force ensures the longitudinal positioning and alignment of the sections 154 and 155, when no other action act on them.

Figure 36A:
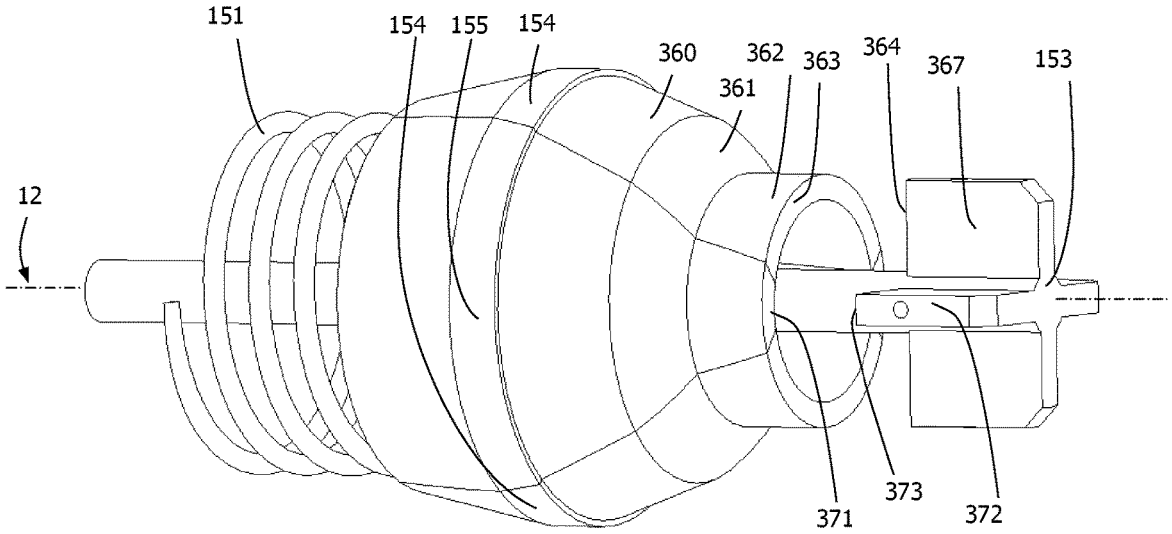
FIG. 36A is an isometric view of a retrievable setting tool of FIG. 35A without showing the housing and the nose.
Figure 36B:
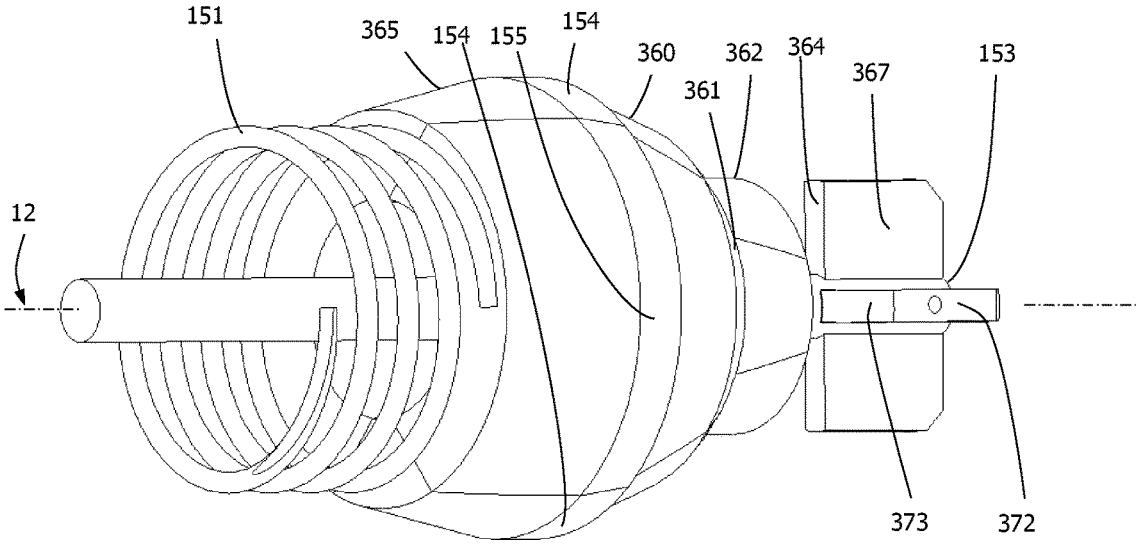
FIG. 36B is an isometric view of FIG. 36A from another orientation.

FIGS. 36A and 36B represent two orientations of an embodiment of the retrievable setting tool without showing the housing 152 and the nose 156.

Similar features as in FIGS. 35A and 35B can be observed, and in more details the collapsible expansion punch with the side planes joining sections 154 and 155. The external surfaces 360, 361, 362, and front faces 363, 371 of the sections 154 and 155 can be observed at a different angle.

The fin pairs 367 and 372 may be dimensioned to contact the front faces 363 of the sections 154 and 155 sequentially. As represented, in the vertical plane, the surface 364 of the fin 367 may contact the front face 363 of the section 154. Similarly, in the horizontal plane, the surface 373 of the fin 372 may contact the front face 371 of the section 155.

Figure 37:
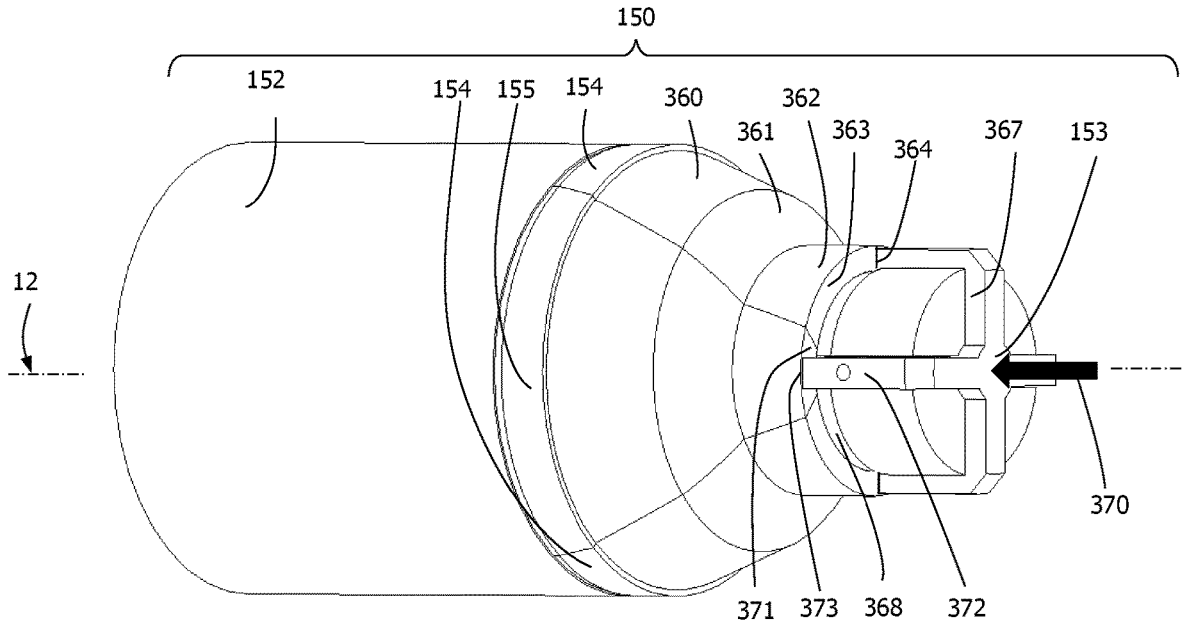
FIG. 37 is an isometric view of a retrievable setting tool, including a collapsible section, with the rod longitudinally moved with respect to other setting tool parts.

FIG. 37 represents a similar retrievable setting tool as FIG. 35B with the difference that the rod 153 has been longitudinally moved with respect to the other setting tool parts. This movement, indicated by 370, is preferably induced by an actuation tool that might be part of the toolstring 10, as depicted in FIG. 2.

In FIG. 37, the position of the rod 153 has reached the point where the surface 373 of the fin 372 is contacting the front face 371 of the section 155. At this point, the surface 364 of the fin 367 may not yet be in contact with the front face 363 of the section 154.

The other parts of the retrievable setting tool, as described in FIG. 35B are the same and in a similar position.

Figure 38A:
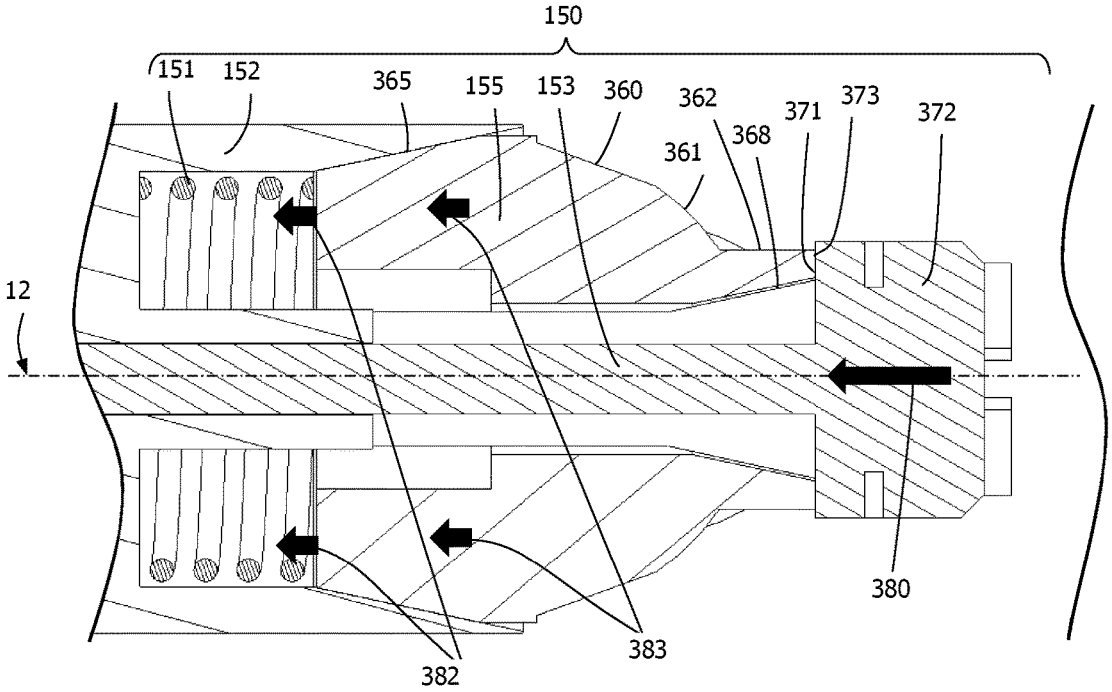
FIG. 38A is a cross-section view of a retrievable setting tool, including a collapsible section, with rod movement inducing collapse of collapsible expansion punch sections.
Figure 38B:
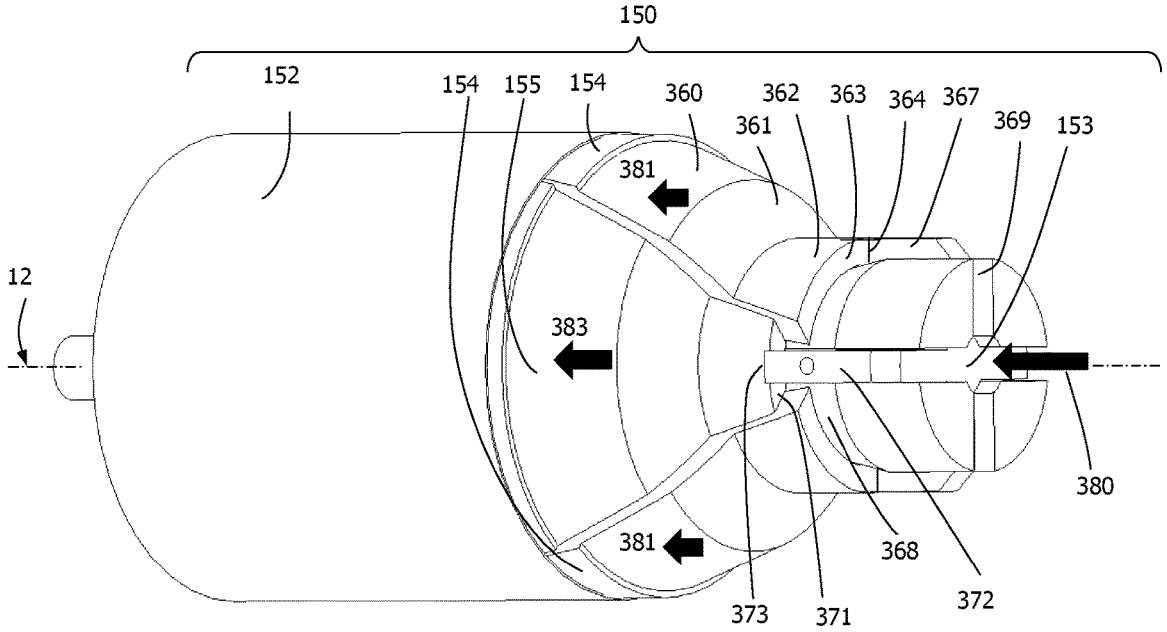
FIG. 38B is an isometric view of FIG. 38A.

FIG. 38A represents a cut view of a sequential step of FIG. 37, through the horizontal plane, or through the plane passing through the fin 372

In FIG. 38A, the rod 153 has further moved compared to FIG. 37 and its movement, as indicated by arrow 380, induces the movement of at least one section 155. As represented, both sections 155 have been contacted on their front faces 371 by the surfaces 373 of the fin pair 372. The longitudinal movement indicated by arrow 380 has induced the movement indicated by arrows 383 of both sections 155. The movement indicated by arrows 383 of the sections is constrained by the guiding surfaces 365 and 368 of the housing 152 and the nose 156, respectively, and involves a compound movement which is both longitudinal and radial inwards. For that purpose, the angles of the guiding surfaces 365 and 368 may be between 5 and 45 degrees with respect to the tool axis 12. The choice of the angle may direct the proportion of longitudinal and radial movement of the selected sections, here 155.

The longitudinal movement indicated by arrow 383 of at least one section 155 will induce the longitudinal compression of spring 151, represented as arrow 382.

FIG. 38B represents a similar position as FIG. 38A, with an isometric view. This representation shows that the movement indicated by arrow 380 of the rod 153 may be staged between the different pairs of sections 154 and 155. As represented, the longitudinal and radial movement indicated by arrow 381 of the sections 154 is less than the movement 383 of the sections 155. The staging may be directed by the different longitudinal length of the fin pairs 367 and 372, having different longitudinal positions (i.e., offset positions) for their respective surfaces 364 and 373. Also, the angles for guiding surfaces 365 and 368 may be different for the corresponding sections.

Figure 38C:
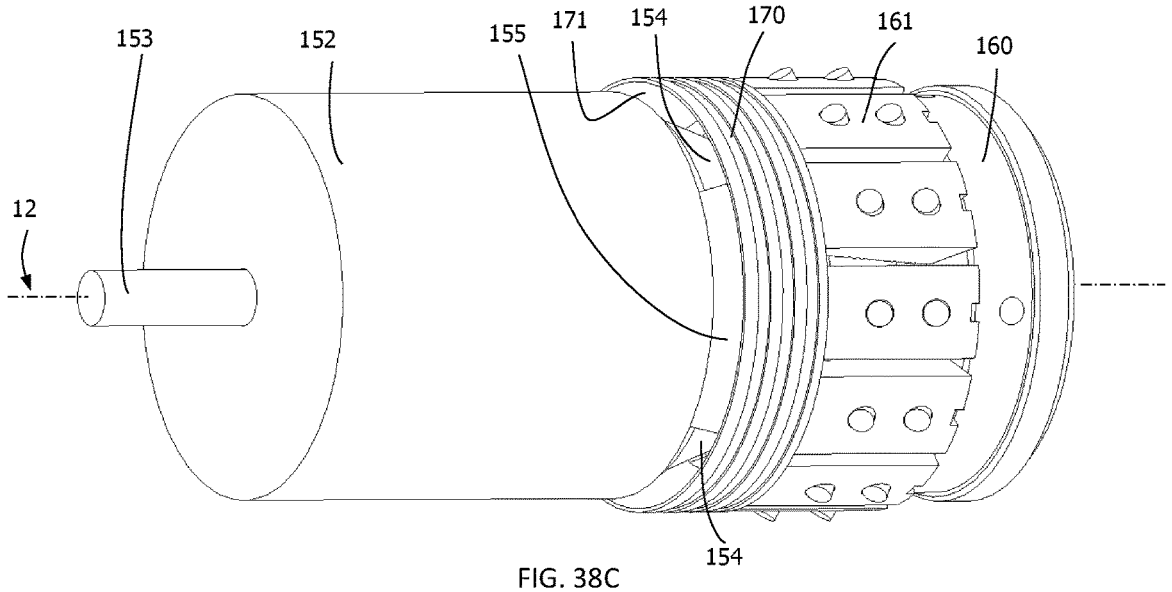
FIG. 38C is an isometric view of a retrievable setting tool, in a collapse sequence, over a plug assembly.

FIG. 38C represents another isometric view of the same embodiment as in FIG. 38B, with the addition of plug parts described in FIG. 15A to FIG. 29.

The collapsed position of the sections 154 and 155, allow to separate the face of the collapsible expansion punch from the inner surface 171 of the expandable continuous ring 170, as well as the expandable gripping ring 161, or the locking ring 180 not visible in this configuration. The retrievable setting tool in this collapsed position can be retrieved from the set plug assembly (for example 170, 161, 180, 160) without having friction force against the collapsible expansion punch, specially the external surface 360, the external surface 361 and the external surface 362, which might be otherwise under compression constraint after the setting process of the plug. The compression constraint could come from the elastic reaction of the material used for the plug assembly, i.e. from the expandable ring 170, and also from the force reaction occurring in case of contacting an inner surface of a tubing string, i.e. from a gripping ring 161. A plug setting sequence using a similar setting tool 150 can be seen in FIGS. 19, 20 and 21.

Note that a component which is not intended to expand during the setting sequence with the setting tool 150 could be placed between the collapsible expansion punch and the expandable assembly. Such component could be a locking ring 180 described in FIGS. 15A to 33C, including different geometries and multiple sections. The locking ring 180 would match partially or fully the external surfaces 360, 361 and 362 of the sections 154 and 155 of the collapsible expansion punch. In the plug assembly embodiment described in FIGS. 15A to 33C, the locking ring 180 would transmit the compression constraint from the expandable assembly, such as an expandable ring 170 and a gripping ring 161 towards the sections 154 and 155 of the collapsible expansion punch. At the end of the setting sequence, the collapse of the sections 154 and 155, induced by the longitudinal movements 381 and 383 would decouple the locking ring 180 from the sections 154 and 155 and stop the transmission of the compression constraint to the sections 154 and 155. The compression constraint would then be contained in the locking ring 180 itself, and keep the plug assembly with its expandable component in an expanded state.

As a further step of operation, after the retrieval of the retrievable setting tool 150, the longitudinal movement indicated by arrow 380 of the rod 153 may be stopped, and the rod 153 may be let free to move to a position determined by a force equilibrium. This operation is preferably performed on surface when the retrievable setting tool 150 along with the toolstring 10 of FIG. 2 is reconditioned to perform the next stage. By releasing the force responsible for the longitudinal movement indicated by 380, the spring 151, which was compressed, may re-expand to recover its original expansion as in FIG. 35A. Along with the expansion of the spring 151, the sections 154 and 155 of the collapsible expansion punch may find their original positions, as depicted in FIG. 35A. Therefore, the retrievable setting tool is back in the configuration to install a new plug, and ready to convey and set a new plug for a subsequent stage.

Figure 39:
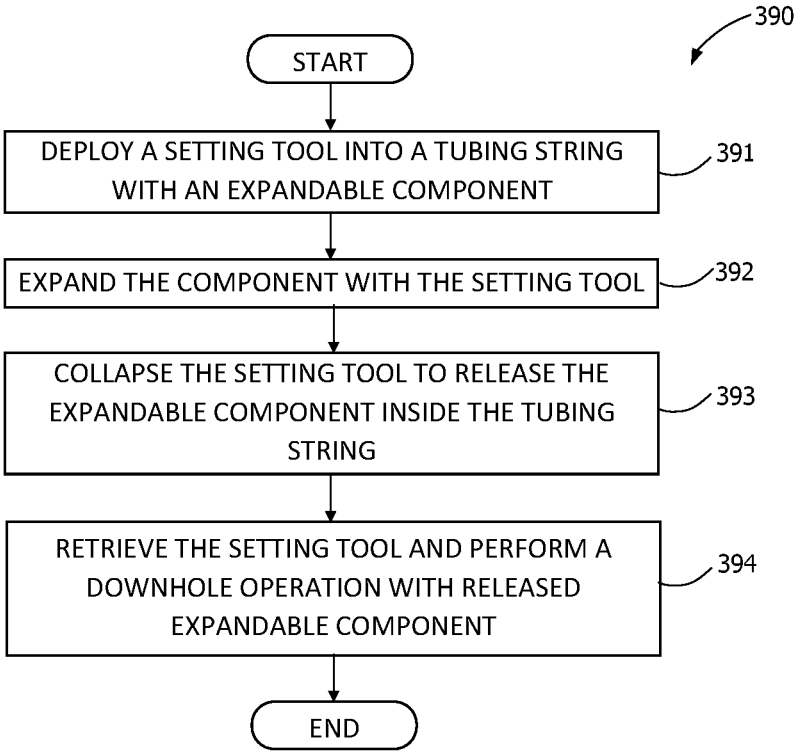
FIG. 39 is a flow diagram representing a technique sequence of deploying and retrieving a retrievable setting tool after expanding an expandable assembly.

FIG. 39 represents a technique sequence 390, which includes the major steps depicted in FIG. 35A to FIG. 38C.

Step 391 corresponds to the deployment of a setting tool (150) into a tubing string (1) with an expandable ring (like 170, 161) of a plug assembly.

Step 392 corresponds to the expansion of the expandable ring with the setting tool (150)

Step 393 further corresponds to the collapsing of the collapsible expansion punch of the setting tool to release the expandable ring inside the tubing string.

Step 394 finally corresponds to the retrieval of the setting tool, and allowing further a downhole operation with the released expandable ring.

Figure 40:
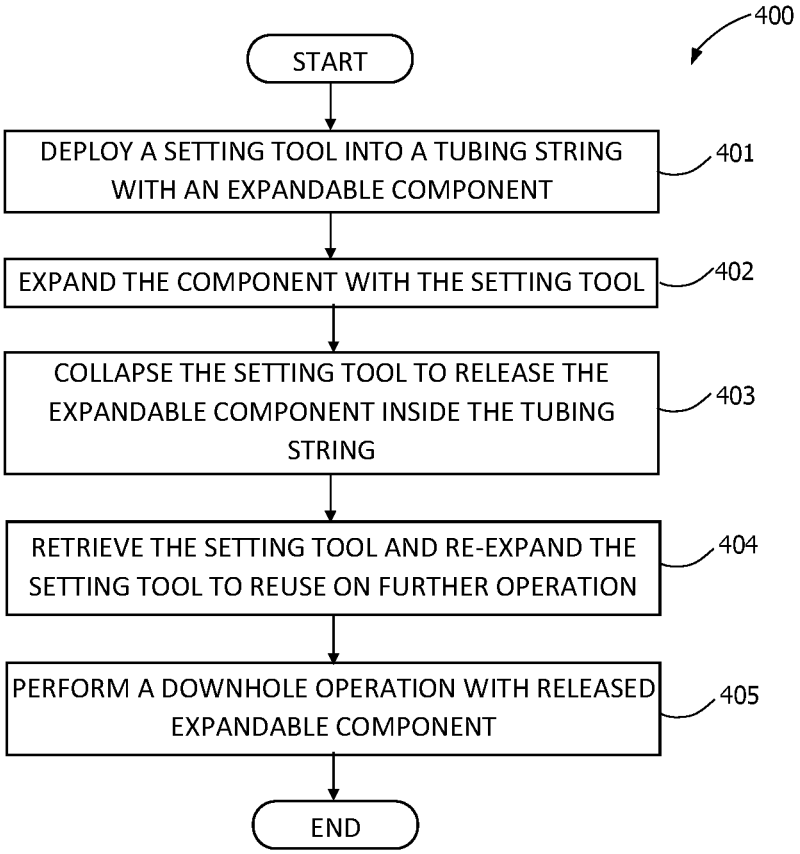
FIG. 40 is a flow diagram representing a technique sequence of deploying and retrieving a retrievable setting tool after expansion of an expandable assembly, and further re-expanding the retrievable setting tool for further operation.

FIG. 40 represents another technique sequence 400, which includes the major steps depicted in FIG. 35A to FIG. 38C.

Step 401 corresponds to the deployment of a setting tool (150) into a tubing string (1) with an expandable ring (like 170, 161) of a plug assembly.

Step 402 corresponds to the expansion of the expandable ring with the setting tool (150)

Step 403 further corresponds to the collapsing of the collapsible expansion punch of the setting tool to release the plug assembly inside the tubing string Step 404 corresponds to the retrieval of the setting tool and its re-expansion allowing reuse on a further operation, with readjusting of the setting tool in its unactuated or run-in-hole position.

Step 405 corresponds finally to a downhole operation with the released plug assembly inside the tubing string.

FIGS. 41A to 48B represent another embodiment of a plug and retrievable setting tool.

Figure 41A:
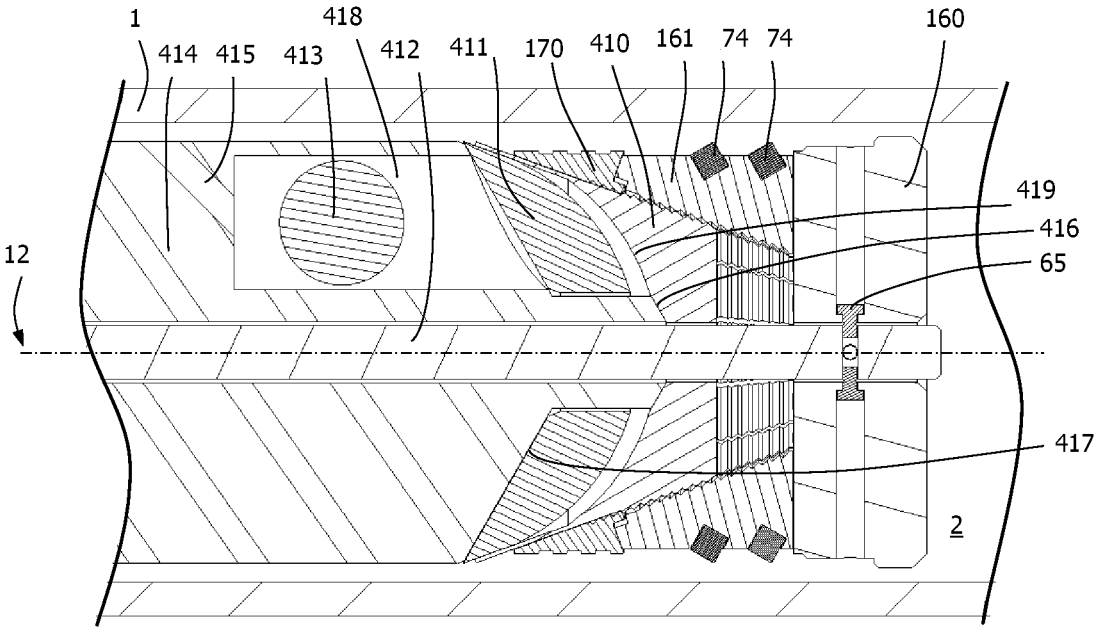
FIG. 41A is a cross-section view of another embodiment of a plug assembly, in a run-in hole position inside a tubing string, over a different setting tool having a caged untethered object or ball-in-place.

FIG. 41A represents a cut view of the embodiment inside the tubing string 1, along tool axis 12.

The embodiment is an unset or run-in-hole position. This represents the unactuated or undeformed position for the plug and the retrievable setting tool, which allows traveling inside the tubing string 1.

The plug includes the following components:

- the expandable continuous seal ring 170, which can have a similar shape than the part described in FIG. 17A,
- the expandable gripping ring 161, which can have a similar shape than the part described in FIG. 16A. The expandable gripping ring 161 preferably includes anchoring devices 74,
- the back-pushing ring 160, which can have a similar shape than the part described in FIG. 16A. The shear devices 65 may be positioned on the inner diameter of the back-pushing ring 160,
- a locking ring 410, which includes a conical external shape matching the inner surface of the expandable gripping ring 161 and the inner surface of the expandable continuous seal ring 170. The locking ring 410 may include a hemispherical inner surface 419 and a conical inner surface 416,
- a hemispherical cup 411, which will be further described in FIGS. 42A and 42B.

The retrievable setting tool includes the following components:

- an external mandrel 414, which may include a cylindrical pocket 418. The pocket 418 may have a channel 415 linking the pocket 418 with the well fluid 2 present inside the tubing string 1. In this representation, the external mandrel 414 may contact the locking ring 410 along the conical surface 416. In addition, the external mandrel 414 may contact the hemispherical cup 411 along a conical surface 417,
- a rod 412 which can move longitudinally within the external mandrel 414. The rod 412 may provide a link to the shear devices 65, securing the longitudinal position of the back-pushing ring 160.

In addition, an untethered object 413 may be included inside the pocket 418 of the external mandrel 414.

This embodiment may be referred to as 'ball in place', where the untethered object 413 may be a ball which is included in the retrievable setting tool. Other embodiments for the untethered object 413 may be a pill, a dart, a plunger, preferably with at least a hemispherical or a conical shape.

Figure 41B:
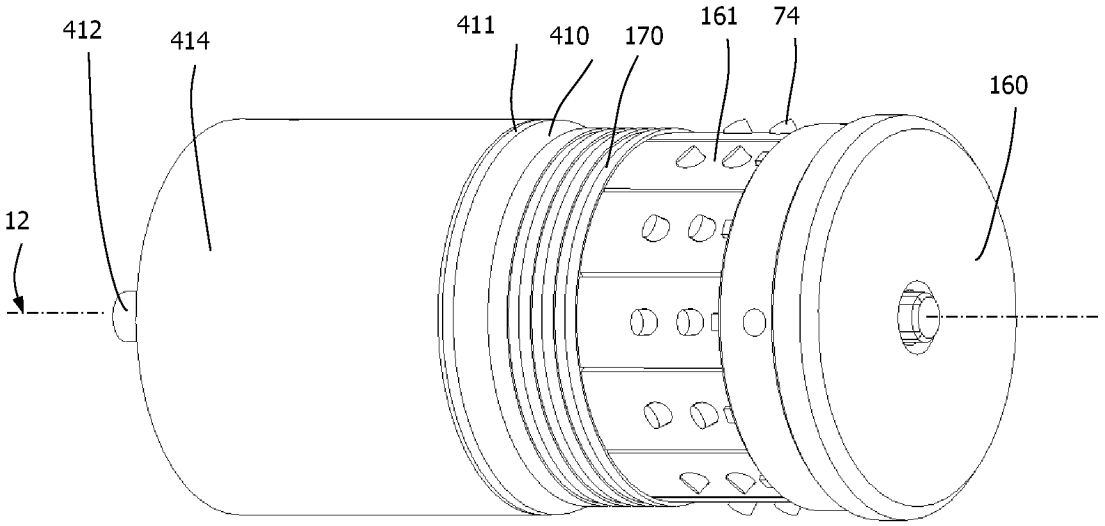
FIG. 41B is an isometric view of FIG. 41A without showing the tubing string.

FIG. 41B represents the same embodiment as FIG. 41A, without the tubing string 1, and as an isometric view, along axis 12.

External plug components visible in FIG. 41B include the back-pushing ring 160, the expandable gripping ring 161 with its anchoring devices 74, the expandable continuous seal ring 170, the locking ring 410 and the hemispherical cup 411.

Regarding external retrievable setting tool components visible in FIG. 41B, it includes the external mandrel 414 and the rod 412

Figure 42A:
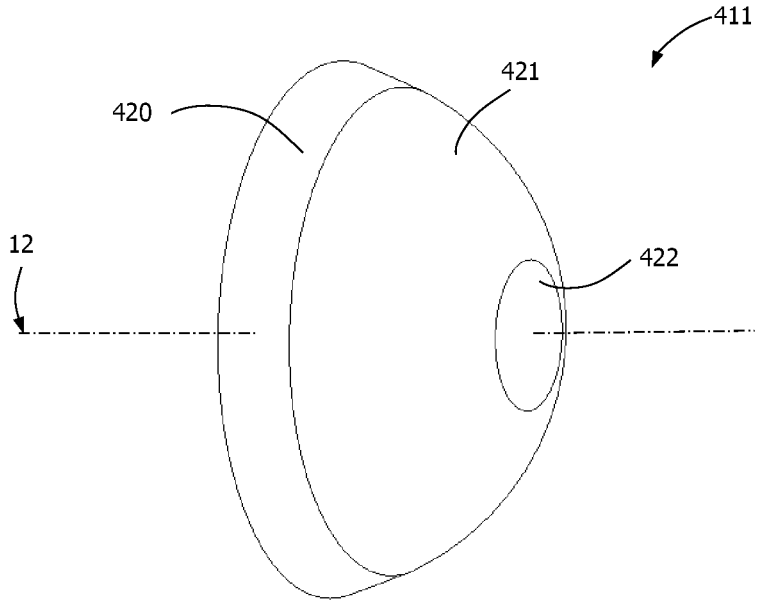
FIG. 42A is an isometric view of a hemispherical cup, according to an example embodiment.
Figure 42B:
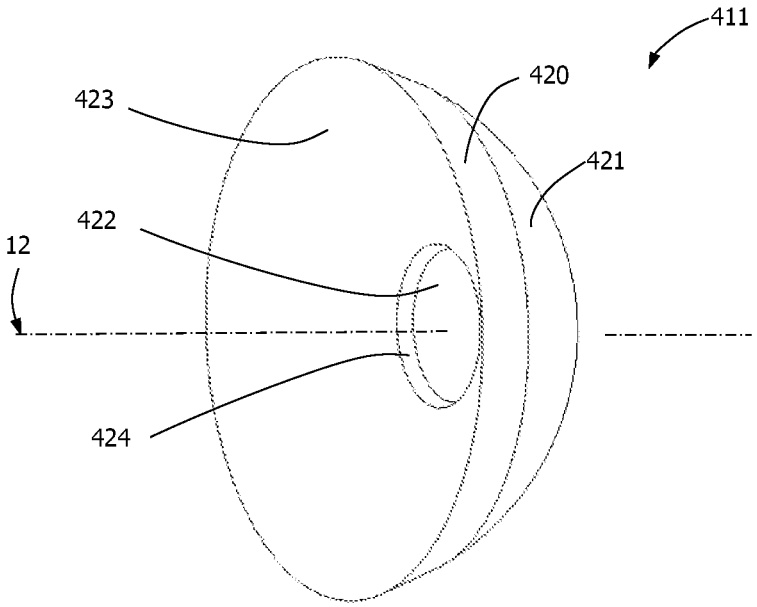
FIG. 42B is an isometric view of FIG. 42A from another orientation.

FIG. 42A and FIG. 42B depict detailed views of the hemispherical cup 411.

FIG. 42A represents an isometric view of the hemispherical cup 411. The external outer surface 420 may be conical. Surface 420 may be matching the inner conical surface of the locking ring 410. The external surface 420 may transition to a hemispherical surface 421. The hemispherical diameter of the surface 421 may be similar to the hemispherical diameter of the surface 419 of the locking ring 410. Note that in the traveling and undeformed position, as shown in FIG. 41A, the two surfaces 422 and 419 may not be in contact with each other. The internal surface 422 may be cylindrical with a diameter allowing a portion of the external mandrel 414 to pass through.

FIG. 42B represents another isometric view of the hemispherical cup 411. The external surfaces 420, as conical and 421 as hemispherical are visible. The inner surface 423 may be conical and match the outer surface 417 of the external mandrel 414. The cylindrical surface 422 is also visible. A chamfer or conical surface 424 may be present between surface 423 and 422.

Figure 43:
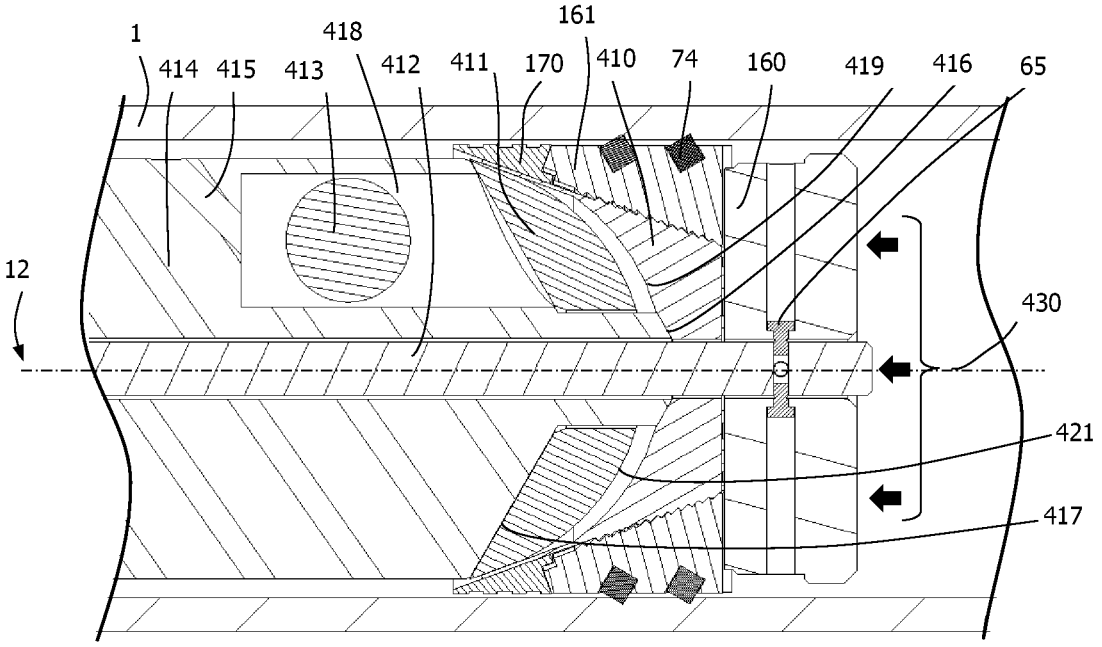
FIG. 43 is a cross-section view of a plug assembly, in a set position inside a tubing string, over a setting tool having a caged untethered object or ball-in-place.

FIG. 43 represents a sequence step of FIG. 41A. In FIG. 43, the retrievable setting tool has been actuated which induce the longitudinal movement indicated by arrow 430 of the rod 412 compared to the external mandrel 414.

Through the link of the shear devices 65, the rod 412 movement indicated by arrow 430 induced the same longitudinal movement to the back-pushing ring 160. The back-pushing ring induces in turn an expansion movement to the expandable gripping ring 161, which in turn induces an expansion movement through the deformation of the continuous expandable seal ring 170. The expansion of the expandable gripping ring 161 and of the continuous expandable seal ring 170 occurs both longitudinally and radially over the conical external shape of the locking ring 410. The locking ring is held longitudinally in position thanks to the contact 416 with the external mandrel 414, as well as radially in position through the conical contact with the hemispherical cup 411, itself held in position through the conical contact 417 with the external mandrel. To be noted during this expansion process, the hemispherical surface 419 of the locking ring 410 may not come in contact with the hemispherical surface 421 of the hemispherical cup 411.

The expansion process of the expandable gripping ring may end when the anchoring devices 74 penetrates the inner surface of the tubing string 1, and a force equilibrium is established between the anchoring force or friction force created by the anchoring devices 74 with the shear devices 65.

The untethered object 413 may still remain inside the cylindrical pocket 418 of the external mandrel 414.

Figure 44:
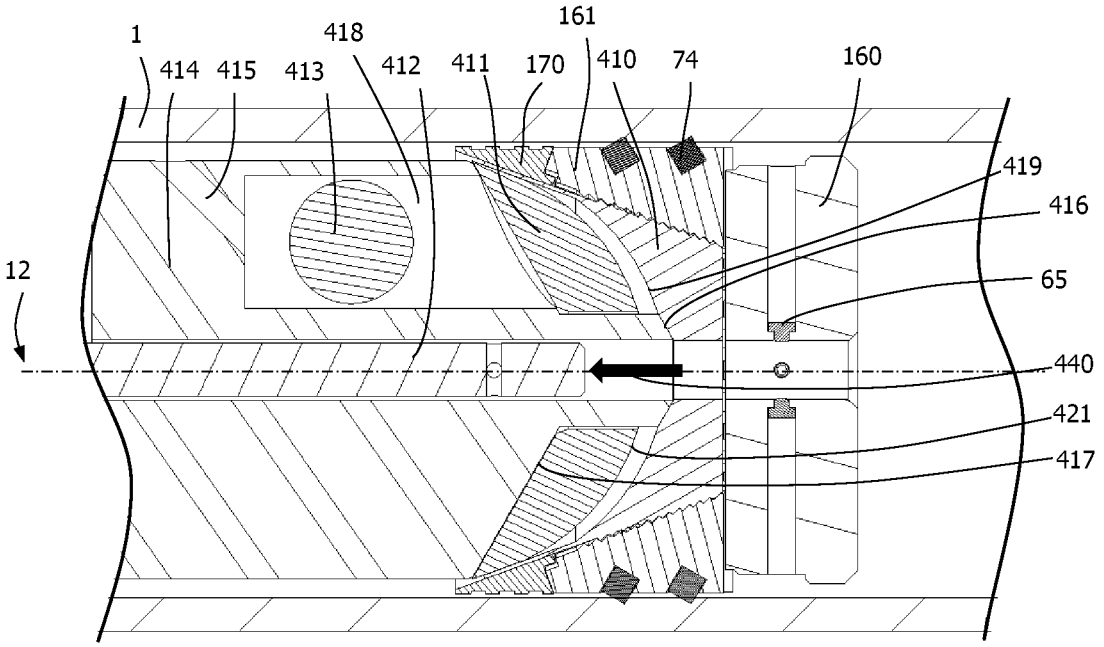
FIG. 44 is a cross-section view of a plug assembly, in a set position inside a tubing string, after longitudinal movement of a rod, over a setting tool having a caged untethered object or ball-in-place.

FIG. 44 represents a sequence step of FIG. 43. In FIG. 44, the force equilibrium between the anchoring devices 74 and shear devices 65 is stopped when the pulling force 440 on the rod 412 exceeds the rating of the shearing devices 65. Therefore, the rod 412 can continue its course longitudinally inside the external mandrel. At this point, all other parts described in FIG. 43 may remain in the same position.

Figure 45A:
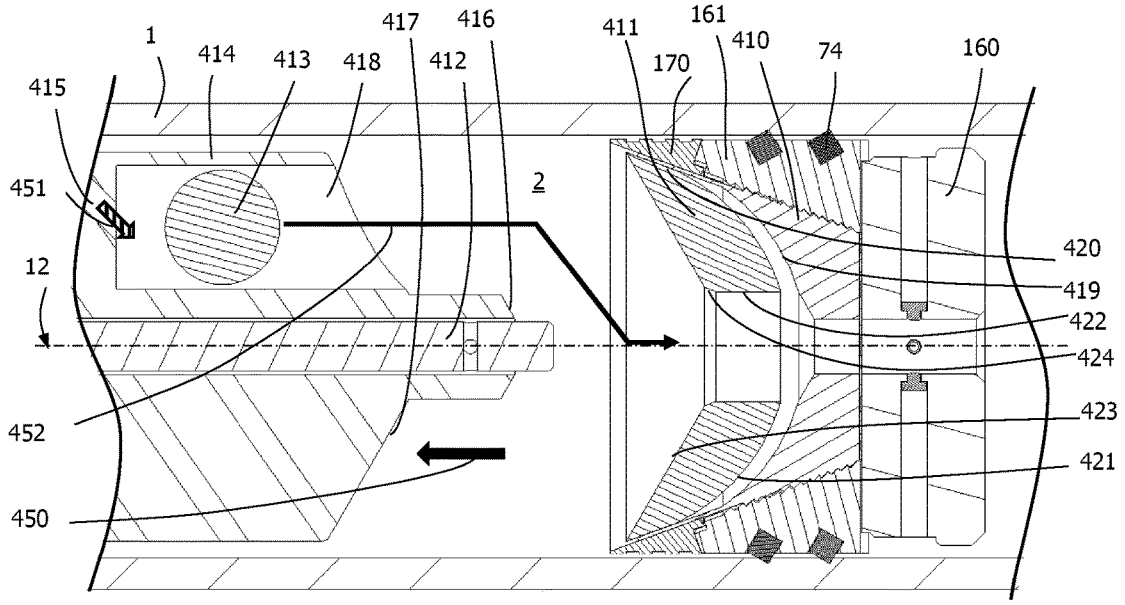
FIG. 45A is a cross-section view of a set plug assembly, with the decoupling of the retrievable setting tool, releasing a caged untethered object.
Figure 45B:
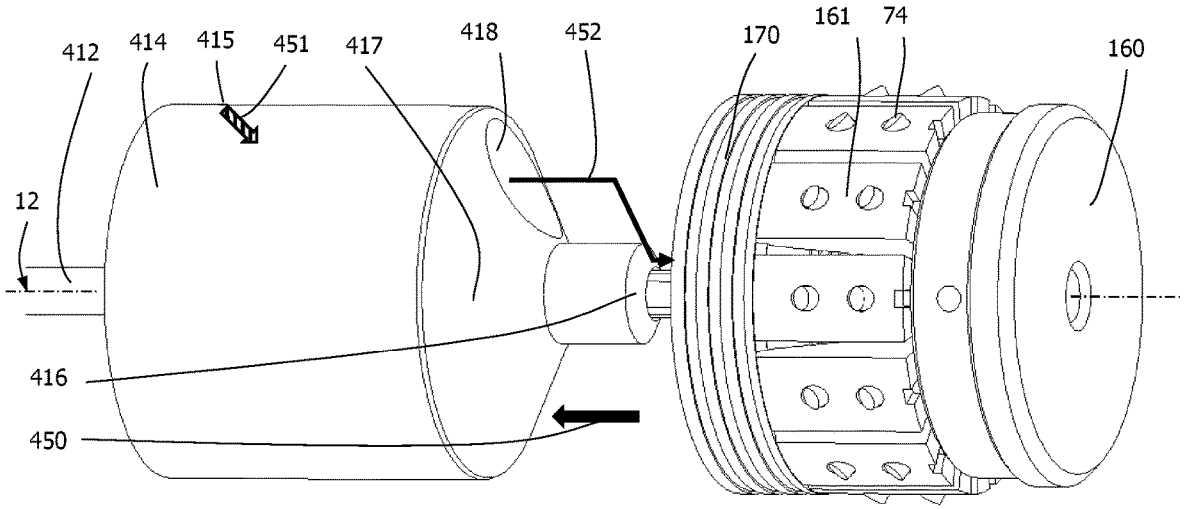
FIG. 45B is an isometric view of FIG. 45A without showing the tubing string.
Figure 45C:
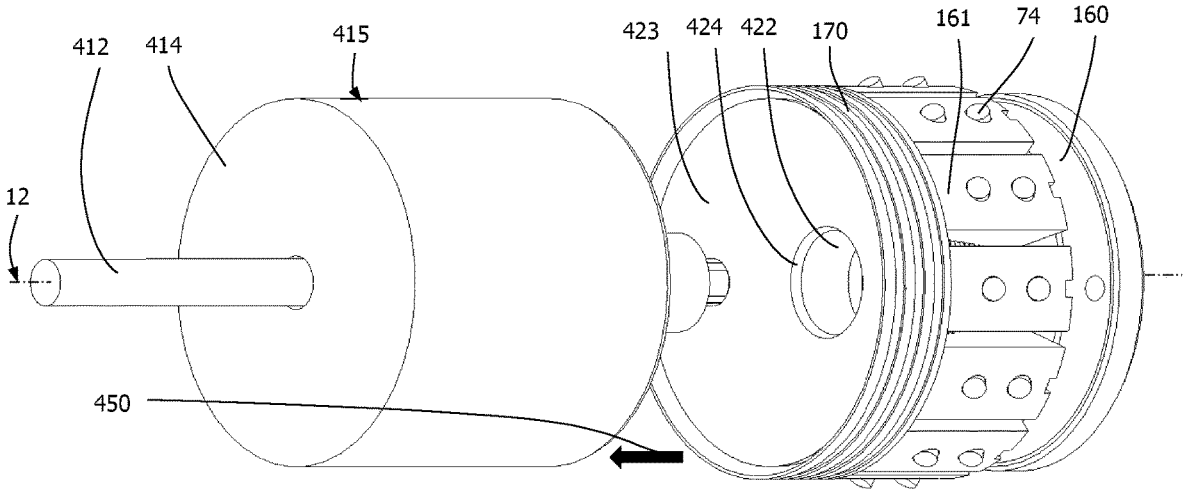
FIG. 45C is an isometric view of FIG. 45B from another orientation.

FIG. 45A, FIG. 45B and FIG. 45C represents a sequence step of FIG. 44. FIG. 45A is a cut view of the embodiment, while FIGS. 45B and 45C are the same embodiment represented in two different orientations isometric view without the tubing string 1.

In FIG. 45A, FIG. 45B and FIG. 45C, the retrievable setting tool with the rod 412 and external mandrel 414 is pulled along a longitudinal movement 450, inside the tubing string 1, as part of the toolstring 10 retrieval as described in FIG. 2.

The retrieval of the setting tool lets the set plug component as described in FIG. 43 and FIG. 44 in their set position. The movement of the mandrel is possible through separation or sliding of several surface contacts: surface 417 and surface 416 of the external mandrel 414 gets separated from the hemispherical cup 411 and from the locking ring 410. The external mandrel 414 can slide through the cylindrical surface 422 of the hemispherical cup 410.

The hemispherical cup may stay in position thanks to the friction contact along its conical surface 420 in common with the inner conical surface of the locking ring 410.

With a sufficient distance of pulling movement indicated by arrow 450, preferably from several inches to several feet [0.1 to 100 m], the release of the untethered object 413 can occur. This release can be initiated preferably from a pumping force indicated by arrow 451 which introduces well fluid 2 through the channel 415, allowing the untethered object to travel towards the set plug. The movement of the untethered object 413 is symbolized with the trajectory 452. Preferably, the well fluid 2 pumping 451 would be initiated from surface.

Figure 46A:
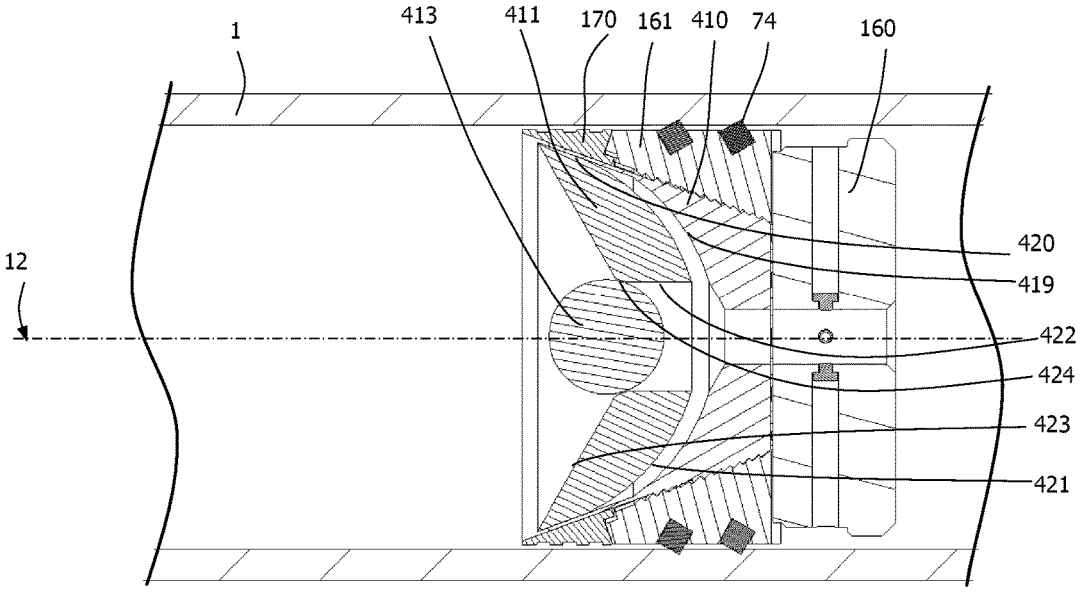
FIG. 46A is a cross-section view of a plug assembly, in a set position inside a tubing string, with the caged untethered object landing on the hemispherical cup.
Figure 46B:
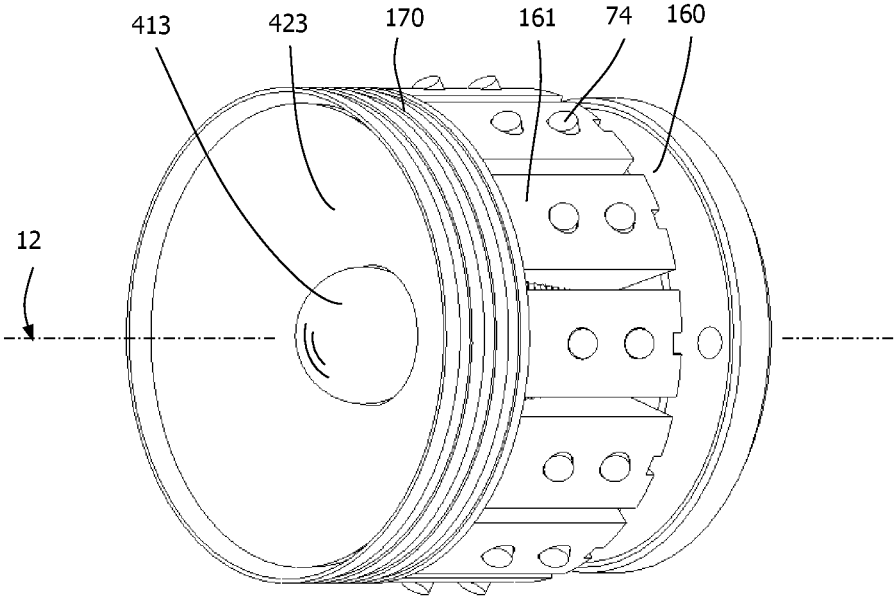
FIG. 46B is an isometric view of FIG. 46A without showing the tubing string.

FIG. 46A and FIG. 46B represent a sequence step of FIGS. 45A, 45B and 45C.

FIG. 46A depicts a cut view inside the tubing string 1, while FIG. 46B depicts the same embodiment with an isometric view, without the tubing string 1.

In FIG. 46A and FIG. 46B, the untethered object 413 has landed on the hemispherical cup 411 and may contact the chamfer 424.

In this position where no particular force is applied on the untethered object, the hemispherical cup 411 may remain in the same position as described from FIG. 43 to FIG. 45C.

The other plug parts remain also in their original set position as described from FIG. 43 to FIG. 45C.

Figure 47A:
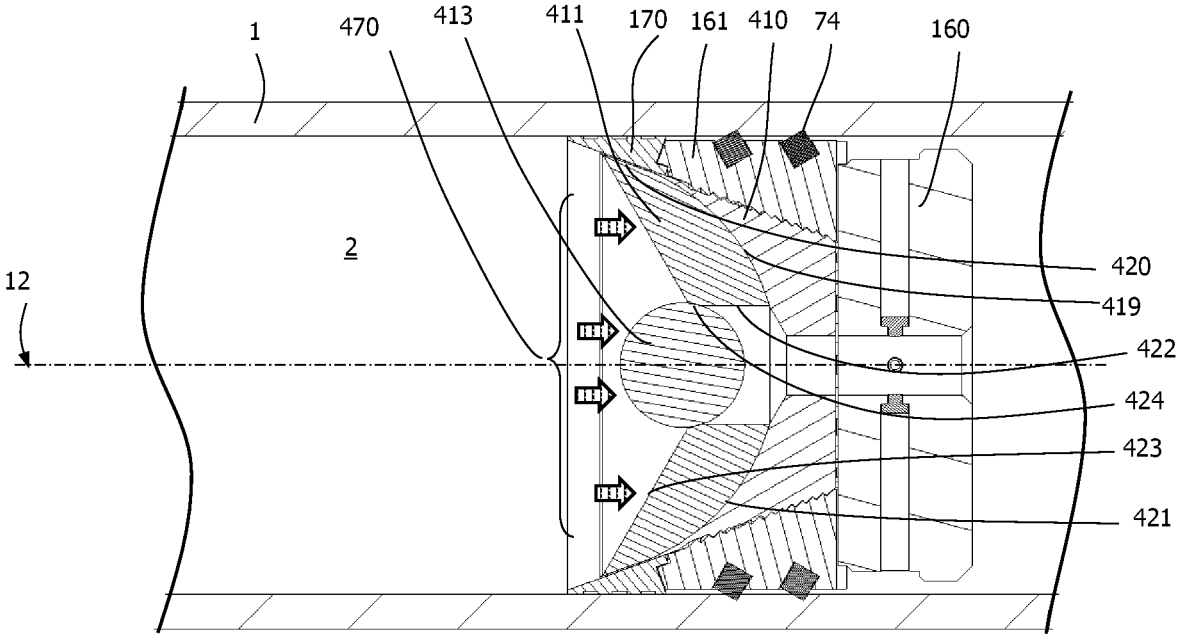
FIG. 47A is cross-section view of a plug assembly, in a set position inside a tubing string, with the caged untethered object pressing on the plug assembly using well fluid pressure.
Figure 47B:
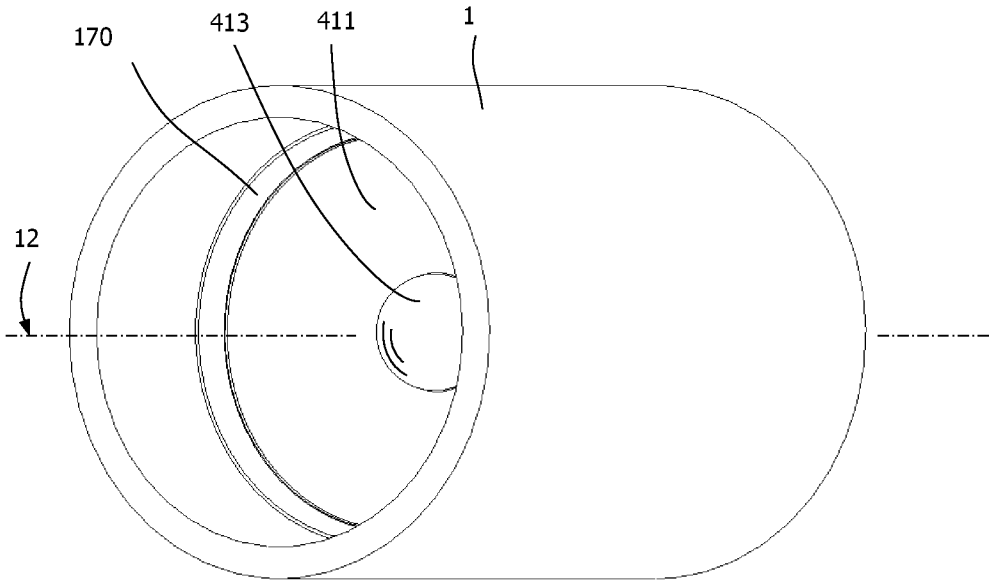
FIG. 47B is an isometric view of FIG. 47A.

FIG. 47A and FIG. 47B represent a sequence step of FIG. 46A and FIG. 46B.

FIG. 47A depicts a cut view inside the tubing string 1, while FIG. 47B depicts the same embodiment with an isometric view.

In FIG. 47A and FIG. 47B, a well fluid pressure restriction is created through well fluid 2 pumping. This flow restriction creates in turn a force 470 on the exposed components, mainly on the untethered object 413 and the hemispherical cup 411.

In this representation, the force 470 has induced a further longitudinal movement of the hemispherical cup 411 and the untethered object 413 contacting the chamfer 422. The longitudinal movement of the hemispherical cup may create a radial deformation of the locking ring through its conical surface 420, which in turn may create a further radial deformation of the expandable continuous seal ring 170.

The further longitudinal movement may continue up to surface contact of the hemispherical surface 421 with the corresponding surface 419 on the locking ring 410.

Figure 48A:
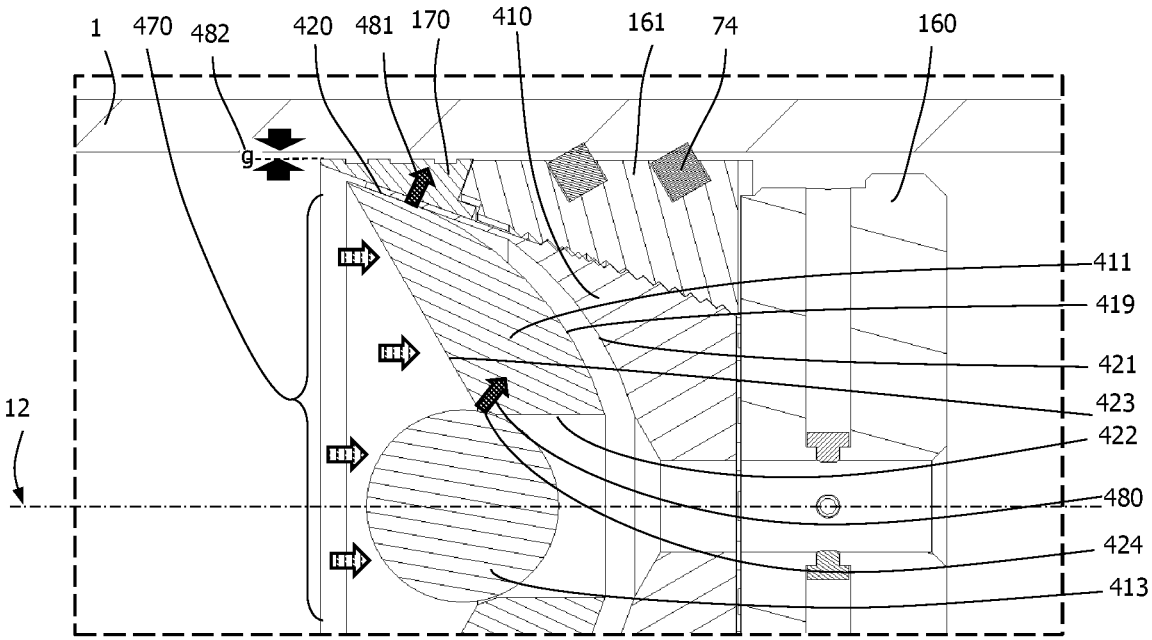
FIG. 48A is a detailed view of the cross-section view of FIG. 46A, with the caged untethered object landing on the hemispherical cup.

FIG. 48A and FIG. 49B depict close-up views of previously described FIGS. 46A and 47A.

The close-up views allow seeing in more details the further expandable continuous seal ring 170 expansion and forces involved.

In FIG. 48A, which represents the same stage as FIG. 46A, the detailed force chain is represented.

At this point, the expandable continuous seal ring 170 might not be in contact with the inner surface of the tubing string 1, creating a radial gap 482. This can be due to geometrical variation of the different parts, possible stop of the expansion process of the expandable continuous seal ring 170 before reaching the inner surface contact with the tubing string, and possible elastic restraint effect of the different parts after the setting process as described in FIG. 43.

Force 470 is acting on the untethered object 413 and on the hemispherical cup 411, with the two parts being in contact through the chamfer 424 and providing a force indicated by arrow 480 at this contact surface. The resultant force indicated by arrow 481 of these two parts may be directed perpendicular to the conical contact surface 420 with the locking ring 410. This resultant force indicated by arrow 481 may in turn be transmitted towards the expandable continuous seal ring 170, allowing its further deformation and closing of the gap 482.

The expandable gripping ring 161 secured with the anchoring devices 74 inside the tubing string 1 and locked internally by the locking ring 410, might not deform during the further expansion process of the expandable continuous ring 170, and provide a radial sliding guide.

Figure 48B:
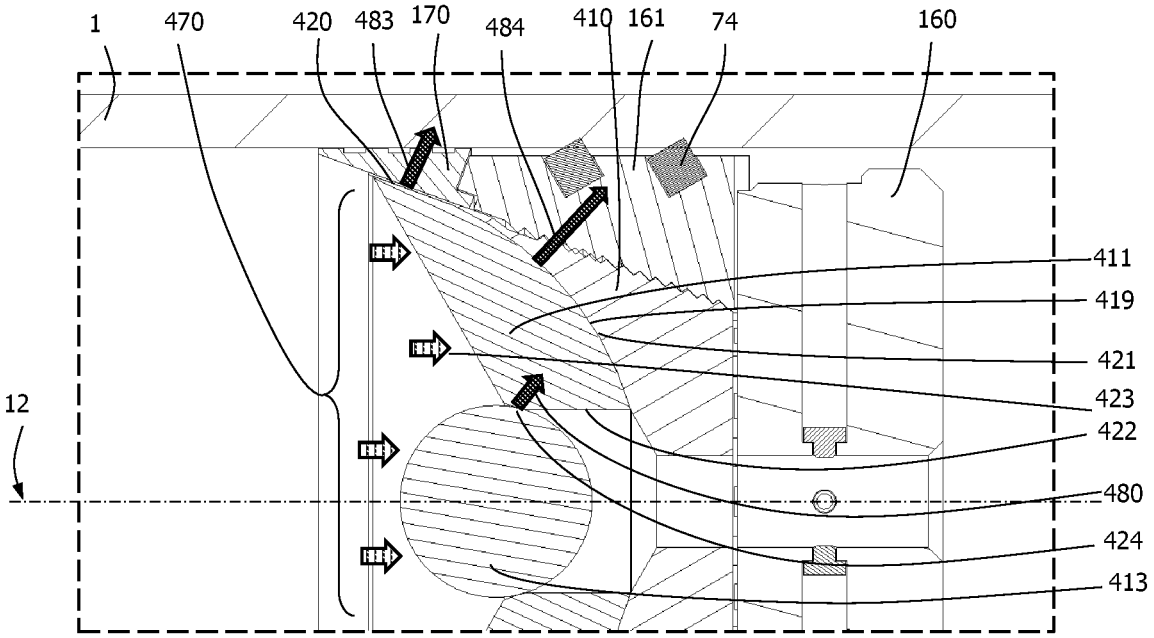
FIG. 48B is a detailed view of the cross-section view of FIG. 47A, with the caged untethered object pressing on the plug assembly using well fluid pressure.

In FIG. 48B, the gap 482 depicted in FIG. 48A may be now closed through the action of the further expansion of the expandable continuous ring 170.

The hemispherical cup 411 may now be in contact with the locking ring 410, as described in FIG. 47A.

The resultant of the force 470 on the untethered object 413 and on the hemispherical cup 411, may now directed towards 483 and 484. Force 483 may compress the expandable continuous seal ring 170 further towards the tubing string, possibly enhancing the sealing feature of the plug. Force 484 may compress the expandable gripping ring 161 further towards the tubing string via the anchoring devices 74, possibly enhancing the anchoring feature of the plug.

Figure 49:
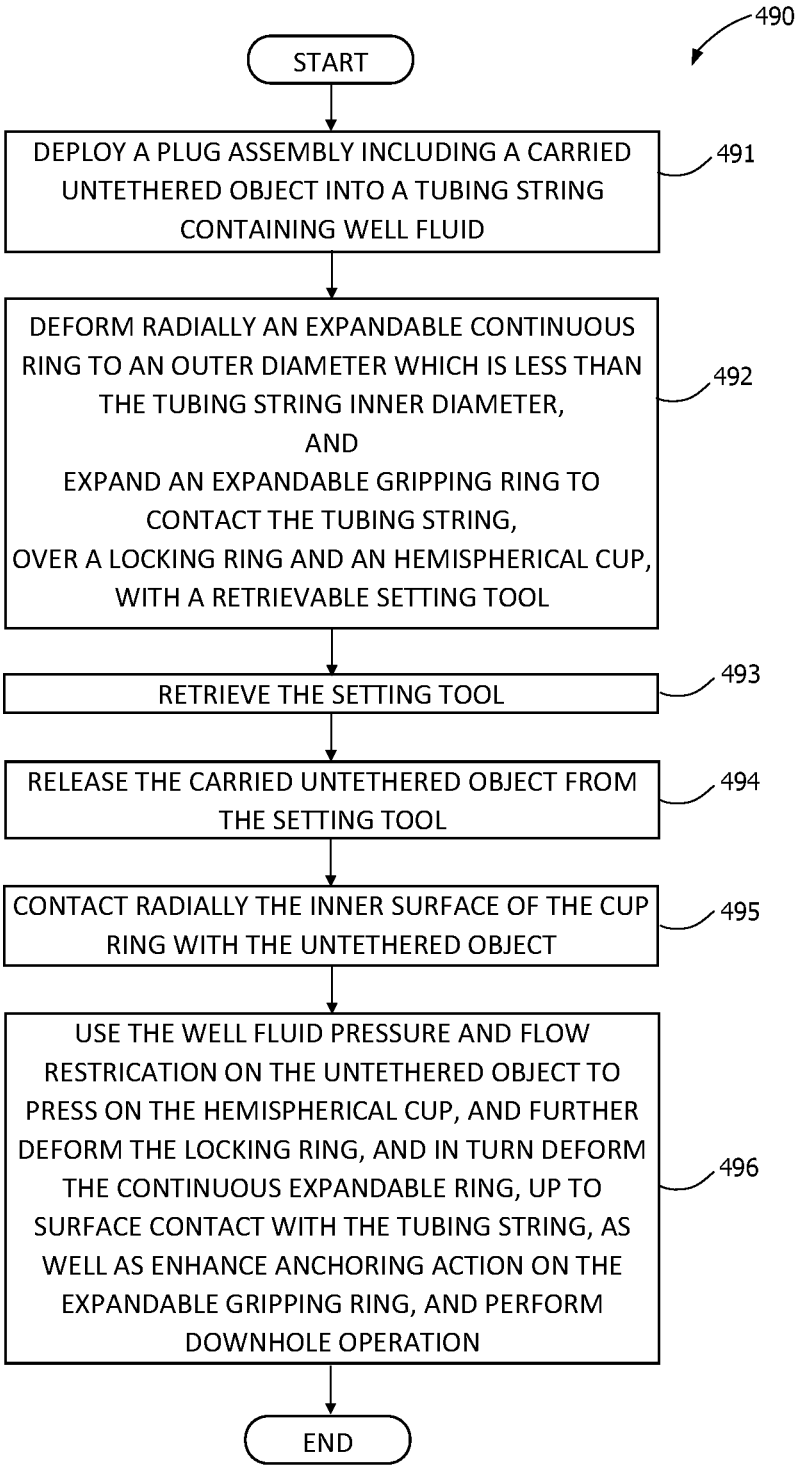
FIG. 49 is a flow diagram representing a technique sequence of deploying a plug assembly with a caged untethered object and hemispherical cup having the action of further expanding the expandable assembly and contacting a stopping surface on the locking ring.

FIG. 49 represents a technique sequence 490, which includes major steps depicted in FIG. 41A to FIG. 48B.

Step 491 corresponds to the deployment of a plug assembly (170, 410, 411, 161, 160) including a carried untethered object (413) into the tubing string (1) containing well fluid (2). During step 492, the plug assembly with its expandable continuous seal ring (170) is deformed radially, and the expandable gripping ring (161) is expanded radially, both due to the action of a retrievable setting tool, over a locking ring (410) and hemispherical cup (411). During the same step 492, the expandable gripping ring contacts at least one point of the inner surface of the tubing string (1), while the expandable continuous seal ring (170) is deformed to an outer diameter which may be less than the tubing string (1) inner diameter. Then, during step 493, the retrievable setting tool, is retrieved. Further during step 494, the carried untethered object (413), is released from the setting tool. Then, during step 495, the untethered object (413) contacts radially the inner surface of the hemispherical cup (411). Then, during step 496, the well fluid (2) pressure and flow restriction up-hole of the untethered object (413) and hemispherical cup (411) is used to act as a force to deform further the expandable continuous seal ring (170), up to its outer surface contact with the tubing string (1) inner surface, allowing further enhanced contact between all plug components from the untethered object (413) to the tubing string (1) passing through the hemispherical cup (411), the locking ring (410) and the expandable continuous seal ring (170). The same force may also enhance the anchoring action on the expandable gripping ring (161). This isolation state allows performing a downhole operation inside the well.

Thus, the disclosure describes a method comprising the step of providing a plug assembly. The plug assembly may include an expandable assembly, and a locking ring. The expandable assembly may comprise a continuous sealing portion and a gripping portion. The locking ring may include a flared outer surface and a stopping inner surface. The flared outer surface of the locking ring may be contacting the flared inner surface of the expandable assembly. The plug assembly may further include an inner surface. The method comprises the step of providing a cup. The cup may include an outer surface that is coupled to the inner surface of the plug assembly. The outer surface of the cup may be adapted to couple with the stopping inner surface of the locking ring. The method comprises the step of deploying the plug assembly and the cup into a tubing string containing well fluid. The method comprises the step of expanding the expandable assembly over the flared outer surface of the locking ring, whereby the expandable assembly may deforms radially, for example, until the gripping portion of the expandable assembly contacts at least one point of an internal surface of the tubing string. Radially deforming the expandable assembly may occur through plastic deformation of metallic alloy. The method comprises the step of launching an untethered object inside the well fluid of the tubing string. The untethered object may include an outer surface adapted to couple with the cup. The method comprises the step of contacting the untethered object with the cup, after the expandable assembly is deformed radially. The method comprises the step of applying pressure on the untethered object using the well fluid whereby forces are applied to the cup. The force may cause one or more of a radial deformation of the continuous sealing portion of the expandable assembly, a contact of an internal surface of the tubing string with the continuous sealing portion of the expandable assembly, or a longitudinal movement of the cup while contacting the flared inner surface of the plug assembly, for example, until the cup contacts the stopping inner surface of the locking ring. The method comprises the step of penetrating the internal surface of the tubing string at the at least one point with the gripping portion of the expandable assembly.

In some embodiments, the method may comprise the step of diverting a portion of the well fluid outside the tubing string, or the step of sealing a portion of the well fluid inside the tubing string with the plug assembly. The method may comprise the step of dissolving at least one component of the plug assembly, the cup, or the untethered object.

The disclosure also describes a plugging apparatus, for use inside a tubing string containing well fluid. The apparatus comprises a plug assembly, which includes an expandable assembly, a locking ring, and a cup. The expandable assembly may comprise a continuous sealing portion and a gripping portion. The expandable assembly may include a flared inner surface. The locking ring may include a flared outer surface and a stopping inner surface. The flared inner surface of the expandable assembly may be contacting the flared outer surface of the locking ring. The expandable assembly may adapted to be deformed radially. The plug assembly may further include an inner surface. The cup may include an outer surface that is coupled to the inner surface of the plug assembly. The outer surface of the cup may adapted to couple with the stopping inner surface of the locking ring. The apparatus comprises an untethered object. The untethered object may include an outer surface adapted to couple with the stopping inner surface of the locking ring. The untethered object may adapted to contact the inner surface of the plug assembly and, using well fluid pressure, to apply forces to the plug assembly. The forces may cause one or more of a radial deformation of the continuous sealing portion of the expandable assembly, a contact of an internal surface of the tubing string with the continuous sealing portion of the expandable assembly, a longitudinal movement of the untethered object while contacting the flared inner surface of the plug assembly, for example, until the untethered object contacts the stopping inner surface of the locking ring, or a penetration of the internal surface of the tubing string at least at one point with the gripping portion of the expandable assembly.

In some embodiments, the inner surface of the plug assembly may be flared. The expandable assembly may include a continuous sealing ring and a gripping ring that are separate. The continuous sealing ring and the gripping ring may be coupled longitudinally though a conical or an annular contact surface. An inner surface of the sealing ring may be adjacent to an inner surface of the gripping ring. The inner surface of the sealing ring and the inner surface of the gripping ring may form the inner surface of the expandable assembly. The expandable assembly may comprise one or more plastically deformable metallic alloys. At least one component of the plug assembly, the plug, or the untethered object may comprise a material dissolvable inside the well fluid. The apparatus may further comprising a back-pushing ring and a retrievable setting tool. The retrievable setting tool may be adapted to displace the back-pushing ring, preferably causing the radial deformation of the expandable assembly over the flared outer surface of the locking ring. A curvature of the outer surface of the plug may be larger than the curvature of the flared inner surface of the plug assembly. The locking ring may include a flared inner surface. For example, the locking ring may include at least two consecutive sections that are juxtaposed. Each of the at least two consecutive sections may have an inner surface and an outer surface. The inner surface of any of the at least two consecutive sections may be adjacent to the inner surface of a following one of the at least two consecutive sections. The outer surface of any of the at least two consecutive section may be adjacent to the outer surface of a following one of the at least two consecutive sections. The untethered object may contact the plug assembly on the inner surface of one of the at least two consecutive sections of the locking ring. Flared inner and outer surfaces on the plug assembly may include conical surfaces with angles between 2 and 40 degrees. The stopping surface of the locking ring may include one or more of annular, conical and spherical portions, and the outer surface of the plug includes at least one portion having a shape matching a portion of the stopping surface of the locking ring.

Figure 50:
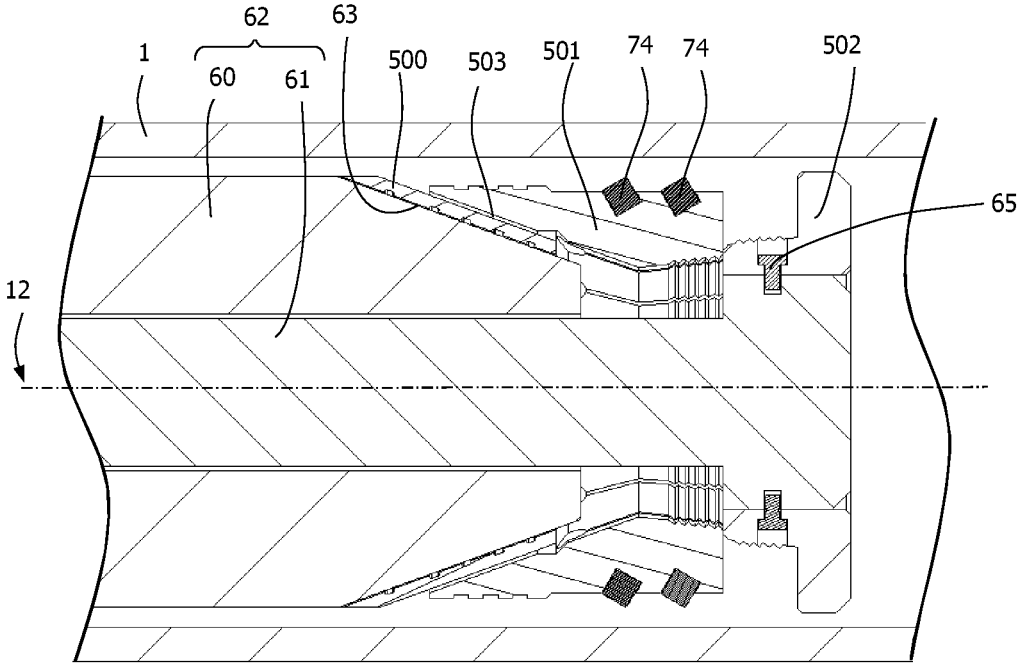
FIG. 50 is a cross-section view of another embodiment of a plug assembly, in a run-in hole position inside a tubing string, over a retrievable setting tool, using a sacrificial feature located between the plug assembly and the retrievable setting tool.

FIG. 50 represents another embodiment. FIG. 50 relates to a sacrificial feature to be located between the setting tool 62 and the plug when the plug is in its run-in-hole or unexpanded position. FIG. 50 represents a cross-sectional view of the plug on its setting tool 62, including a rod 61 and a mandrel 60 providing an expansion punch, within a tubing string 1. The plug is represented with an expandable ring 501 containing gripping features, such as buttons 74, a back-pushing locking ring 502 and shearing parts 65. Note that other plug embodiments described in FIGS. 15A to 34 would also be compatible with the sacrificial feature.

The sacrificial feature is represented as a sacrificial layer 500, having an internal surface in contact with the conical surface 63 of the expansion punch provided by the mandrel 60, and having an external surface in contact with the conical surface 503 of the expandable ring 501.

Other surface combinations may be possible as long as substantial contact exists between the expansion punch provided by the mandrel 60, the sacrificial cone 500 and the expandable ring 501. For example, surfaces may have a combination of cylindrical, annular, flared, hemispherical surfaces.

Figure 51A:
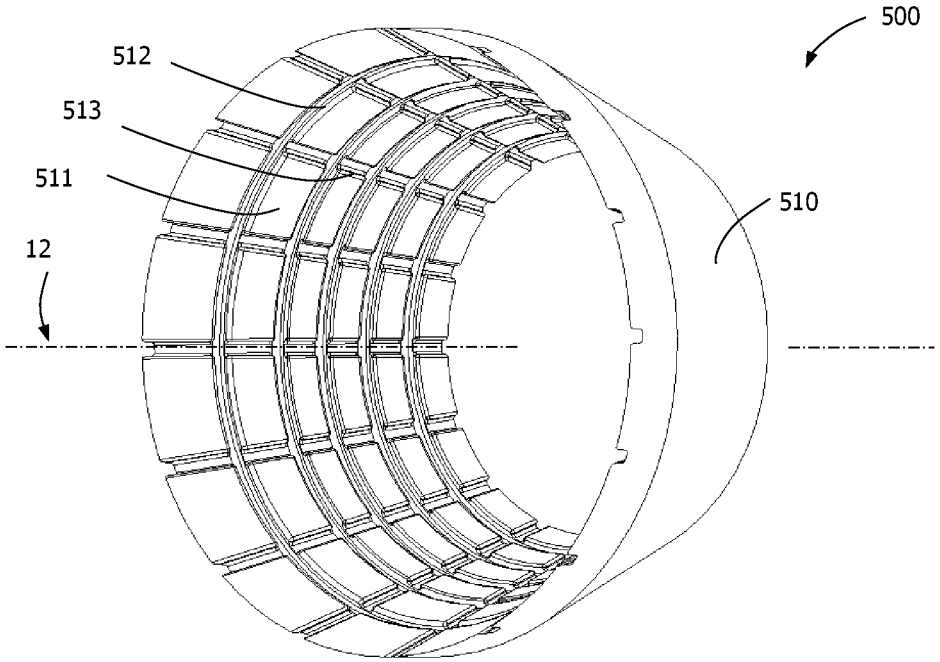
FIG. 51A is an isometric view of a sacrificial feature, according to an example embodiment.
Figure 51B:
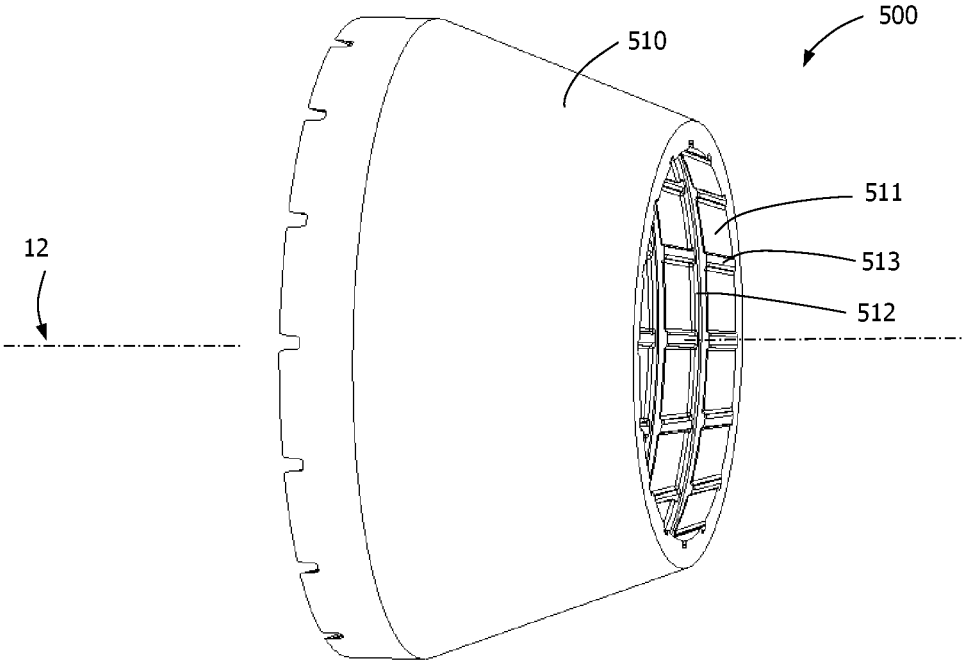
FIG. 51B is an isometric view of FIG. 51A from another orientation.

FIGS. 51A and 51B represent isometric views of the sacrificial cone 500.

The outside surface 510 may be conical to match the surface 503 of the expandable ring 501 shown in FIG. 50. The outside surface 510 is kept mainly continuous or slick to allow the expansion movement of the expandable ring 501. Possible and acceptable surface features on the outside surface 510, may be longitudinal grooves.

The inner surface is represented with circumferential grooves 512 and longitudinal grooves 513, creating polygons, here quadrilateral sections 511, while keeping an essentially conical internal surface.

The spacing of the circumferential and longitudinal grooves 513 and 512 may condition the surface of the quadrilateral sections 511.

Note that the embodiment would be compatible with other grooves pattern creating other polygons, such as triangles, hexagons, octagons. Grooves may also be curved resulting in curved sections.

Figure 55:
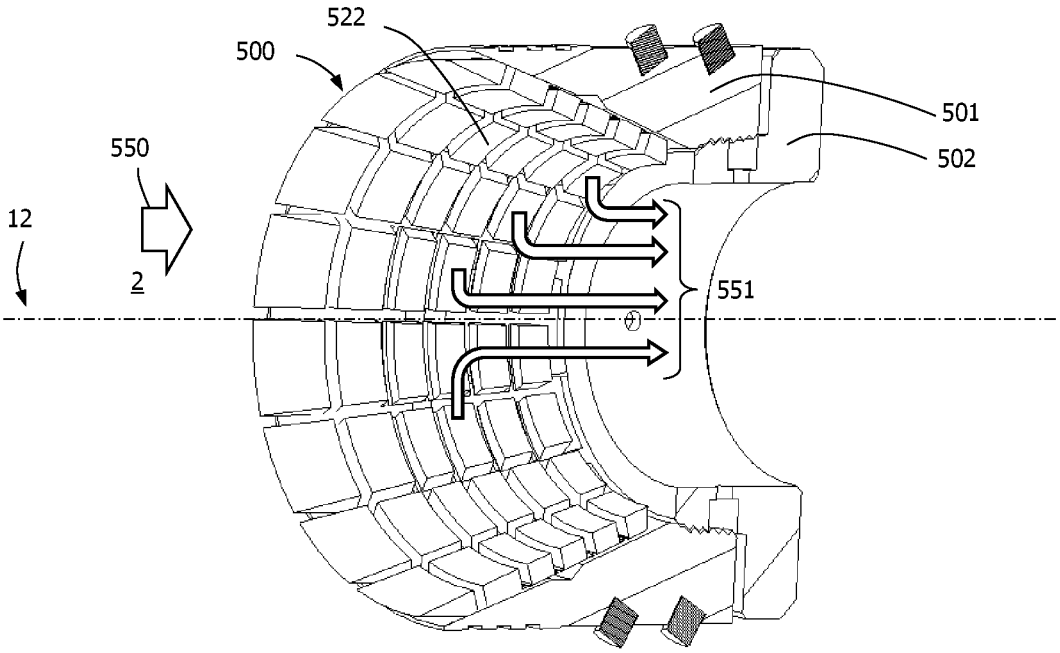
FIG. 55 is an isometric cross-section view of the plug assembly and the smaller segments of the sacrificial feature able to get free inside the well fluid.
Figure 56:
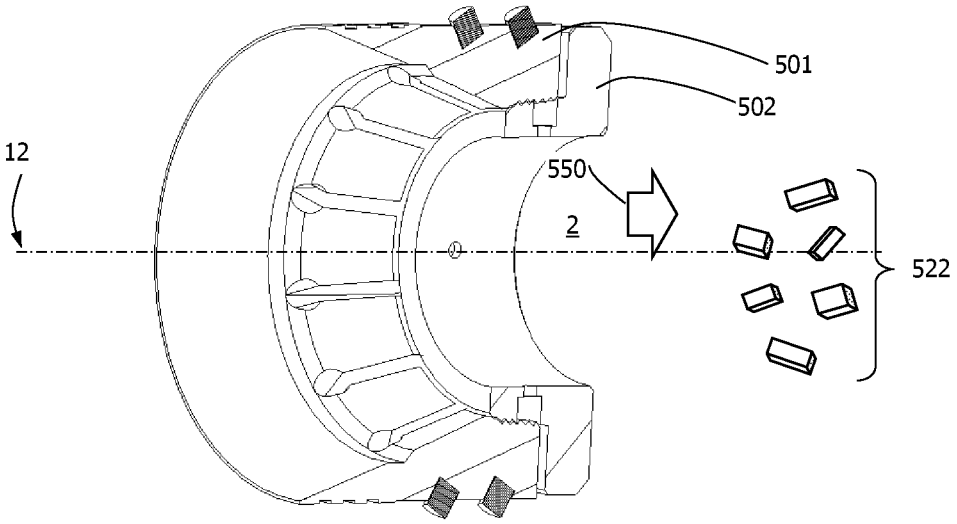
FIG. 56 is an isometric cross-section view of the plug assembly with the smaller segments of the sacrificial feature being dispersed inside the well fluid.
Figure 57:
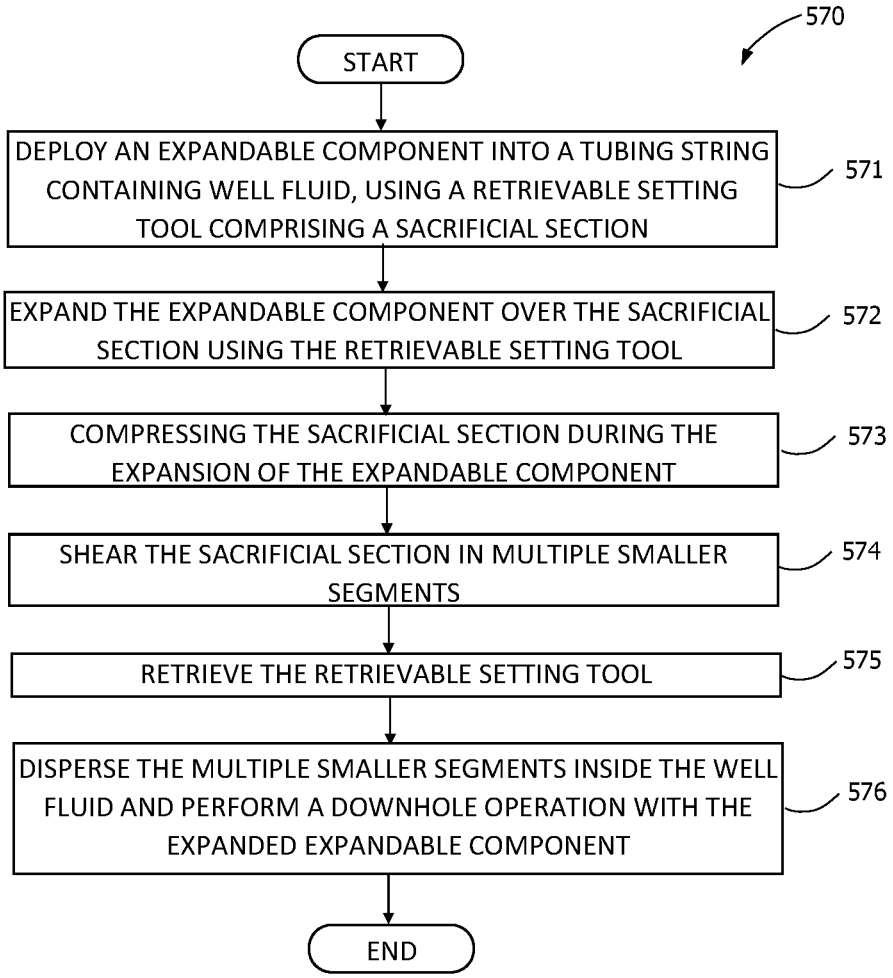
FIG. 57 is a flow diagram representing a technique sequence of deploying an expandable assembly over a retrievable setting tool, using a sacrificial feature located between the plug assembly and the retrievable setting tool.

FIG. 57 represents a technique sequence 570, which includes steps depicted from FIG. 52A to FIG. 56.

Figure 52A:
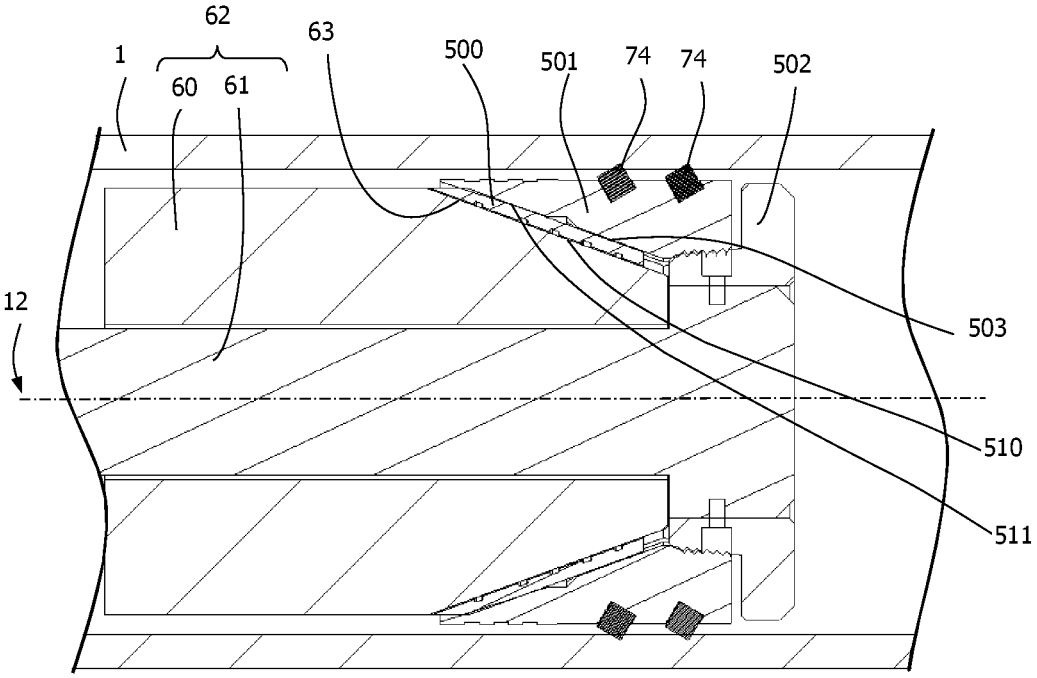
FIG. 52A is a cross-section view of a plug assembly, in a set position inside a tubing string, over a retrievable setting tool, using a sacrificial feature located between the plug assembly and the retrievable setting tool.

The method may comprise the step 571, involving the deployment of an expandable ring 501 into a wellbore containing well fluid, using a retrievable setting tool, the retrievable setting tool comprising a sacrificial layer 500, for example as shown in FIG. 52A.

Figure 52B:
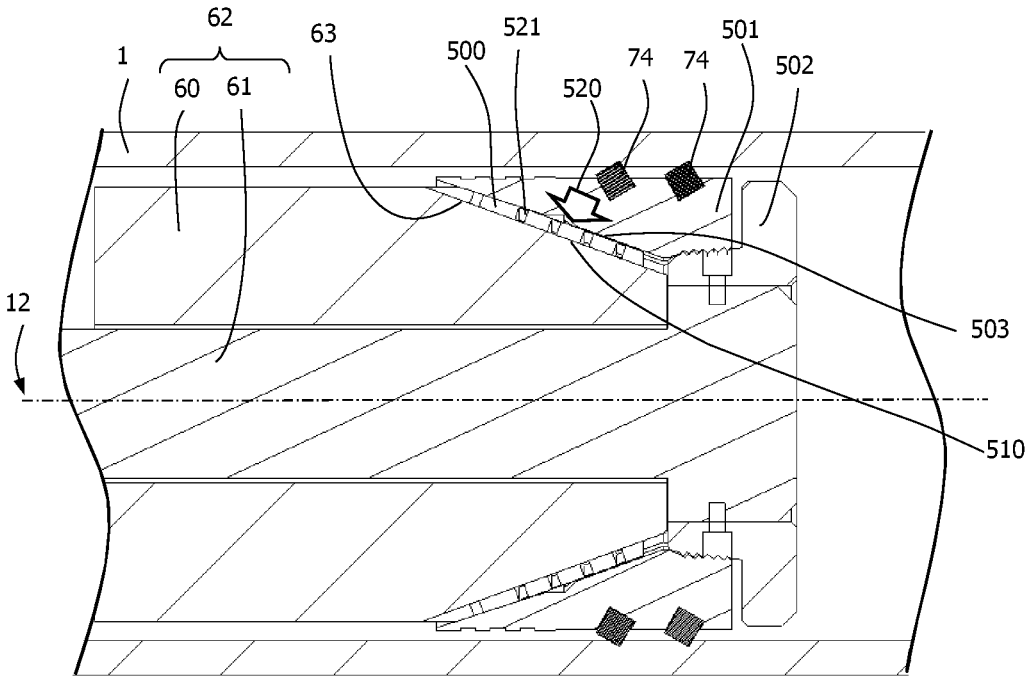
FIG. 52B is a cross-section view of a plug assembly, in a set position inside a tubing string, over a retrievable setting tool, having the sacrificial feature under compression constraint and separating in smaller segments at the end of the setting sequence.

The method may comprise the step 572, involving the actuation of the retrievable setting tool to expand the expandable ring 501 over the sacrificial layer 500, for example as shown in FIG. 52B.

The method may comprise the step 573, involving the compression of the sacrificial layer 500 during the expansion of the expandable ring 501, for example as shown in FIG. 52B. The layer 500 may facilitate the expansion of the expandable ring 501 because there it can provide a low friction force against the expansion punch of the mandrel 60.

Figure 54:
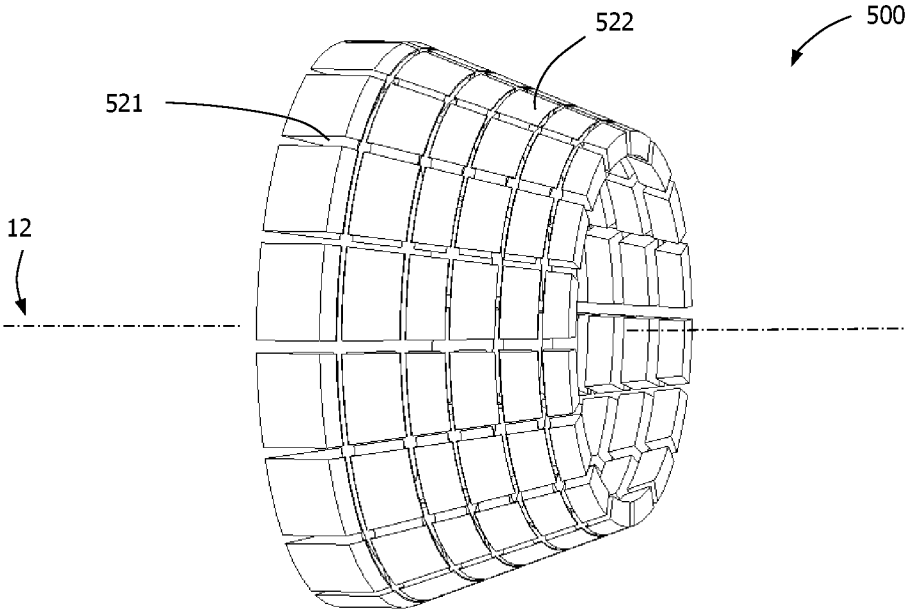
FIG. 54 is an isometric view of the sacrificial feature separated in smaller segments.

The compression may be so that the sacrificial layer 500 breaks or shears into in multiple smaller segments 522 separated by gaps 521. Thus, the method may comprise the step 574 involving the breaking or shearing of the layer 500, for example as shown in FIG. 54 in which only the layer 500 is represented.

Figure 53:
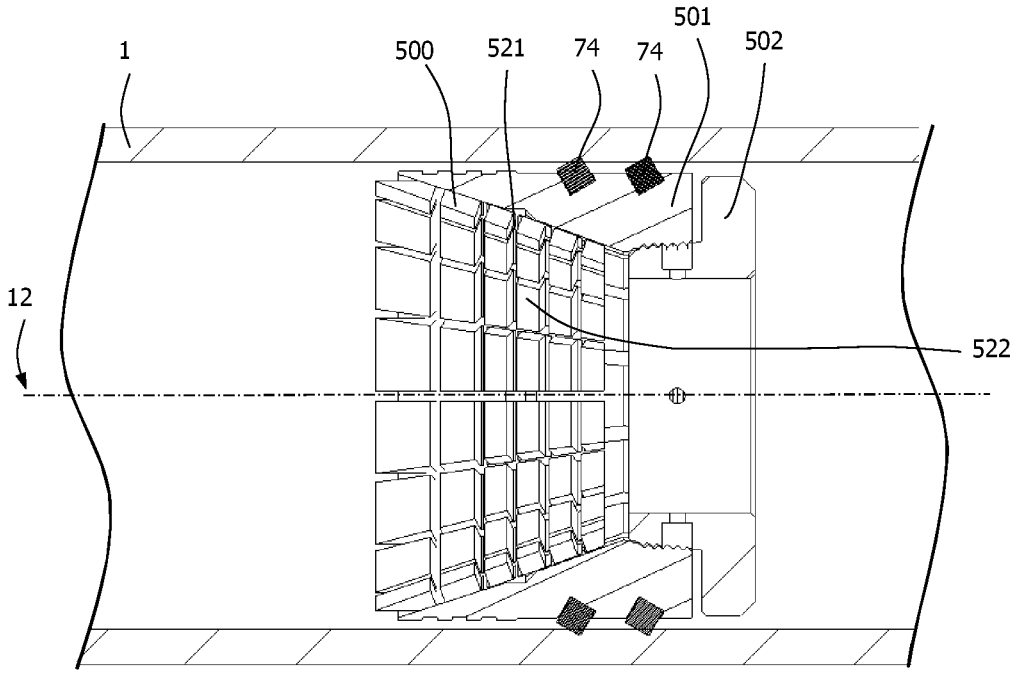
FIG. 53 is a cross-section isometric view of FIG. 52B inside the tubing string, after retrieval of the retrievable setting tool.

The method may comprise the step 575, involving the retrieval of the retrievable setting tool, for example as shown in FIG. 53. The layer 500 may facilitate the retrieval of the retrievable setting tool because it can provide a low friction force against the expansion punch of the mandrel 60.

The method may comprise the step 576, involving the dispersion of the multiple smaller segments 522 of the sacrificial layer 500 inside the well fluid of the wellbore, as indicated by arrow 551 in FIG. 55 and shown in FIG. 56.

The corresponding apparatus would be a retrievable setting tool apparatus, inside a wellbore containing well fluid, including:

a mandrel providing an expansion punch and a rod,
a sacrificial layer,
an expandable ring,
wherein the rod and the mandrel are adapted to expand the expandable component,
wherein the sacrificial section is positioned between the mandrel and the expandable component,
wherein the sacrificial section shears in multiple smaller segments under compression load.

What is claimed is:

1. A method comprising:

deploying a plug assembly into a tubing string containing well fluid, the plug assembly including:
an expandable assembly, comprising a continuous sealing portion and a gripping portion,
a locking ring,
a cup,
wherein the expandable assembly includes a flared inner surface,
wherein the locking ring includes a flared outer surface, a stopping inner surface, and a flared portion,
wherein the flared portion of the locking ring includes a flared inner surface positioned opposite of the flared outer surface,
wherein the cup includes a flared outer surface, a stopping outer surface and a stopping inner surface,
wherein the flared outer surface of the locking ring is contacting the flared inner surface of the expandable assembly,
wherein the flared outer surface of the cup is contacting the flared inner surface of the locking ring,
wherein the stopping outer surface of the cup is adapted to couple with the stopping inner surface of the locking ring;

expanding the expandable assembly over the flared outer surface of the locking ring, whereby the expandable assembly deforms radially until the gripping portion of the expandable assembly contacts at least one point of an internal surface of the tubing string;

launching an untethered object inside the well fluid of the tubing string, wherein the untethered object includes an outer surface adapted to couple with the stopping inner surface of the cup;

contacting the untethered object with the stopping inner surface of the cup, after the expandable assembly is deformed radially;

applying pressure on the untethered object and on the cup using the well fluid whereby forces are applied to the plug assembly to cause:
the radial deformation of the flared portion of the locking ring,
the radial deformation of the continuous sealing portion of the expandable assembly,
the contact of an internal surface of the tubing string with the continuous sealing portion of the expandable assembly,
the longitudinal movement of the cup while contacting the flared inner surface of the locking ring until the stopping outer surface of the cup contacts the stopping inner surface of the locking ring; and penetrating the internal surface of the tubing string at the at least one point with the gripping portion of the expandable assembly.

2. The method of claim 1, further comprising diverting a portion of the well fluid outside the tubing string, or sealing a portion of the well fluid inside the tubing string with the plug assembly.

3. The method of claim 1, wherein radially deforming the expandable assembly occurs through plastic deformation of metallic alloy.

4. The method of claim 1, further comprising dissolving at least one component of the plug assembly or the untethered object.

5. The method of claim 1, wherein the expandable assembly includes a continuous sealing ring and a gripping ring that are separate, wherein the continuous sealing ring and the gripping ring are coupled longitudinally through a conical or an annular contact surface, and wherein the inner surface of the continuous sealing ring and the inner surface of the gripping ring form the flared inner surface of the expandable assembly.

6. The method of claim 1, wherein launching the untethered object inside the well fluid occurs from surface or directly released from the plugging assembly as part of the plug deployment inside the tubing string.

7. A plugging apparatus, for use inside a tubing string containing well fluid, comprising:

a plug assembly including:

an expandable assembly, comprising a continuous sealing portion and a gripping portion, a locking ring, a cup, wherein the expandable assembly includes a flared inner surface, wherein the locking ring includes a flared outer surface, a stopping inner surface, and a flared portion, wherein the flared portion of the locking ring includes a flared inner surface positioned opposite of the flared outer surface, wherein the cup includes a flared outer surface, a stopping outer surface and a stopping inner surface, wherein the flared outer surface of the locking ring is contacting the flared inner surface of the expandable assembly, wherein the flared outer surface of the cup is contacting the flared inner surface of the locking ring, wherein the stopping outer surface of the cup is adapted to couple with the stopping inner surface of the locking ring;

wherein the locking ring includes a flared outer surface and a stopping inner surface, wherein the flared inner surface of the expandable assembly is contacting the flared outer surface of the locking ring, and wherein the expandable assembly is adapted to be deformed radially;

an untethered object, wherein the untethered object includes an outer surface adapted to couple with the stopping inner surface of the cup and, using well fluid pressure, to apply forces to the plug assembly to cause:

the radial deformation of the flared portion of the locking ring, the radial deformation of the continuous sealing portion of the expandable assembly, the contact of an internal surface of the tubing string with the continuous sealing portion of the expandable assembly, the longitudinal movement of the cup while contacting the inner surface of the locking ring until the stopping outer surface of the cup contacts the stopping inner surface of the locking ring, and the penetration of the internal surface of the tubing string at least at one point with the gripping portion of the expandable assembly.

8. The apparatus of claim 7, wherein the expandable assembly includes a continuous sealing ring and a gripping ring that are separate, wherein the continuous sealing ring and the gripping ring are coupled longitudinally through a conical or an annular contact surface, wherein an inner surface of the continuous sealing ring is adjacent to an inner surface of the gripping ring, and wherein the inner surface of the continuous sealing ring and the inner surface of the gripping ring form the inner surface of the expandable assembly.

9. The apparatus of claim 7, wherein the expandable assembly comprises one or more plastically deformable metallic alloys.

10. The apparatus of claim 7, wherein at least one component of the plug assembly or the untethered object comprise a material dissolvable inside the well fluid.

11. The apparatus of claim 7, further comprising a back-pushing ring and a retrievable setting tool, wherein the retrievable setting tool is adapted to displace the back-pushing ring causing the radial deformation of the expandable assembly over the flared outer surface of the locking ring.

12. The apparatus of claim 11, wherein the retrievable setting tool includes a mandrel and a rod, wherein the mandrel has a surface including one or more of annular, conical, and spherical portions, wherein the mandrel contacts the inner surface of the locking ring with the surface including one or more of annular, conical, and spherical portions, wherein the rod couples to the back-pushing ring with a preset load-shearing device.

13. The apparatus of claim 11, wherein the retrievable setting tool is configured to be retrieved, after the radial expansion of the expandable assembly.

14. The apparatus of claim 13, wherein the untethered object is included inside the retrievable setting tool, wherein the untethered object is launched from the retrievable setting tool after the radial expansion of the expandable assembly and before the retrieval of the retrievable setting tool.

15. The apparatus of claim 7, wherein the untethered object is launched from surface.

16. The apparatus of claim 7, wherein the untethered object is a ball, a dart, or a pill.

17. The apparatus of claim 7, wherein the flared portion of the locking ring between the flared outer surface and the flared inner surface is a thin section, including a material capable of deforming radially, elastically or plastically, between 1% and 30%, under the forces applied by the cup and the untethered object to the plug assembly, upon the well fluid being pressurized between 100 and 15,000 psi [0.7 to 100 MPa].

18. The apparatus of claim 17, wherein the thin section includes a radial thickness between 0.02 to 0.4 inches [0.5 to 10 mm].

19. The apparatus of claim 7, wherein the stopping surface of the locking ring includes one or more of annular, conical and spherical portions, and wherein the outer surface of the cup includes at least one portion having a shape matching a portion of the stopping surface of the locking ring.

20. The apparatus of claim 7, wherein the flared inner and outer surfaces on the locking ring, as well as the flared outer surface of the cup include conical surfaces with angles between 2 and 40 degrees.

* * * * *